US006644748B2

(12) United States Patent
Tholkes et al.

(10) Patent No.: US 6,644,748 B2
(45) Date of Patent: Nov. 11, 2003

(54) SYNERGISTIC BODY POSITIONING AND DYNAMIC SUPPORT SYSTEM

(75) Inventors: Alan L. Tholkes, Farmington, MN (US); Jack Hockenberry, Albert Lea, MN (US); DuWayne Dandurand, Redwood Falls, MN (US)

(73) Assignee: Health Postures, Inc., Belle Plaine, MN (US)

( * ) Notice: Subject to any disclaimer, the term of this patent is extended or adjusted under 35 U.S.C. 154(b) by 0 days.

(21) Appl. No.: 09/750,541

(22) Filed: Dec. 28, 2000

(65) Prior Publication Data

US 2001/0015567 A1 Aug. 23, 2001

Related U.S. Application Data

(63) Continuation-in-part of application No. 09/513,374, filed on Feb. 25, 2000, now Pat. No. 6,439,657, and a continuation-in-part of application No. 09/257,900, filed on Feb. 25, 1999.

(51) Int. Cl.[7] ..... A47C 7/50

(52) U.S. Cl. ..... 297/423.12; 297/172; 297/135; 248/280.11; 248/286.11

(58) Field of Search ..... 248/125.7, 286.1, 248/287.1, 280.11, 281.11, 286.11; 108/50.02, 95, 94, 96, 103; 297/172, 187, 423.11, 423.12, 423.26, 174, 301.1, 135, 344.19; 312/223.3

(56) References Cited

U.S. PATENT DOCUMENTS 2,464,690 A * 3/1949 Ketchem
4,365,561 A * 12/1982 Tellier et al.
4,548,373 A * 10/1985 Komura ..... 248/280.1 X (List continued on next page.)

FOREIGN PATENT DOCUMENTS

EP 0513838 A 11/1992

OTHER PUBLICATIONS

CTDNEWS, Supplement to CTDNews: Prevention, 1998 LP Publications, vol. 7, No. 9, Sep. 1998*.

"The Power of Being First," Neutral Posture, Ergonomics, Inc. (brochure)*.

Steelcase Advertisement, 14 pages.

(List continued on next page.)

*Primary Examiner*—Peter R. Brown
*Assistant Examiner*—Stephen Vu
(74) *Attorney, Agent, or Firm*—Patterson, Thuente, Skaar & Christensen, P.A.

(57) ABSTRACT

An operator adjustable workstation is provided, ranging from a seated work level to a standing work level with an infinite number of health posture arrangements and work surface levels in between. Two trigger controlled height and angle adjustment body support actuators and a foot controlled lower leg and lower leg support pivot actuator, provide the operator with independent control to quickly lock into place and/or release each health posture and work surface at any level within the adjustment range. The workstation includes a base structure, a body support area, a work surface area, and lift arm. The work surface area incorporates two substantially planar work surfaces. The body support area incorporates seat, back, lower leg and lower leg support components. The body support and work areas incorporate two separate lift arms. The lift arms have first ends and second ends. The first ends are pivotally secured to the base structure while the second ends are pivotally secured to their respective body support and work area components. These first ends and second ends pivot through a range of motion to raise and lower the work and body support areas from a seated to a standing work level.

48 Claims, 40 Drawing Sheets

U.S. PATENT DOCUMENTS

| | | | | | |
|---|---|---|---|---|---|
| 4,552,404 | A | | 11/1985 | Congleton | |
| 4,639,039 | A | | 1/1987 | Donovan | |
| 4,687,167 | A | * | 8/1987 | Skalka et al. | 248/282 |
| 4,736,982 | A | | 4/1988 | Hwang | |
| 4,741,547 | A | | 5/1988 | Tholkes | |
| D296,959 | S | | 8/1988 | Gusrud | |
| 4,765,684 | A | | 8/1988 | Kvalheim | |
| 4,768,744 | A | * | 9/1988 | Leeds et al. | 248/280.1 |
| 4,779,540 | A | * | 10/1988 | Dion et al. | |
| 4,783,036 | A | * | 11/1988 | Vossoughi | 248/281.1 |
| 4,793,655 | A | | 12/1988 | Kvalheim | |
| 4,852,500 | A | * | 8/1989 | Ryburg et al. | |
| 4,880,270 | A | * | 11/1989 | Cooper | |
| 4,898,103 | A | | 2/1990 | Pontoppidan | |
| 5,054,852 | A | | 10/1991 | Tholkes | |
| D327,375 | S | | 6/1992 | Cooper | |
| 5,119,078 | A | | 6/1992 | Grant | |
| 5,149,174 | A | | 9/1992 | Charash | |
| 5,174,223 | A | * | 12/1992 | Nagy et al. | 108/50 |
| 5,186,519 | A | | 2/1993 | Larson | |
| 5,199,360 | A | | 4/1993 | Koistinen | |
| 5,255,957 | A | | 10/1993 | Opsvik | |
| 5,330,254 | A | | 7/1994 | Larson | |
| 5,437,235 | A | * | 8/1995 | Randolph | |
| 5,470,041 | A | | 11/1995 | Cucinotta | |
| 5,484,151 | A | | 1/1996 | Tholkes | |
| D373,030 | S | | 8/1996 | Chen | |
| 5,542,746 | A | | 8/1996 | Bujaryn | |
| 5,584,546 | A | | 12/1996 | Gurin | |
| D380,910 | S | | 7/1997 | LeSourd | |
| 5,653,499 | A | | 8/1997 | Goodall | |
| 5,667,278 | A | | 9/1997 | Li | |
| 5,765,910 | A | | 6/1998 | Larkin | |
| 5,782,534 | A | | 7/1998 | Desanta | |
| 5,823,120 | A | | 10/1998 | Holmquist | |
| 5,871,258 | A | | 2/1999 | Battey | |
| 5,909,923 | A | | 6/1999 | DeKraker | |
| 5,975,634 | A | | 11/1999 | Knoblock | |
| 5,979,984 | A | | 11/1999 | DeKraker | |
| D425,321 | S | * | 5/2000 | Tholkes et al. | D6/338 |
| 6,076,785 | A | * | 6/2000 | Oddsen, Jr. | 248/280.11 X |
| 6,466,432 | B1 | * | 10/2002 | Beger | 361/681 |

OTHER PUBLICATIONS

Eldon Brochure, 8 pages.
Mayline Brochure, 8 pages.
Photograph of ergonomic desk.
Cooltools Advertisement, 2 pages.
Net surfer Advertisement, 2 pages.
Computer Recliner Advertisement, 2 pages.
Computer Recliner Advertisement, "The Back Station™", 2 pages.

* cited by examiner 57
56
58
51
46
54
64
62
60
68
61
42
27
26
102
20
104
24
23
22

384
460
466
468
462
454
476
464
458
374b
487
472
477
376
474
470
456
375
385
386
C
D
482
484
486
488
477
480
478
479
454
494
492
490
462
476

746
748
SEAT UP
SEAT TILT
LEG FWD
DN
TILT/
REAR
PROGRAM
758
744
726
PWR
724
SEAT
728
UP
DN
SEAT
TILT
TILT
730
LEG
FWD
REAR
732
740
MEMORY
1.
2.
3.
750
MEMORY
INITIALIZE
756
752
754
742
PROCESSOR
706
704
710
708
712
700
716
720
718
702
714

SYNERGISTIC BODY POSITIONING AND DYNAMIC SUPPORT SYSTEM

RELATED APPLICATIONS

This is a Continuation-in-Part of application Ser. No. 09/257,900, filed Feb. 25, 1999, and is a CIP application Ser. No. 09/513,374, filed Feb. 25, 2000 now U.S. Pat. No. 6,439,657.

BACKGROUND OF THE INVENTION

1. Field of the Invention

The present invention generally relates to a body positioner structured to provide healthy postures by promoting active sitting and proactive positioning. The positioner enables accurate and repeatable correlation between a user's body and a work station by enabling quick postural adjustments based on the preferred postural excursions of the user. Particularly, the body positioner is preferably integrated with at least one work station such as, for example, a computer or manufacturing station. More particularly, the invention provides integration of the positioner with a seating task station, enabling quick dynamic adjustments for optimal alignment and orientation of the positioner and the user relative to the seating task station within a plurality of healthy postures and ergonomic ranges to promote worker health, comfort and productivity.

2. Description of Related Art

In the early 1970's Jerome Congleton, a leading ergonomist, was the first to introduce the concept of the neutral position to the task seating industry. Further, A. C. Mandal, in a book relating to unhealthy postures of school children, emphasized the need to tilt the pelvis forward in order to maintain a proper balance of the weight of the upper body on the spine. These and other ergonomic research over the last three decades have shown that certain postural orientations, particularly during sitting, affect the body weight distribution on the spine and generally result in injury or long term pain. For the most part therefore, ergonomic research over the past three decades appears to support the concept of proper body weight distribution by maintaining certain postures. However, heretofore, no system exists which would enable a person, particularly engaged in work involving task seating systems and related operations, to shift into comfortable positions, quickly without disrupting work.

Several medical studies have shown that prolonged static postures in any of the natural configurations such as, for example, sitting and standing cause discomfort, pain and ultimately injury. Modern work stations such as computer related work at the office require that the operator be oriented in a sedentary position. When a subject is in a limited movement sitting position muscle stress and discomfort occur. Specifically, during sitting, the vertebral column transmits the weight of the body through the pelvis to the lower limbs. When the vertebral column experiences prolonged stress due to sedentary postures, a deformity of the spine may result leading to serious medical problems such as kyphosis which is characterized by a posterior curvature of the vertebral column. Further, prolonged sedentary sitting may contribute and/or aggravate scoliosis, characterized by a lateral curvature of the vertebral column and lordosis, characterized by an anterior curvature of the vertebral column. Movements of the vertebral column are freer in the cervical and lumbar regions and these regions are the most frequent sites of discomfort and pain. The main movements of the vertebral column are flexion or forward bending, extension or backward bending, lateral bending or lateral flexion, and rotation or twisting of the vertebra relative to each other. Some circumduction which consists of flexion-extension and lateral bending also occurs. It is imperative, therefore, that a body positioning system provide movement, at the very least, to the cervical and lumbar regions of the vertebral column.

In addition to the vertebral column, a body support system implemented to position a person proximal to a work station must be ergonomically balanced with the work station. In this regard the upper limb, which is the organ of manual activity, should be allowed to move freely. Further, the upper limb which includes the shoulder, arm, forearm and hand must be positioned to provide stability and to gain mobility. Because any slight injury to the upper limb is further aggravated by repeated motion of the hand and arm muscles, it is important to provide comfortable positioning and support to the upper limb at all postures related to a task seating work station.

Similarly, a well-designed body support system should consider neck and head position. The neck contains vessels, nerves, and other structures connect in the head and the trunk. There are several causes of neck pain. As it relates to neck pain resulting from bad postures, muscle strain and protrusion of a cervical intervertebral disc may be the cause. Many vital structures are located in the neck and proper positioning and support of the neck must be made to avoid muscle strain. Further, posterior positioning to the head is important to avoid strain, headache and head pain.

Lumbar and thoracic support are also vital to promote good breathing and elimination of stress on the lumbar and thoracic vertebrae. As it is well known clinically, the lungs are the essential organs of respiration. The inspired air is brought in close relationship to the blood in the pulmonary capillaries. Thus, proper positioning and thoracic support enhances the efficiency of the lungs to supply optimal oxygen levels to the blood. This is key to worker overall health and productivity.

The lower limb, including the upper and lower leg, ankle, and foot, is the organ of locomotion and is also a load bearing element. The parts of the lower limb are comparable to those of the upper limb. The lower limb is heavier and stronger than the upper limb. Since a vast number of vital networks of arterial vessels are located in the lower limb, it is medically important to promote the flow of blood through these arterial vessels. Thus, in sedentary postures, frequent removal of weight off the lower limb is recommended to eliminate muscle tension, fatigue and related degenerative joint disease.

In general, the present state of the art is incapable of providing a full authropometric range to users with the option to switch to different comfortable/healthy postures while keeping them within an ergonomic range of a work station in a manner that is non-disruptive to the task being performed. Particularly, the present state of the art does not provide an "active sitting and proactive positioning" system which incorporates the support of the various body parts and promotes healthy postures and comfort at work stations.

Accordingly, there is a need for a body positioning system capable of providing fluidic and timely transposition of a user into various preferred and healthy postural configurations, maintaining comfortable ergonomic ranges to a task seating work station at all postures and enhancing health and productivity relative to a defined space-volume envelope of the positioning system and, preferably to a work station integrated therewith.

SUMMARY OF THE INVENTION

The present invention is based on the heretofore unrealized objective to successfully integrate human performance with comfort and health. Specifically, in the preferred embodiment, the invention implements principles of "active sitting and proactive positioning" in which the subject is temporally encouraged to change to various comfort and health postures while maintaining ergonomically compatible access and reach to a work station at all times.

The invention provides a user with a selection of discrete and dynamic medically preferred health postures. Specifically, the invention utilizes, inter alia, the principle that to prevent cumulative trauma disorder (CTD) the pelvis must always be positioned in an orientation similar to an erect/tilted position during standing. The basic discrete postures of the present invention include a recline seated posture, a recline neutral posture/breath-easy posture and a recline standing posture. The invention incorporates these discrete postures to generate a full range of dynamic hybrid postures continuously shiftable and adjustable to prevent injury, discomfort and fatigue while enhancing health and comfort. Further, the invention proactively positions the user to be placed within an ergonomic range of the work station, at all postural configurations to enhance productivity.

The invention enables the user to move in and out of the discrete and dynamic postures without disrupting the task at hand. One of the significant benefits derived from this active sitting aspect of the invention is that the user is provided with a full range of joint movement in the legs and torso during the excursion through the various postures. Further, the postures enhance the respiratory fluid flow and joint lubrication systems and relieve muscle stress. The user may also perform occasional stretch exercises, by shifting through these various postures to increase vital fluid flow and circulation in the torso and lower parts of the body.

The invention includes a body positioning system having components designed to be compatible with human physiology and enhancement of healthy postures at work stations. Specifically, the major components include a seat/back support, a body support component for below the lower leg, and a foot rest body support all being independently and correlatively operable at the option(s) of the user to navigate through various postures while maintaining ergonomic reach to the work station. More specifically, the seat/back support and the support for below the lower leg comprise pressure surfaces having ergonomically optimized/compatible geometric shapes to enable a smooth transition from one posture to the next in addition to the provision of proper body support and healthy positions at all postural configurations. Further, the surfaces are made of materials specifically structured to eliminate excessive resistance, during the user's dynamic excursions through the various postures or during any static posture, irrespective of the type and fabric of clothing worn by the user. Since the pressure surfaces/bearing surfaces are implemented to shiftably serve as back and seat support at various postures, the interaction between the surfaces and the user's clothing is critical to promote smooth transition of the user from one posture to the other.

The controls and actuators implemented in the present invention, which control the body positioning system seat/back angle adjustment, seat height adjustment and lower body part support angle adjustment, are ergonomically designed to have a high level of accessibility and availability to the user. Further, the actuators are set to meet the anthropometric fit requirements of a world population. Particularly, the controls are designed and located to enable a user to quickly and easily shift from one posture to another without disruption of the task being performed.

The present invention further provides robust features integrated to enhance productivity and worker effectiveness. The user is generically integrated with the positioning system and work station such that all the components are positioned to be readily accessible and available to the user while enabling work to progress concurrent with multiple posture position shifting. Further, the work station is designed to attenuate the transfer of vibration to the positioner by strategically installing vibration dampeners and shock absorbing connections at points of contact between the user, the work station, work tools, and the positioner.

The office environment is one of the many work areas in which the present invention could be advantageously implemented. The body positioning system is dimensionally optimized to fit into most office space and is highly mobile to be compatible with movable wall offices. Further, the system of the present invention is modularized to stand alone or to be incorporated into multiple work station areas.

In the preferred embodiment, the controls and mechanical systems are versatile to adapt to various power supply systems. Further, ease of assembly and disassembly make the system advantageously flexible to accommodate the user's choices and be compatible with various production and work area environments.

With these and other features, advantages and objects of the present invention which may become apparent, the various aspects of the invention may be more clearly understood by reference to the following detailed description of the preferred embodiment, the appended claims and to the several drawings herein contained.

DETAILED DESCRIPTION OF THE PREFERRED EMBODIMENTS

The present invention is able to accommodate the various shifts in weight and pressure normally encountered by the body when an individual changes from one posture to another. More particularly, the invention mimics ergonomically desirable postural silhouettes to proactively support and position the user in the most healthy posture, such that body weight and pressure are distributed to eliminate undue discomfort, pain, fatigue, and muscular and skeletal strain. Thus, one of the significant features of the present invention is the elimination of discomfort and potential injury caused by most sitting postures when the individual is forced to sit in an upright posture or other unhealthy postures for an extended time period.

Figure 1:
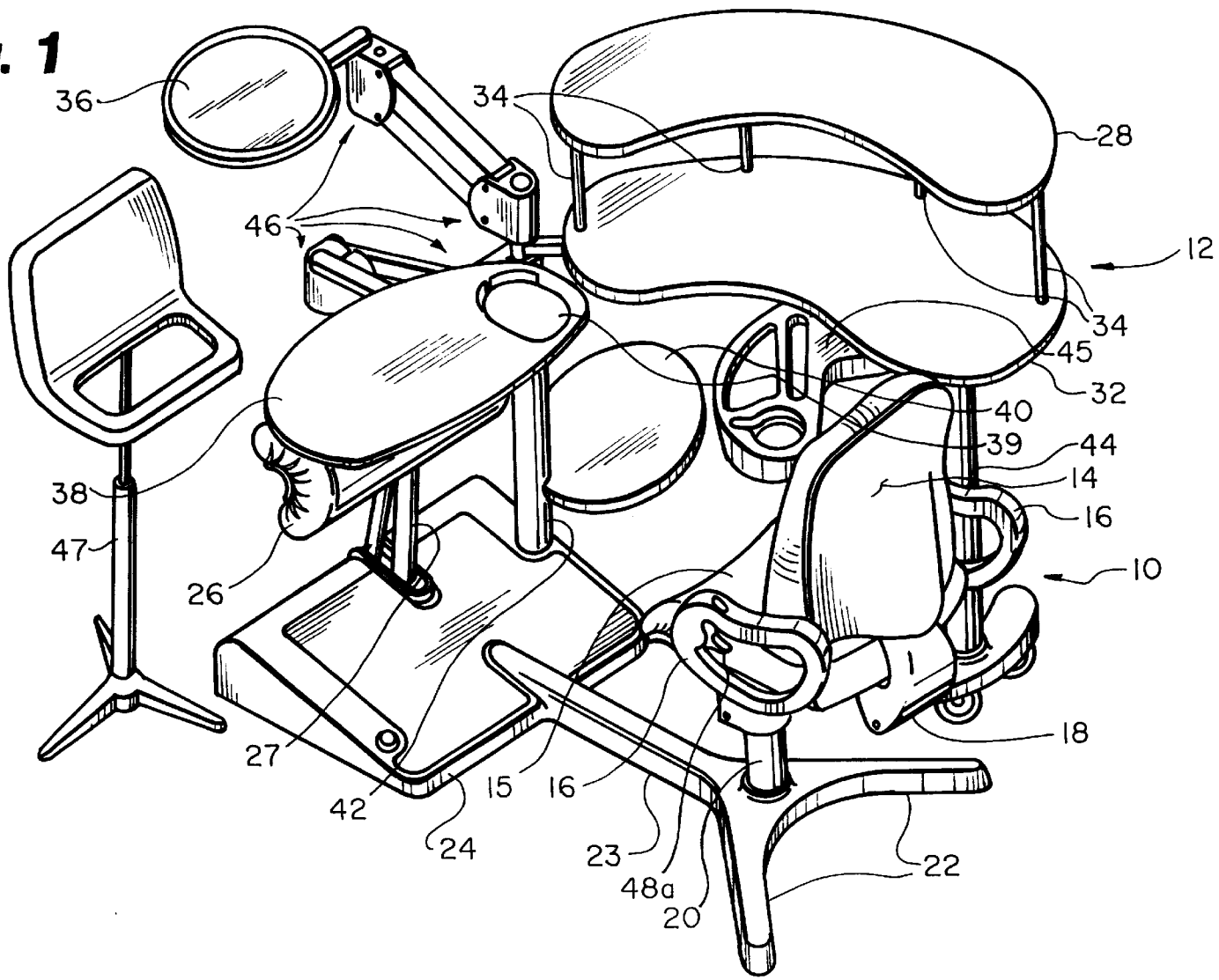
FIG. 1 is an isometric view assembly drawing of the preferred embodiment.

With reference to FIG. 1, a perspective assembly view is shown of the present invention. In particular, the body positioning system 10 is shown integrated with work station 12. As depicted herein, work station 12 is a computer work station where any type of computer, small enough to fit on an office desk, is implemented. A desktop computer may be connected to the local area network and configured with sufficient memory and storage to perform standard or specialist business computing tasks. Current technology offers full-function desktop computers which can be turned into portable notebook computers. When in the office, the small computer sits in a docking station and can connect to a local area network. Although body positioning system 10 can be used independently, FIG. 1 shows one of the preferred embodiments in which a computer work station 12 is integrated with it. Specifically, the computer work station 12 includes support surfaces and structures for a monitor, keyboard and a central processing unit (CPU). As discussed hereinbelow, the integrated system is designed not only to promote medically advantageous ergonomic postures but incorporates bio-mechanical design features to eliminate any physical discomfort such as eye strain, muscle stress, and improper spinal configuration which occurs during long term task activity. Further, the present invention provides a user with a selection of discrete and dynamic medically preferred health postures based on a coordinated, accurate and repeatable orientation of body positioning system 10 and work station 12. More specifically, a plurality of basic discrete postures including a recline seated posture, a recline neutral posture/breath-easy posture, and a recline standing posture are implemented to set a user at positioning system 10 at various orientations. The discrete postures are a distinct part of a full range of dynamic hybrid postures continuously shiftable and adjustable to prevent injury, discomfort and fatigue while enhancing health and comfort. The invention utilizes ease of adjustment and proactively motivates the operator/user to be positioned within an ergonomic range of work station 12 during all postures, thus enhancing health and productivity. As will be discussed hereinbelow, one of the advantages of the proactive aspect of the invention is the structural cooperation of the elements of positioning system 10 and work station 12 to advance, favor, promote motion and nimble transformation of the user from one posture to the next. Particularly, positioning system 10 is a synergistic bio-mechanical system designed to accommodate and become synergistic with the next best postural orientation of the human body ranging from a convention seated, with full body stretch option, to a lean-stand with the full body in a substantially vertical posture.

Still referring to FIG. 1 in more detail, an integrated body positioning and work station system is shown. Specifically, body positioning system 10 and work station 12 are shown integrated to correlatively operate as an integrated unit. Positioning system 10 includes pressure bearing surfaces 14 and 15 and a pair of articulating side supports 16. An actuator 48*a* enables adjusting the height of the surface 15. A corresponding actuator 48*b* on the second side support 16 enables adjusting the tilt of the surface 15. Pressure bearing surfaces 14 and 15 are adjustably and resiliently attached at joint 18. Pressure bearing surface 14 includes a contact surface (back support) and outer formed surface to encase reinforcing frames therein. The inner surface includes geometric shapes to cradle the user as lumbar, lower back and shoulder blade regions during sitting, neutral and lean-stand positions, and the several postures in between. The outer surface is preferably removable and is centrally cumbered to encase an upper end section of joint 18 which is secured to outer surface of pressure bearing surface 14. Further, articulating side supports 16 are attached to pressure bearing surface 15. Pressure bearing surface 15 is rotatably and tiltably connected to a top end of pedestal 20. Pressure bearing surface 15 includes an upper and lower formed surfaces. The upper part of pressure bearing surface 15, which functions as a seat and back support depending upon the user's temporal posture, generally includes a declivity with anticlined arcuate edges at opposite sides. This geometric shape of surface 15 provides a biomedical system which articulates with the user's body to effectively support the gluteal and lumbosacral regions. At its bottom end, pedestal 20 is pivotally and adjustably secured to stabilizers 22 and connector arm 23. Connector arm 23 interconnects stabilizers 22 with base structure 24. Lower body support pad 26 including link member 27 are mounted on base structure 24.

Work station 12 includes tool platforms 28 and 32 separated by connection members 34. Further, work station 12 includes platforms 36, 38, and 40 hingeably and adjustably connected to column 42. Swivel mounted leg 44 provides support to tool platforms 28 and 32 at the fore end. Platform 45, formed to support coffee cups, cans and similar containers in addition to writing tools, is adjustably and swingably mounted on swivel mounted work surface 32. Mouse cage 39 is set on platform 38 where a keyboard is preferably located. As will be discussed hereinbelow, the platforms are adjustably interconnected by utilizing maneuverable compound linkage framework 46. Specifically, as will be disclosed hereinbelow, when body positioning system 10 is translated through various postural positions, work station 12 is accurately and continuously maintained within the ergonomic range of the user by timely manipulating compound linkage framework 46. Work station 12 preferably includes file holder 47 which is designed to be compatible with the many ergonomic features of the present invention.

Figure 2:
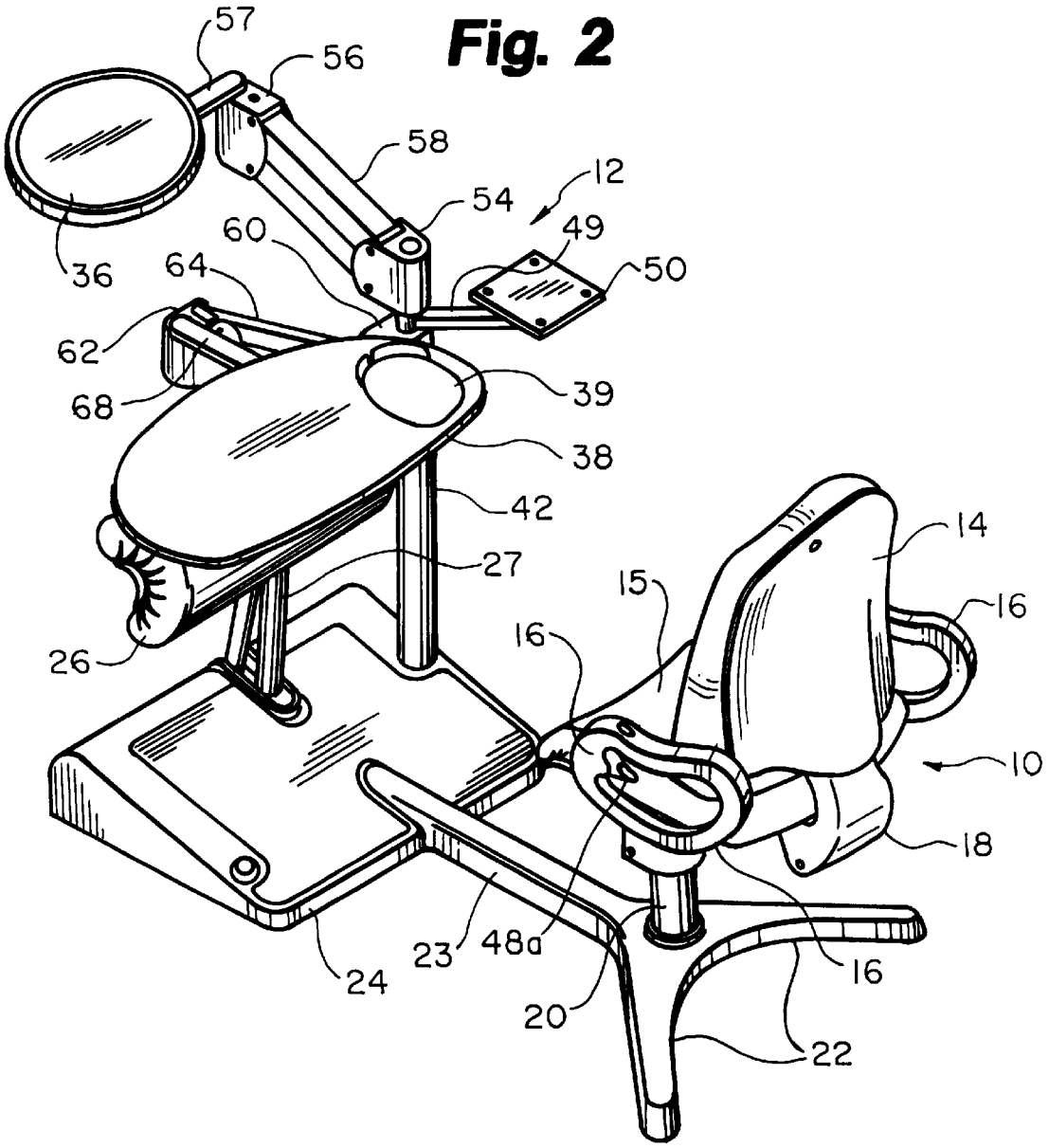
FIG. 2 is an isometric view describing in greater detail correlatively adjustable joints and links.

Referring next to FIG. 2, a portion of work station 12 is removed to clearly show some of the major interactive elements of the invention. Particularly, body positioning system 10 is shown with triggers 48 embedded in articulating side supports 16. Triggers 48 are located immediately forward under the declivity of articulating side supports 16. This arrangement proactively encourages the user to keep the elbows backwards thus pushing the thorax forward. As the user actuates triggers 48, the thorax is extended anteriorily and this in turn tilts the pelvis forward throughout the various postural excursions of the user. This is one of the many distinguishing features of the present invention. Prior art devices, such as ergonomic chairs and supports, are generally designed to locate and provide lumbar support. In sharp contrast, the present invention enables the pelvis to be tilted forward irrespective of the position of the lumbar curve. Each basic posture of the present invention leans the upper body back about 15° beyond the vertical. This allows all of the upper body weight to be distributed throughout pressure bearing surfaces 14 and 15 while platforms 36 and 38 are moved to easily accessible positions. In the preferred embodiment, platform 36 is used to support a screen/monitor or similar device, and as indicated above, a keyboard is placed on platform 38. Mouse cage 39 includes a pad and a structure to retain the mouse in place when platform 38 is shifted laterally and tilted toward or away from positioning system 10. The tiltability/rotatability of platform 38 is one of the many innovative and biomechanical features of the invention. Platform 38 is independently tiltable to conform to the many various orientations of the user. Specifically, when the user is in stand/near stand or lean/stand, posture platform 38 is inclined away from positioning system 10 to provide an ergonomically healthy and non-stressful positioning of the hands. Platform 38 is rotatable toward and away from positioning system 10 to eliminate positions of the hand which may cause hi compression of the median nerve at specific postures. Generally, a prolonged compression of the median nerve will likely result in Carpal Tunnel Syndrome which results in a progressive loss of coordination and strength in the thumb if the cause of the median nerve compression is not alleviated. This further results in difficulty in performing fine movements. In cases of severe compression of the median nerve, there is a likely risk of atrophy of some of the muscles in the hand. Yet another innovative aspect of the present invention is mouse cage 39 which is designed to secure the mouse to be accessible and available at any of the positions of platform 38.

Still referring to FIG. 2, support plate 50 is shown cantilevered from link arm 49. Further, link arm 49 is secured to a telescoping section of support column 42. Support plate 50 is adjustably pivotably and provides support for tool platforms 28 and 32 at the rear end. Compound linkage framework 46 includes flex joints 54 and connected to intermediate members 58. Platform 36 is cantilevered at joint 57 via flex joint 56. Further, compound linkage framework 46 includes flex joints 60 and 62 connected to intermediate members 64. Platform 38 is cantilevered at joint 68 via flex joint 62.

Figure 3:
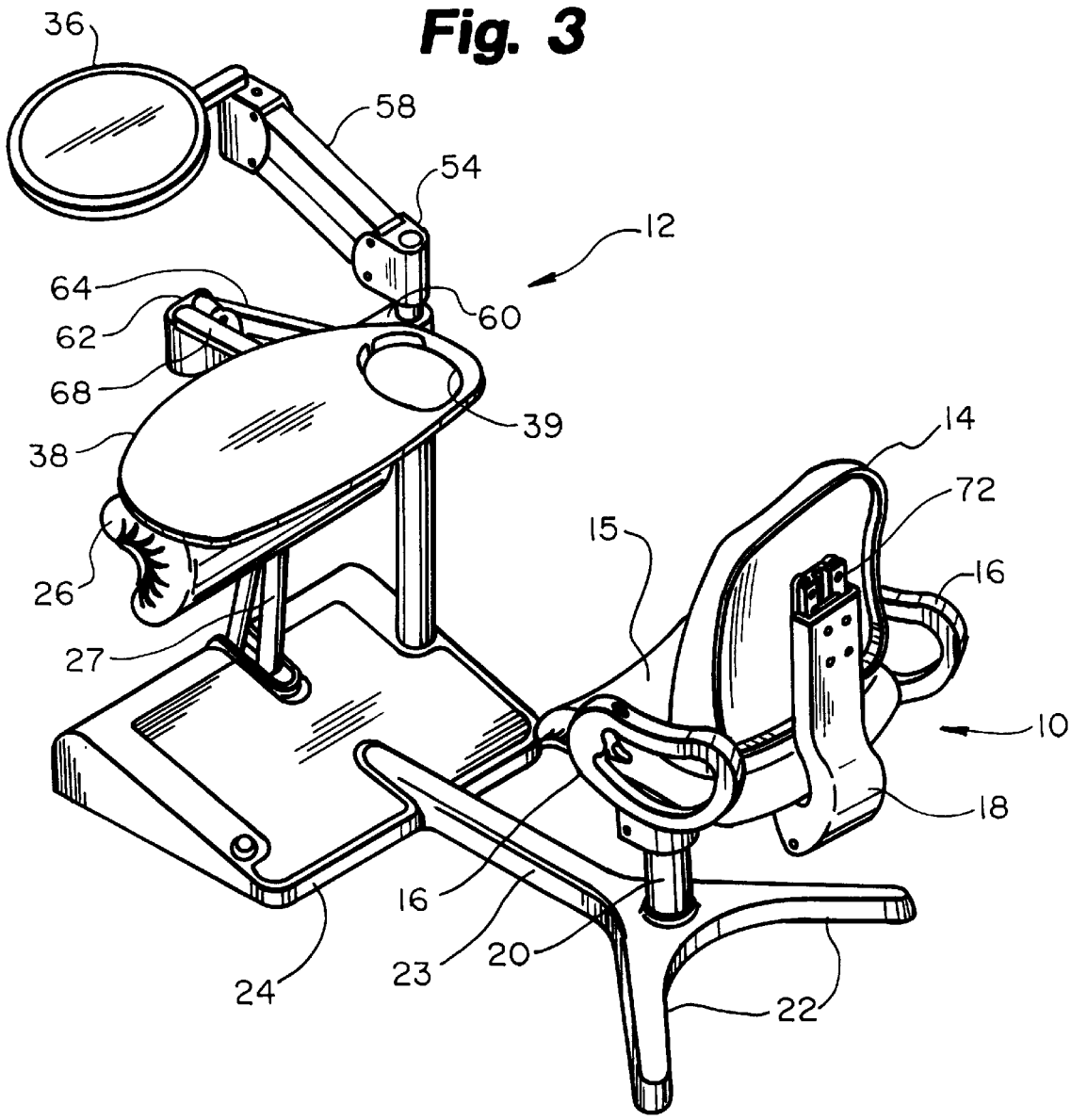
FIG. 3 is an isometric view showing in greater detail adjustable support systems and mechanism.

Directing attention to FIG. 3 now, a detailed section of a manual positioning and locking mechanism for pressure surface 14 is shown. Height adjustment mechanism 72 is a commercially available component such as one manufactured by Milsco or equivalent. Mechanism 72 enables pressure bearing surface 14 to be raised or lowered by the user to various positions along the upper end section of joint 18. The mechanism enables height adjustment of pressure surface 14 to fit the user's specific physiological and lumbar configurations. Particularly, as pressure surfaces 14 and 15 articulate to assume a substantially vertical position, the relative adjustment and positioning of these surfaces become critical in providing proper support as selected parts of the body such as the dorsal, gluteal and lumbosacral regions. In this regard, mechanism 72 is integrated to enable an independent and coordinated adjustment of pressure surface 14.

Figure 4:
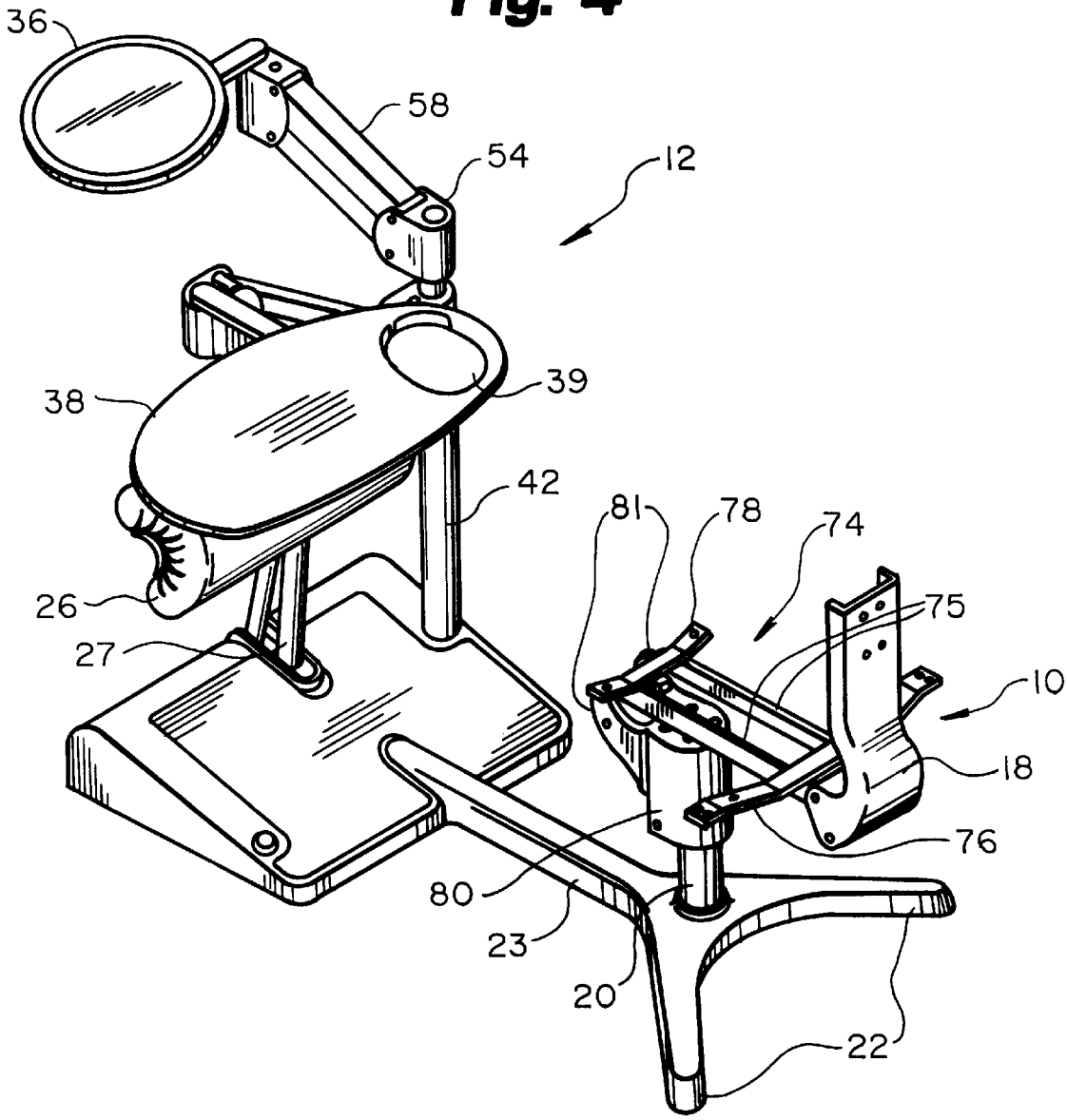
FIG. 4 is an isometric view of the structural details of actuating members of the positioner.

Referring now to FIG. 4, reinforcing structural frame 74 is shown. Structural frame 74 includes a plurality of parallel bars 75 with aft member 76 and fore member 78. Structural frame 74 is secured to aft member 78. Specifically, cap link 80 is rotatably secured to the top end of pedestal 20. Cap link 80 is preferably an extruded substantially hollow cylindrical stub having a first open end and a second closed end. The top end of pedestal 20 is rotatably secured to the open end of cap link 80. At the closed end of cap link 80, a plurality of attachment brackets 81 are distally disposed thereon and provide a hinge connection and support to parallel bars 75.

Figure 5:
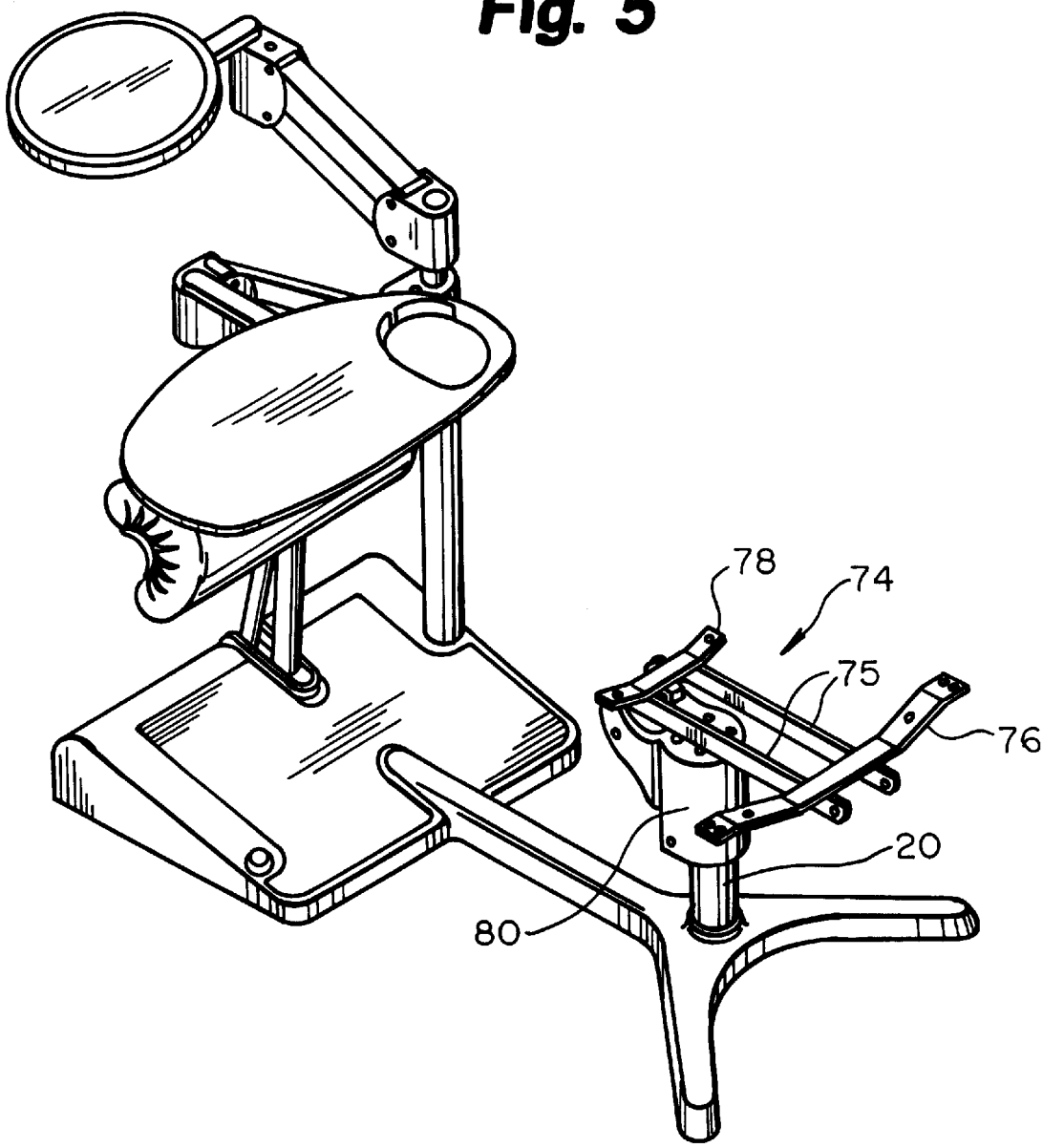
FIG. 5 is a further detailed isometric view of actuating members and cooperative structural links.
Figure 6:
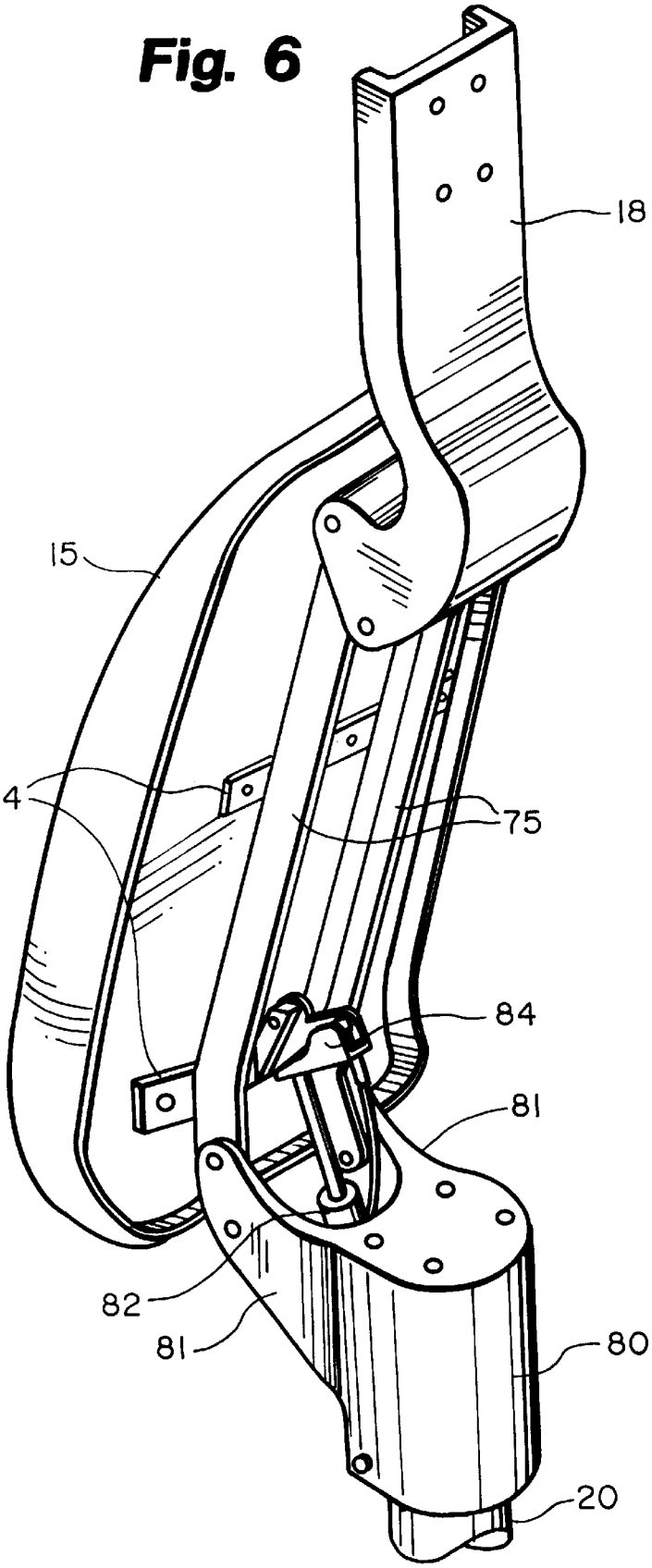
FIG. 6 is an isometric view of position actuation and engagement details and structures for rotating pressure surfaces through a 90° angle.

FIGS. 5 and 6 show in more detail the connection between cap link 80 and structural frame 74. Specifically, FIG. 6 depicts one of the many significant and inventive features of the present invention. Pressure surface 15 and joint 18 are rotated through about a 90° displacement to create a near vertical orientation thereof. More specifically, whereas prior to rotation, structural frame 74 and joint 18 are substantially perpendicular to each other, after the 90° translation, they are transposed into a substantially co-planar relation. As described hereinbelow, this coordinated and dynamic orientation of structural frame 74 and joint 18 provides various ergonomically desirable positions of pressure surfaces 14 and 15 such that a user is enabled to progressively change postures from sitting to lean/stand positions. The mechanism for the rotation is preferably a position with pneumatic, hydraulic, electric or equivalent drive. For example, air cylinder 82 is shown bearing against fixed block 84. Block 84 is pivotably connected to structural frame 74. Cylinder 82 is linked to block 84 and when the piston is extended, structural frame 74 is rotated to the full extension of the piston. Preferably, structural frame 74 is rotated through 90° to assume a substantially vertical orientation.

Figure 7:
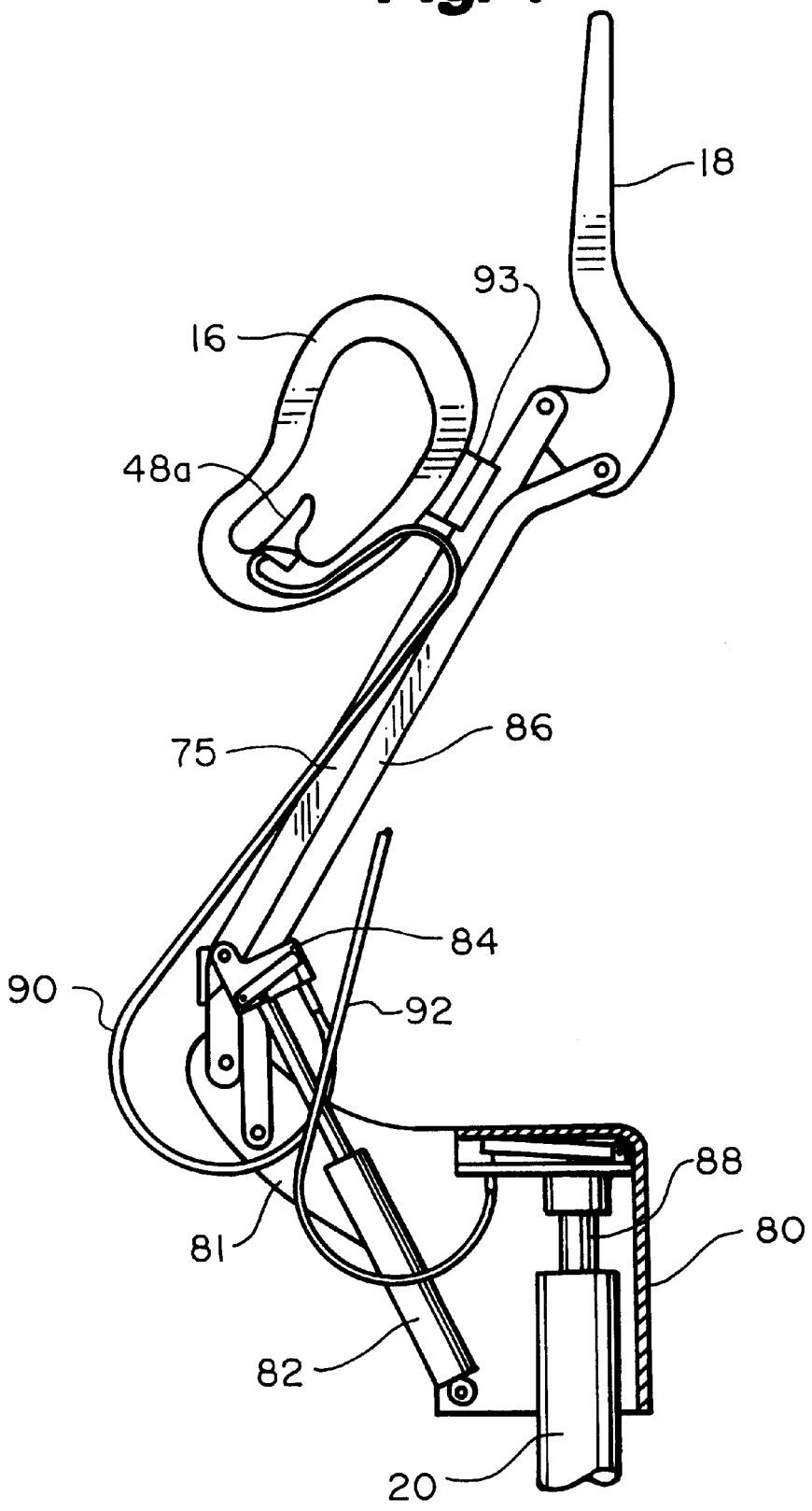
FIG. 7 is an isometric view of the structure and actuation control lines from the triggers which operate the push-pull pistons.

Directing attention to FIG. 7, one of the many significant features of the present invention is shown. Specifically, parallel bars 75 and bar linkage 86 provide an articulating structural linkage which enables to maintain joint 18 perpendicular to the horizontal plane at all times. FIG. 7 shows the near side of 2-bar connection to joint 18. A second set of symmetric 2-bar connection on the far side of joint 18 forms a 4-bar linkage. Each 2-bar linkage is connected to brackets 81. Accordingly, when structural frame 74 translates from a horizontal to a substantially vertical position, joint 18 is elevated through the radius of rotation while maintaining its original vertical orientation relative to stabilizers 22 and connector arm 23. This arrangement enables pressure surface 14 to maintain a vertical orientation at all times. Further, FIG. 7 shows cylinder 88 encased in pedestal 20. Cylinder 88 is implemented to move or adjust structural frame 74 up or down. Both cylinders 82 and 88 are actuated by triggers 48 each embedded under articulating arm 16. For example, right trigger 48 may be used to actuate cylinder 82 and left trigger 48 may be used to activate cylinder 88. Exemplary control line 90 is shown connecting trigger 48 to cylinder 82. Similarly control line 92 is partially shown extending from cylinder 88 to the other trigger 48 (not shown). Each side support 16 is secured to each parallel bar 75. As discussed hereinbelow, side support 16 includes a geometric loop with various features adapted for articulation and enhancement of ergonomic positioning of the user.

Figure 8:
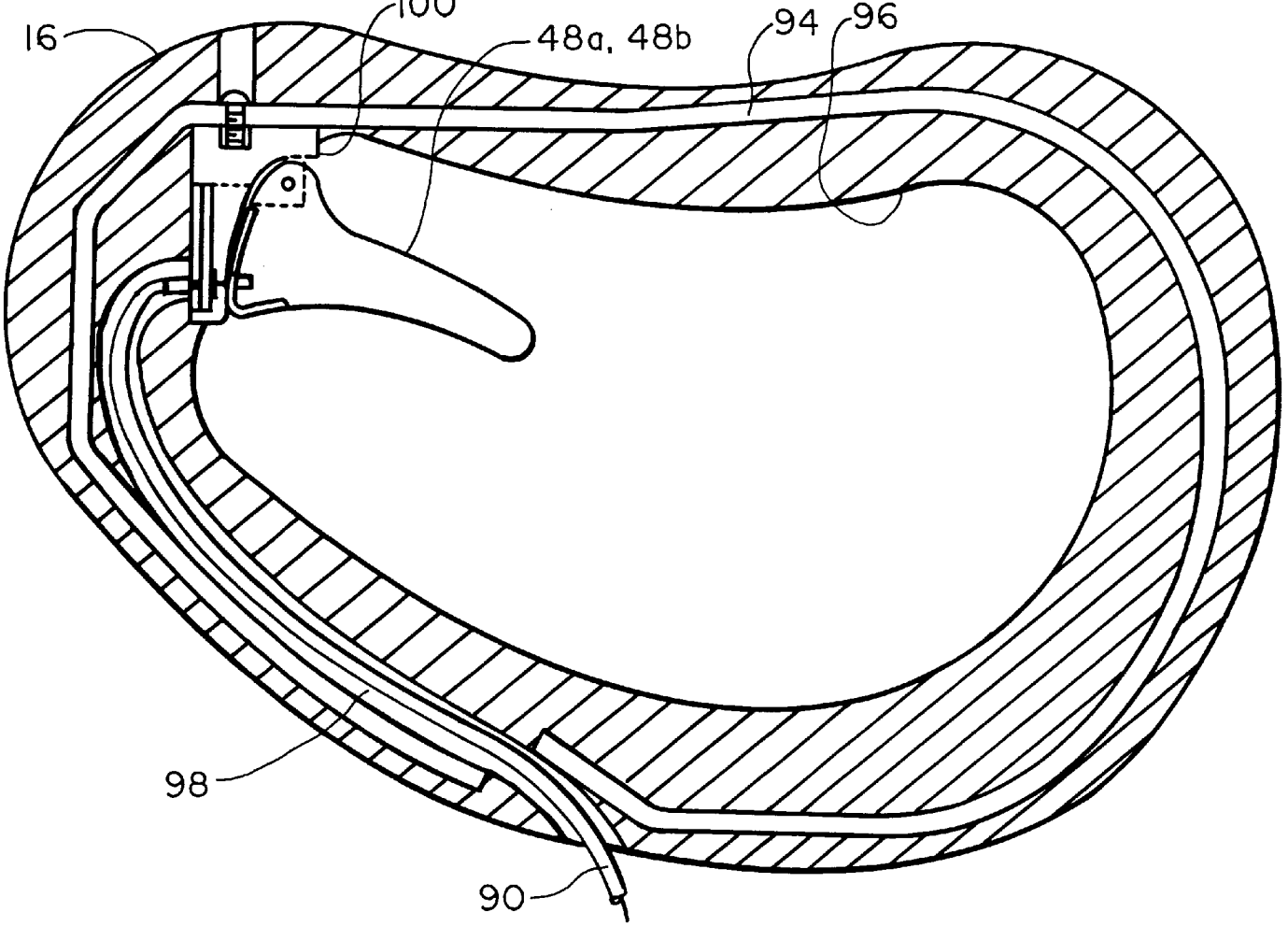
FIG. 8 is a cross-section of the side support loop structure.

FIG. 8 depicts a detailed structure of the two side supports 16 and control line 90 embedded therein. The shape of side support 16 is an ellipsoidal loop with one end narrower than the other and further having one side bulging outward and the opposite side depressed inward. Trigger 48*a*, 48*b* is secured on the inner surface of the narrower side proximate to the depressed region. Trigger 48*a*, 48*b* is set to be tactile and is accessible to a person resting the palm of the hand on the top surface of the depressed region. Further, the depressed region promotes sure-grip and control by users especially during the articulation of side support 16 which rotates in conjunction with structural frame 74. Member 94 provides rigidity to the outer elastic member 96. Member 94 may be made of structural grade steel, aluminum or equivalent, whereas member 96 is preferably semi-rigid urethane, rubber, polyvinyl or equivalent. Control line 90 is connected to trigger 48*a*, 48*b* through an internal cavity 98. Retention bracket 100 is used to pivotally secure trigger 48*a*, 48*b* such that when trigger 48*a*, 48*b* is squeezed, control line 90 is activated to thereby actuate cylinder 82 or cylinder 88, depending upon which one of the two triggers 48*a*, 48*b* is being used. Each of triggers 48*a*, 48*b* can be activated separately or can be used simultaneously together.

Figure 9:
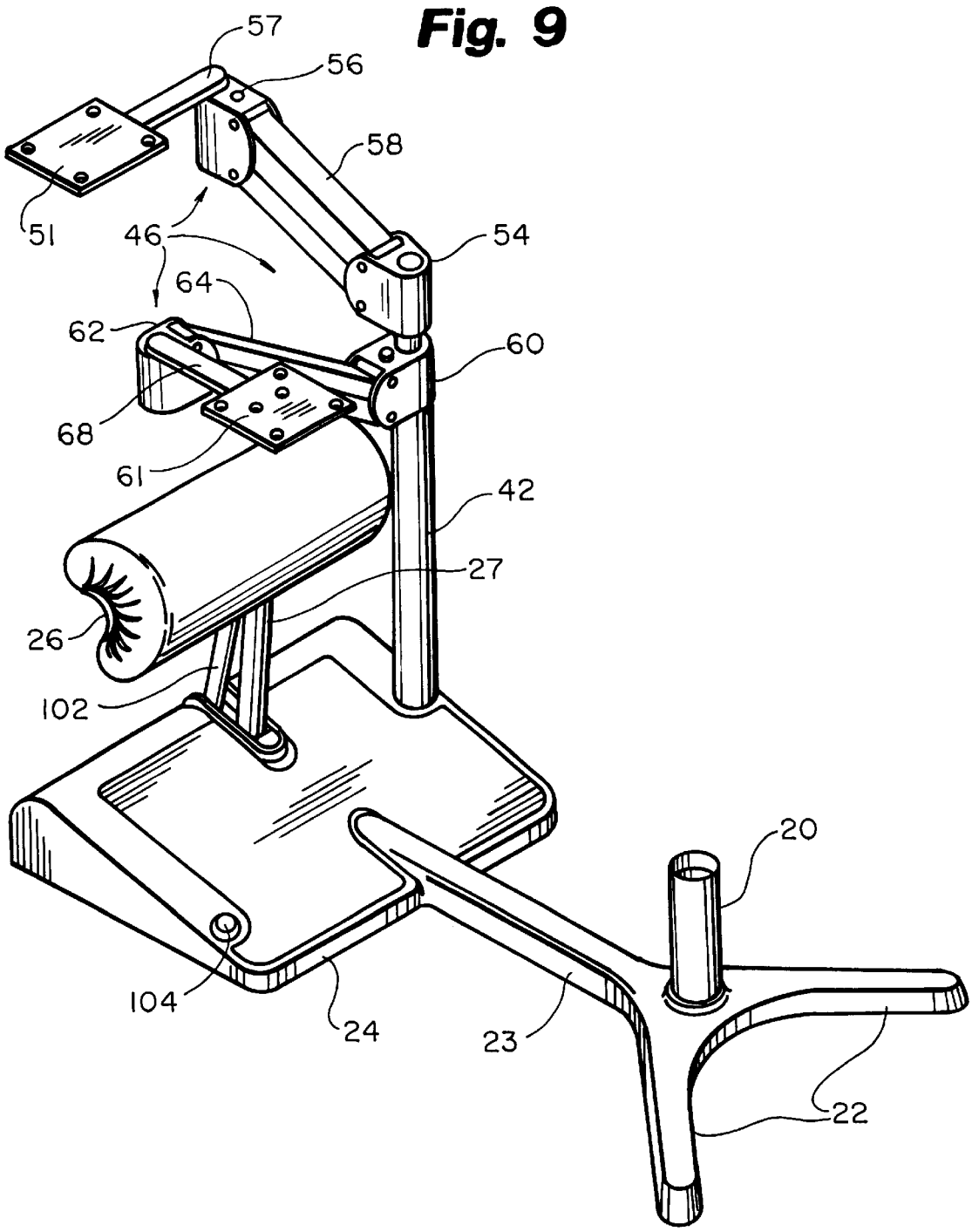
FIG. 9 is an isometric view of the control lock mechanism for the work surfaces such as the monitor and keyboard support including lower body support mechanism in greater detail.

Referring now to FIG. 9, an isometric view of the control mechanism for the work surfaces such as monitor support platform 51 and keyboard support platform 61 including lower body support mechanism are shown. Specifically, compound linkage framework 46 includes flex joints 54 and 60 secured on support column 42. The flex joints enable several degrees of freedom/adjustment in the thri-axis primary planes. One of the many unique aspects of the arrangement includes the use of single support column 42 to fixably secure articulating flex joints 46. This arrangement and structure enables space-volume efficiencies and provides an interference free, independent and simultaneous adjustments of support platforms 51 and 61 on which monitor support 36 and keyboard support 38 are mounted, respectively.

Still referring to FIG. 9, lower body support pad 26 including link member 27 are shown mounted on base structure 24. Base structure 24 includes a generally increasing gradient from the near end to the far end. This gradient is preferably about 15°. The gradient enables the user to assume a firm foot grip on the non-skid surface of base structure 24. In an alternative embodiment, the gradient is preferably greater than 15° to provide support for the feet and provide balance in lieu of lower body support pad 26. Lower body support pad 26 is articulated by cylinder 102. Button 104 activates cylinder 102 to rotate and hold in place lower body support pad 26. As will be seen hereinbelow, connector arm 23 is a tension member and serves as a bridge between lower body support structure and articulating pressure surfaces 14 and 15. Further, base structure 24 operates as a counter-weight and center of gravity stabilizer against articulating pressure surfaces 14 and 15, the associated structures therewith, and the weight of the user which generates variable dynamic rotational moments about pedestal 20.

Figure 10:
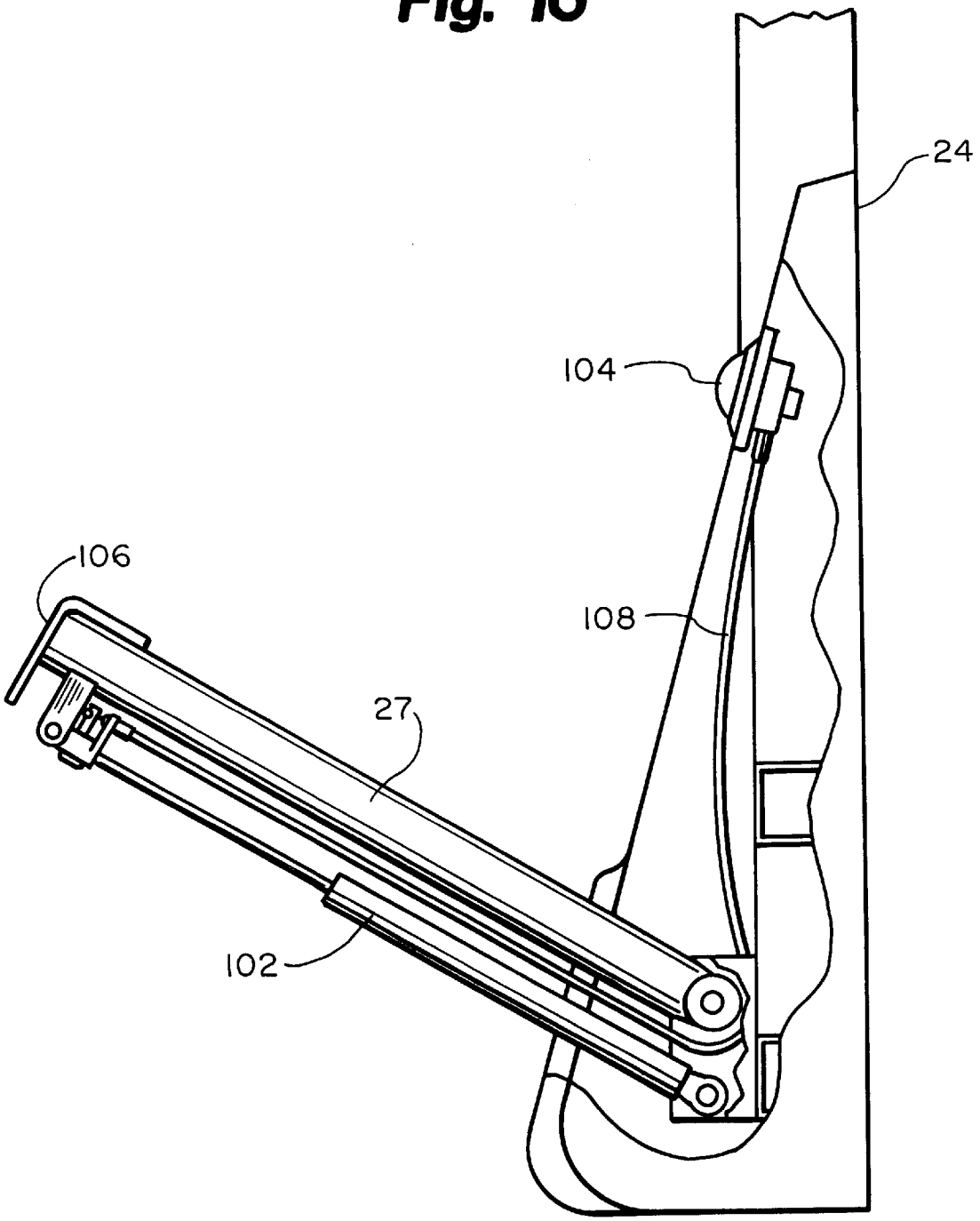
FIG. 10 is an isometric view of the actuating mechanism for the lower body support.

FIG. 10 shows further details of link member 27 and cylinder 102. Button 104 is connected to control line 108 and actuates cylinder 102. Cylinder 102 rotates link member 27 and fixes it at a desired angle. Support pad 26 is secured to support pad moving bracket 106. Support pad 26 includes resilient outer surfaces having substantially parabolic shapes. Support pad 26 serves various functions. Some of the important bio-mechanical and structural advantages of support pad 26 include its implementation to provide an adjustable fulcrum to the user's body in cooperation with articulating pressure surfaces 14 and 15. Further, pad 26 operates as a body balancer and posture adjustment mechanism. When the user shifts from a sitting posture to a lean/stand posture, support pad 26 is implemented to bear some of the shifting weight. In this regard, support pad 26 acts as a body balancer and a point at which the user may shift the center of gravity of both the user and positioning system 10 under both dynamic and static conditions without falling or sliding out of articulating pressure surfaces 14 and 15. Yet another cooperative structural aspect of support pad 26 includes its implementation as a transitional dynamic weight support and stabilizer. The parabolic oblong shape of support pad 26 promotes rotation at the lower leg and shin regions such that the user is enabled to rotatably transpose from one posture to another by adjusting the pressure and angular orientation of support pad 26 using operating button 104. Support pad 26 may also be implemented as an adjustable leg rest. The user may be positioned in a normal sitting position with the leg stretched out and the posterior aspect of the legs resting on support pad 26.

Figure 11:
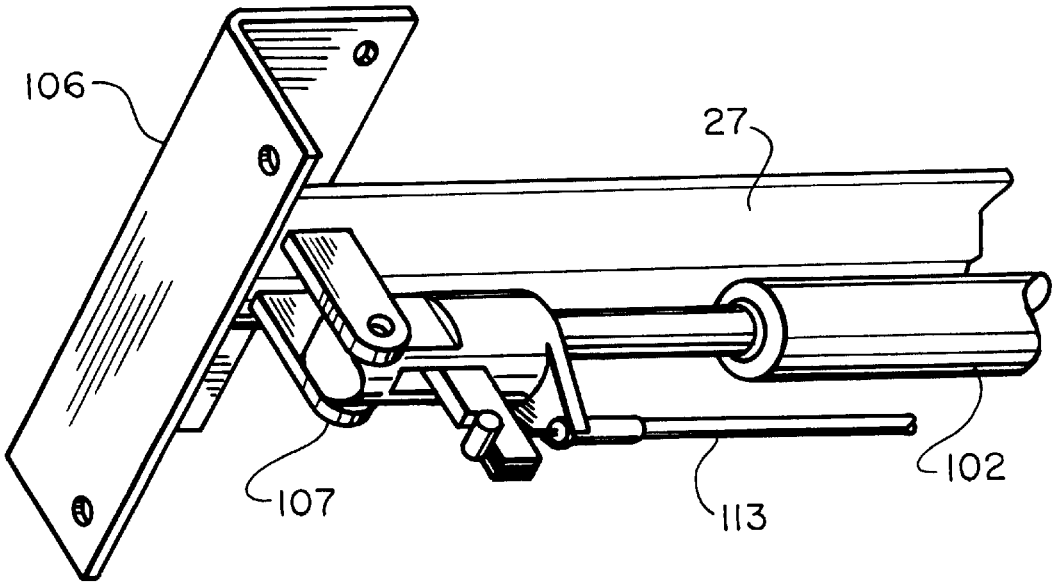
FIG. 11 is an isometric view showing underlying structural connections and organization of a piston and the lower body support.

Referring now to FIG. 11, a detailed view of support frame 26 is shown. Particularly link 107 provides a secure link between cylinder 102, link member 27 and structural angle 106. Link member 27 is rotatable through approximately 75° with about 45° toward the user from the vertical and about 30° away from the user from the vertical. The user presses button 104 to actuate cylinder 102 and applies bodily pressure on support pad 26 to adjust it away from the lower legs/legs. In the alternate, button 104 is pressed to allow support pad 26 to rotate towards the user. In either case, releasing button 104 locks support pad 26 into position.

Figure 12:
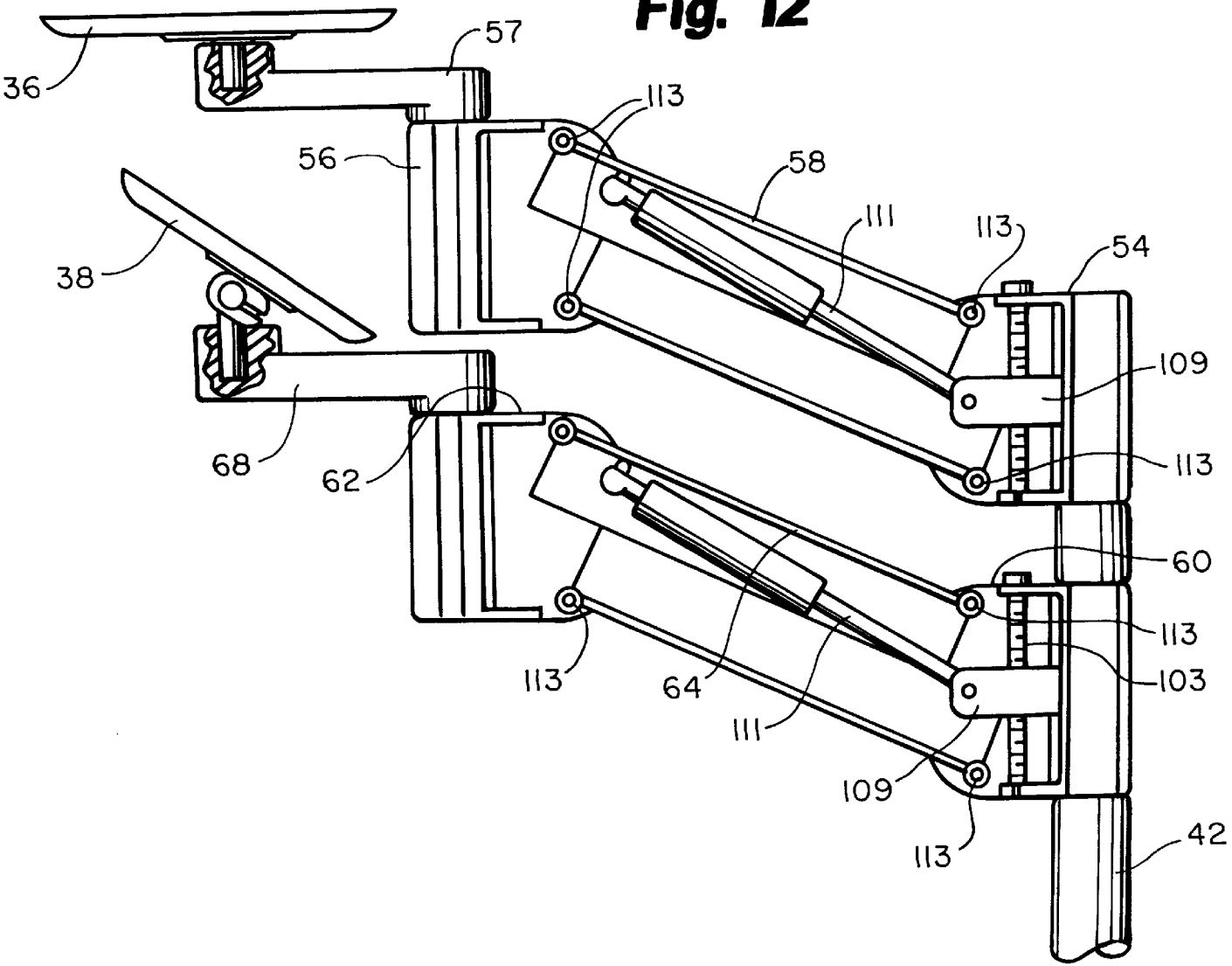
FIG. 12 is an isometric view of the rotational position control/lock mechanism for adjusting the work tool support surfaces and connections thereof.

FIG. 12 shows the rotation, articulation, and positioning in single or combination of three-dimensional planes of platforms 36 and 38, including the compound linkage comprising intermediate member 58 and 64 preferably formed of bar linkages. Specifically, column 42 supports a plurality of work stations preferably cantilevered therefrom. More specifically, the use of single column 42 enables the stacking of various work stations without the complication of interference and crowding which may result due to multiple supports and columns. Flex joints 54, 56, 60, and 62 enable articulation and rotation in three dimensions. Specifically, joints 54 and 60 coupled with threaded screw 103 enable universal adaptability for adjustment in three-dimensions. Screw 103 is adjusted by link member 109 indexing up or down. This movement results in changes of the leverage of gas spring 111 and thereby enables adjustment for varying weights. For example, when the load to be supported at platform 36 or 38 is heavy, link member 109 is indexed downward to shorten the extension of intermediate members 58 and 64, thereby reducing the length of the cantilever and increasing the capacity to carry a heavy load. Alternately, when link member 109 is indexed upwards, joints 58 and 64 extend outward, thus reducing the capacity to carry a cantilevered load at platforms 36 and 38, as well as extending the reach of the assembly orthogonally from column 42. The flexibility and adjustability of each of the structural components, individually and in combination, enables the assembly of FIG. 12 to be most versatile for support of work tools and work surfaces and is highly synergistic with positioning system 10. Flex joints 54 and 56 enable full 360° rotation at column 42. Further, flex joints 56 and 62 provide a coupling for a full 360° rotation of joints 57 and 68, respectively. Additionally, pivots 113 cooperate with bar linkage of intermediate members 58 and 64 to be responsive to the changes in leverage of gas spring 111. Yet another feature of the invention includes the rotatability of platform 36 and the rotatability and tiltability of platform 38. Platform 36 is structured to support a computer screen or similar work tools. Platform 38 is well suited to carry a keyboard or similar work tools which may need to be adjusted in several orientations. One of the many unique aspects of the structure includes its lockability in any position after adjustment. Specifically, the user is enabled to configure the position of the work tools to be compliant and ergonomically congruent with positioning system 10. More specifically, the user applied minimum manual pressure to adjust the position of support platform 36 or 38 as needed. Platforms 36 and 38 remain locked in position after adjustments have been made. Thus, the tool support platform structure of the present invention provides several degrees of freedom to orient the work tools, and is designed to be synergistic with positioning system 10 by allowing quick dynamic adjustments relative to a desired postural configuration.

Figure 13:
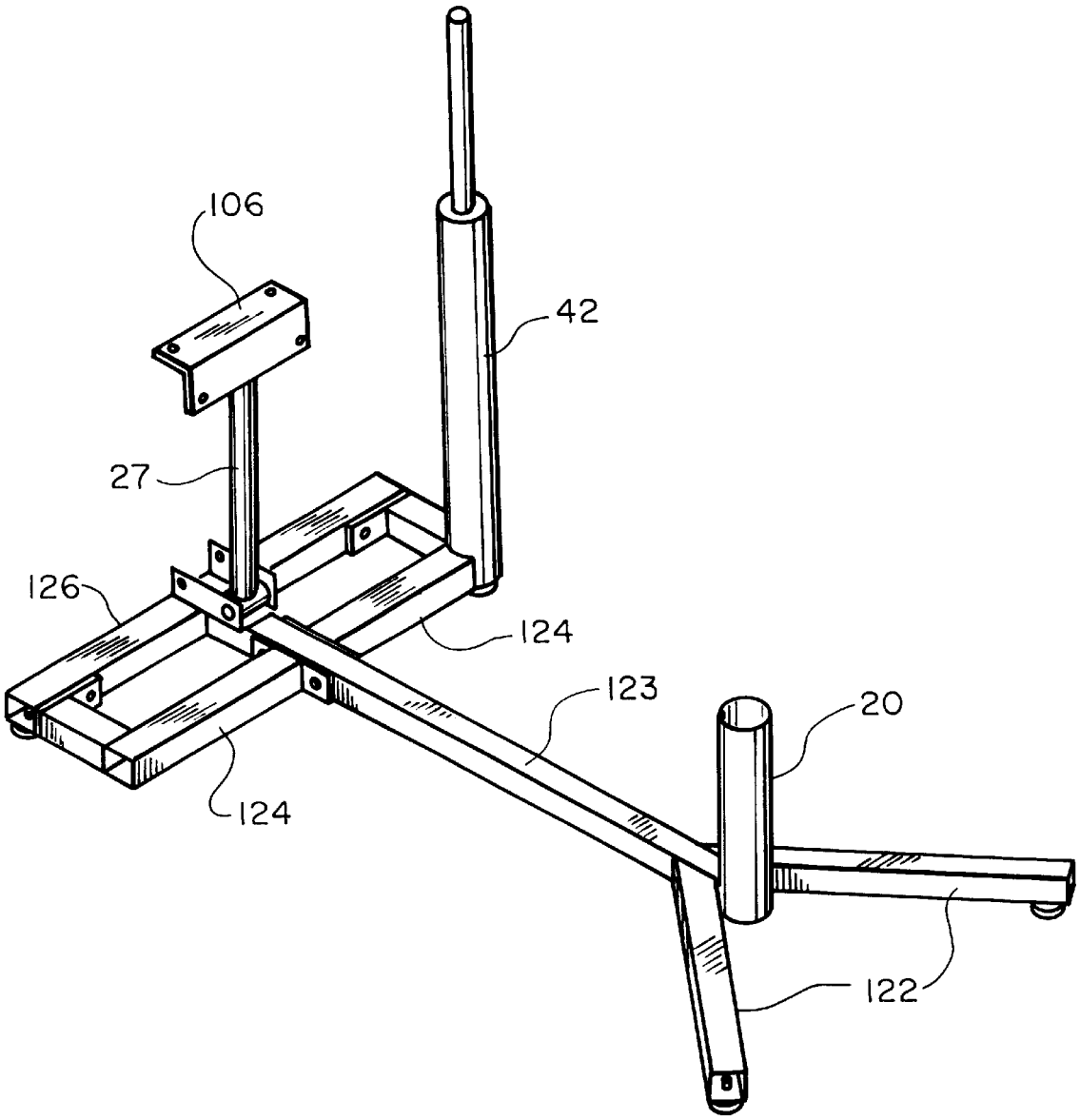
FIG. 13 is an isometric view of the main structural base and support assembly.

Referring now to FIG. 13, the underlying structural assembly of positioning system 10 is shown. Preferably, the material of construction is structural grade steel, aluminum or equivalent. The frame work includes fore and aft assemblies connected by member 123. Aft assembly comprises members 122 which are preferably welded to member 123 and extend in symmetrical angular relations therefrom. The fore assembly includes rectangular structures 124 and 126 secured to member 123.

Figure 14:
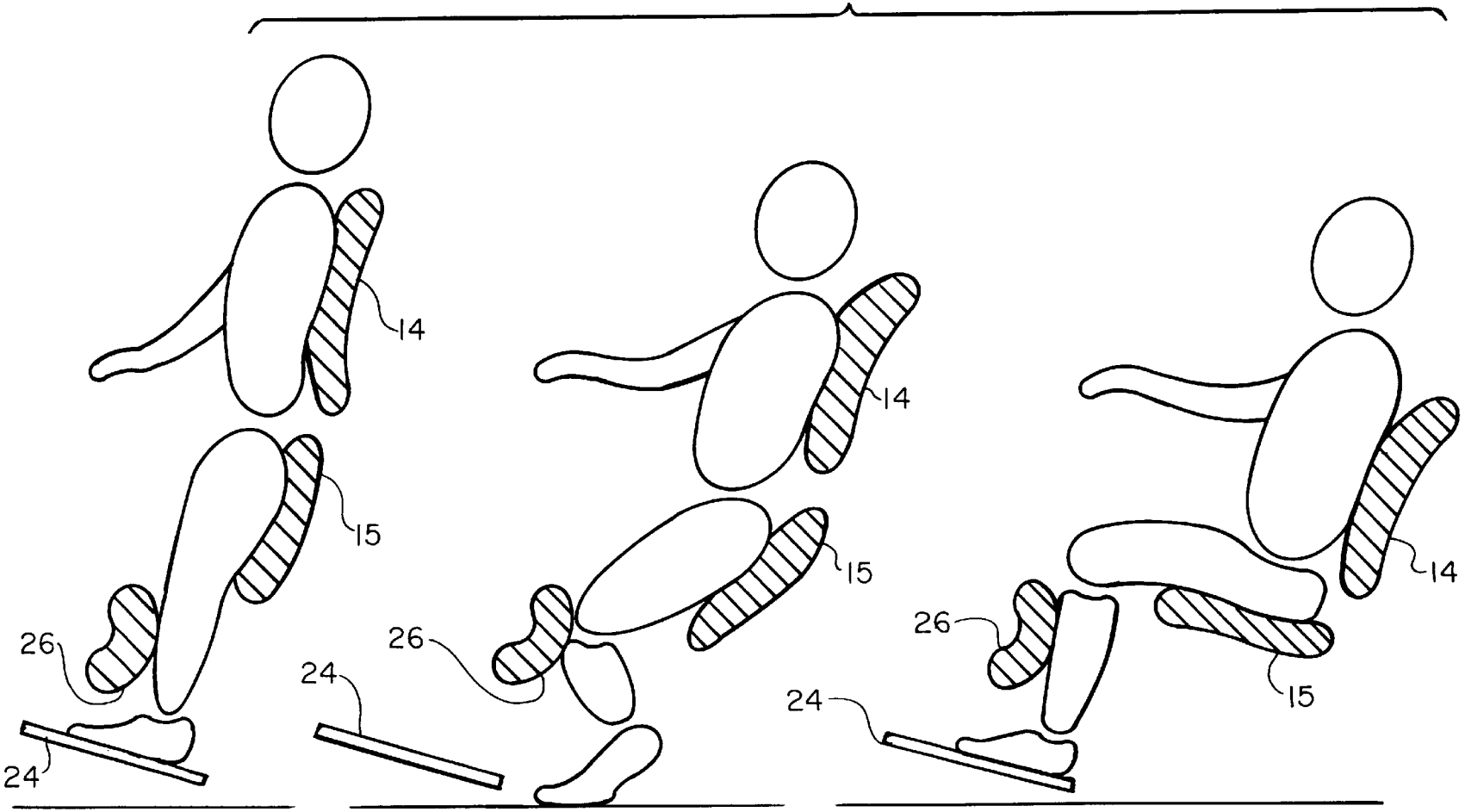
FIG. 14 is a simulation view of the multi-posture range of the present invention.

FIG. 14 is a representation of the ergonomic multi-posture range of the present invention. In the seated position, the user preferably engages pressure surfaces 14 and 15 and support pad 26. The user then activates trigger 48 and button 104 to shift to a breathe-easy position. As pressure surfaces 14 and 15 rotate, the angle between the torso and the lower part of the body increases and support pad 26 is actuated forward and rotated to prevent the user from sliding off pressure surface 15. As the user continues to rotate with pressure surfaces 14 and 15, it is preferable to adjust the position of support pad 26 and lock it in place so that the user can negotiably maintain contact with pressure bearing surfaces 14 and 15 and keep the body in balance. The user is also supported by foot platform 24 which is padded, and is surfaced with friction material to prevent slipping. The angle of foot platform 24 can be adjusted to facilitate comfort of the user.

Figure 15:
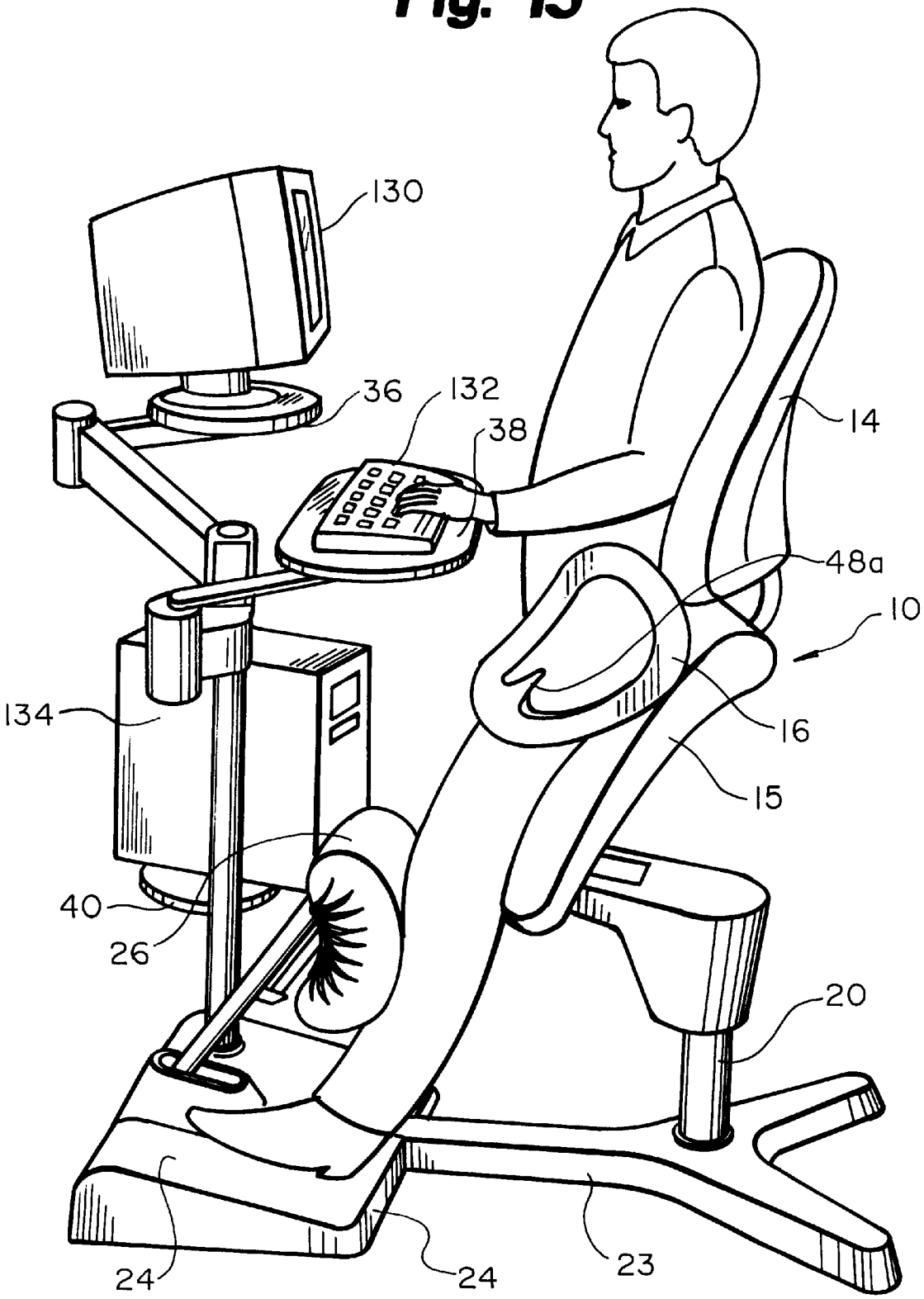
FIG. 15 is an isometric view of the present invention integrated with a computer console/station.

FIG. 15 is a representative depiction of positioning system 10 integrated with computer work station 12. Monitor or screen 130 is placed within the visual and ergonomic ranges of the operator. Keyboard 132 is set for easy access to the hands and CPU 134 is placed within the ergonomic range of the operator while clearing any possible interference with positioning system 10, especially during articulation, thus allowing timely postural adjustments by the user.

Figure 16:
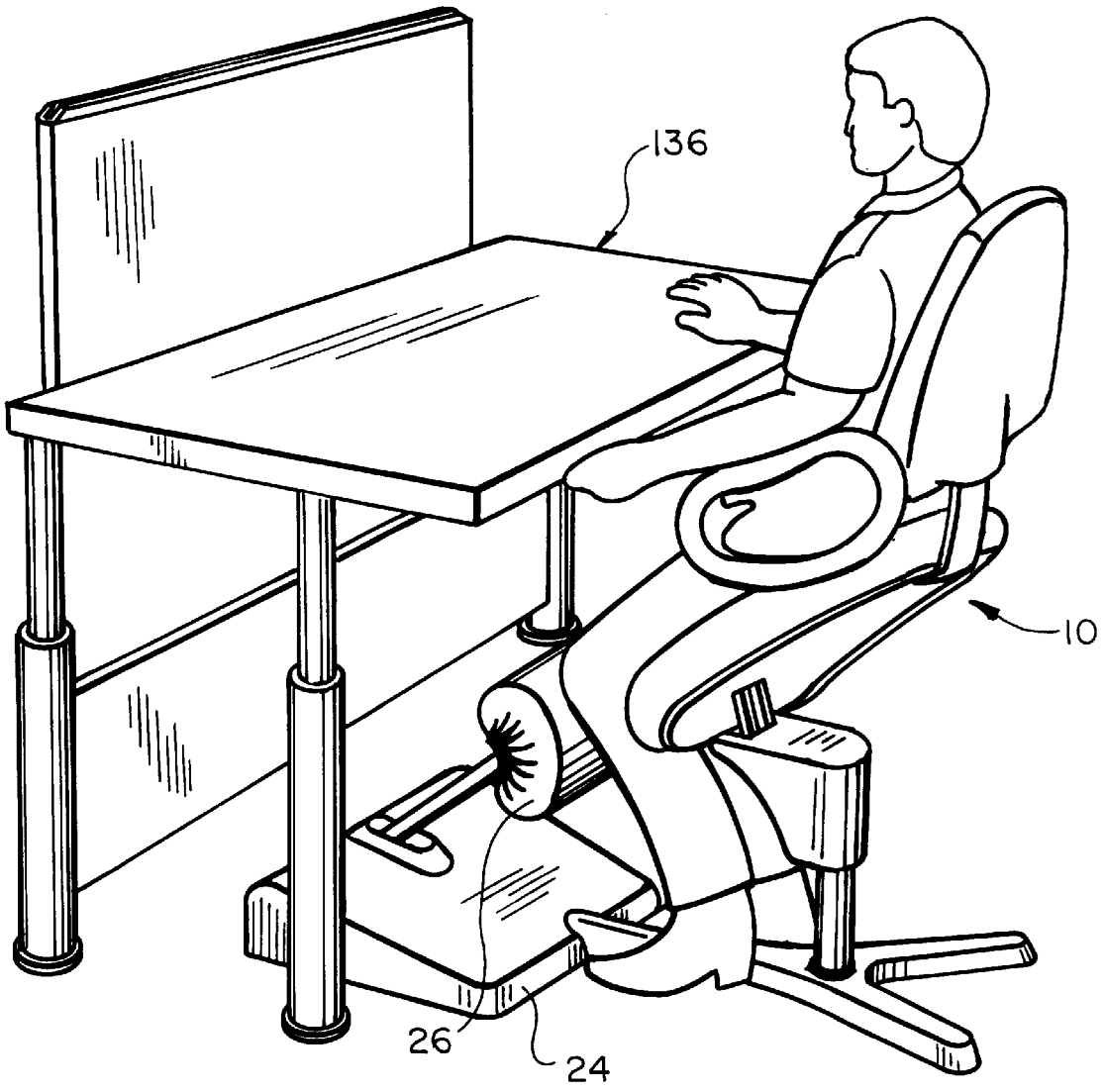
FIG. 16 is an isometric view of the positioner being used in non-integrated set up in an assembly type environment.

FIG. 16 is another embodiment of the present invention. Positioning system 10 is shown with work station 136 not attached or integrated with positioning system 10. In order to ensure stability and safety, base structure 24 is filled with stabilizing weights such as water, sand or equivalent. The embodiment shows a typical work station 136, such as an assembly line, in which a task is performed in a substantially sitting position. The implementation of positioning system 10 advantageously enables the worker to shift through various ergonomic postures without interrupting the task at hand. As discussed hereinabove, the present invention enables the worker to benefit from active sitting through timely movements of the muscles and the body, and from proactive positioning which forms the body into medically advantageous postures. Specifically, three basic adjustment actuators which include (two) triggers 48 and button 104 are used to easily transform the user from a sitting to lean/stand posture.

Figure 17:
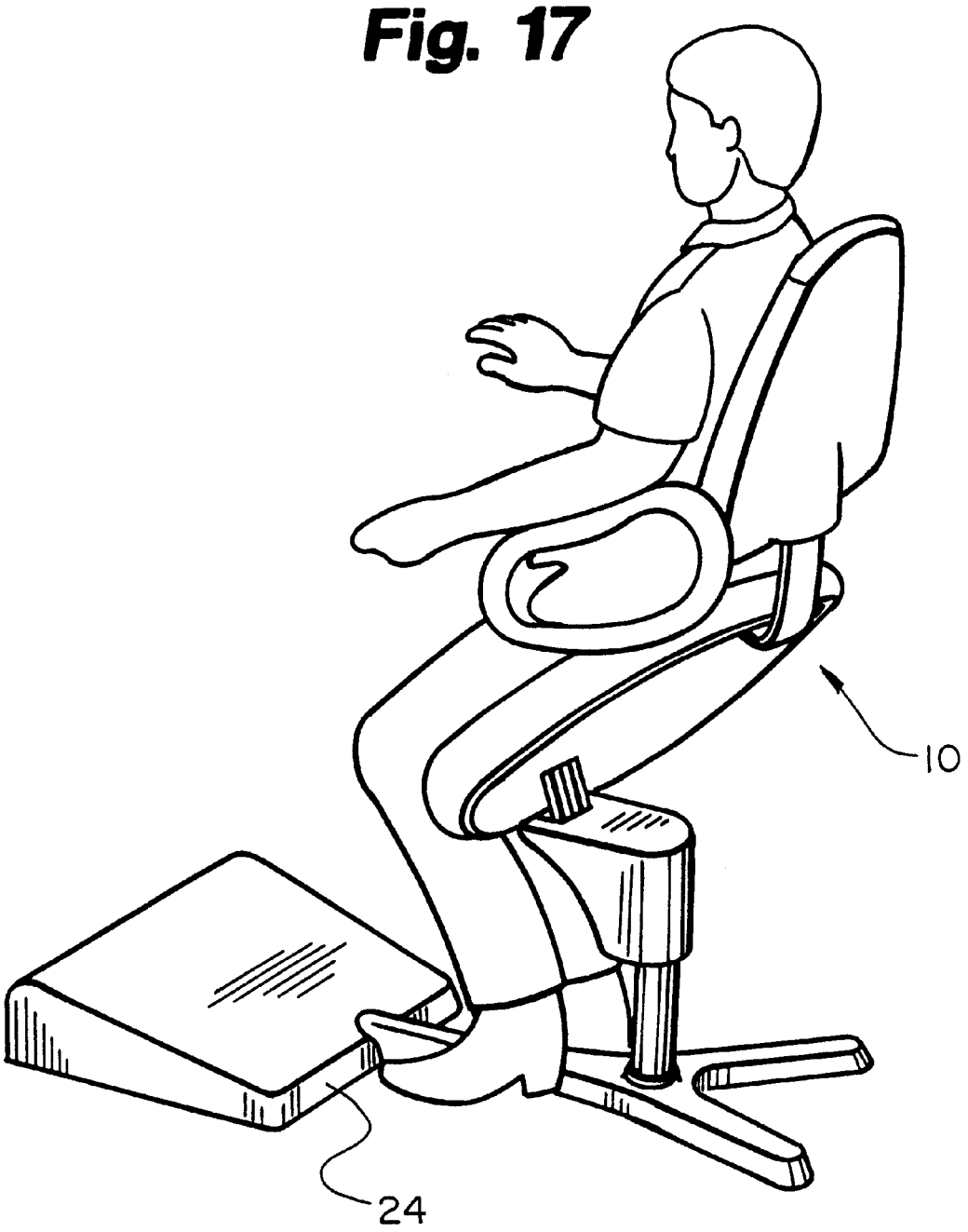
FIG. 17 is an isometric view of an alternate embodiment of the positioner with the lower leg support structure and pad removed.

FIG. 17 is yet another embodiment of the present invention. Positioning system 10 is shown without support pad 26. In this embodiment, base structure 24 includes a gradient of about 25° or higher to enable balance and support of the user's weight. This embodiment is alternately advantageous in operations where support pad 26 may interfere with the work station or may be undesirable for other reasons. The omission of support pad 26 is compensated for by the increased inclination/gradient of base structure 24.

Figure 18:
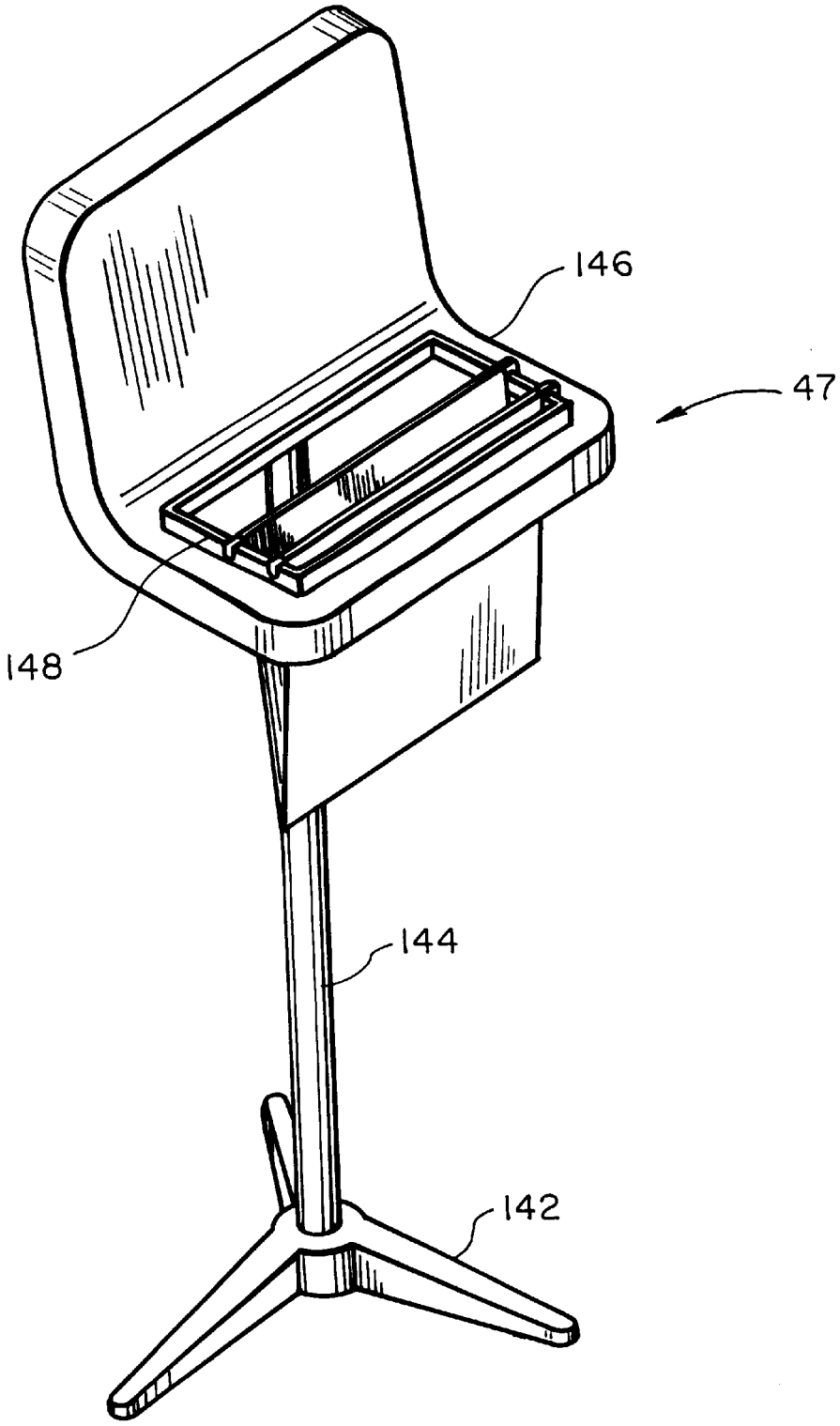
FIG. 18 is an isometric view showing detailed structural parts of the file holder.

FIG. 18 shows a reference holder/working file display 47. Holder 47 includes support base 142 with telescoping column 144 supported at one end thereon. The other end of telescoping column 144 supports a substantially L-shaped structure 146 which includes a mortised section at the leg having edge structure 148 about the perimeter of the cutout. Files and folders are suspended through the cutout and supported on edge structure 148.

Figure 19:
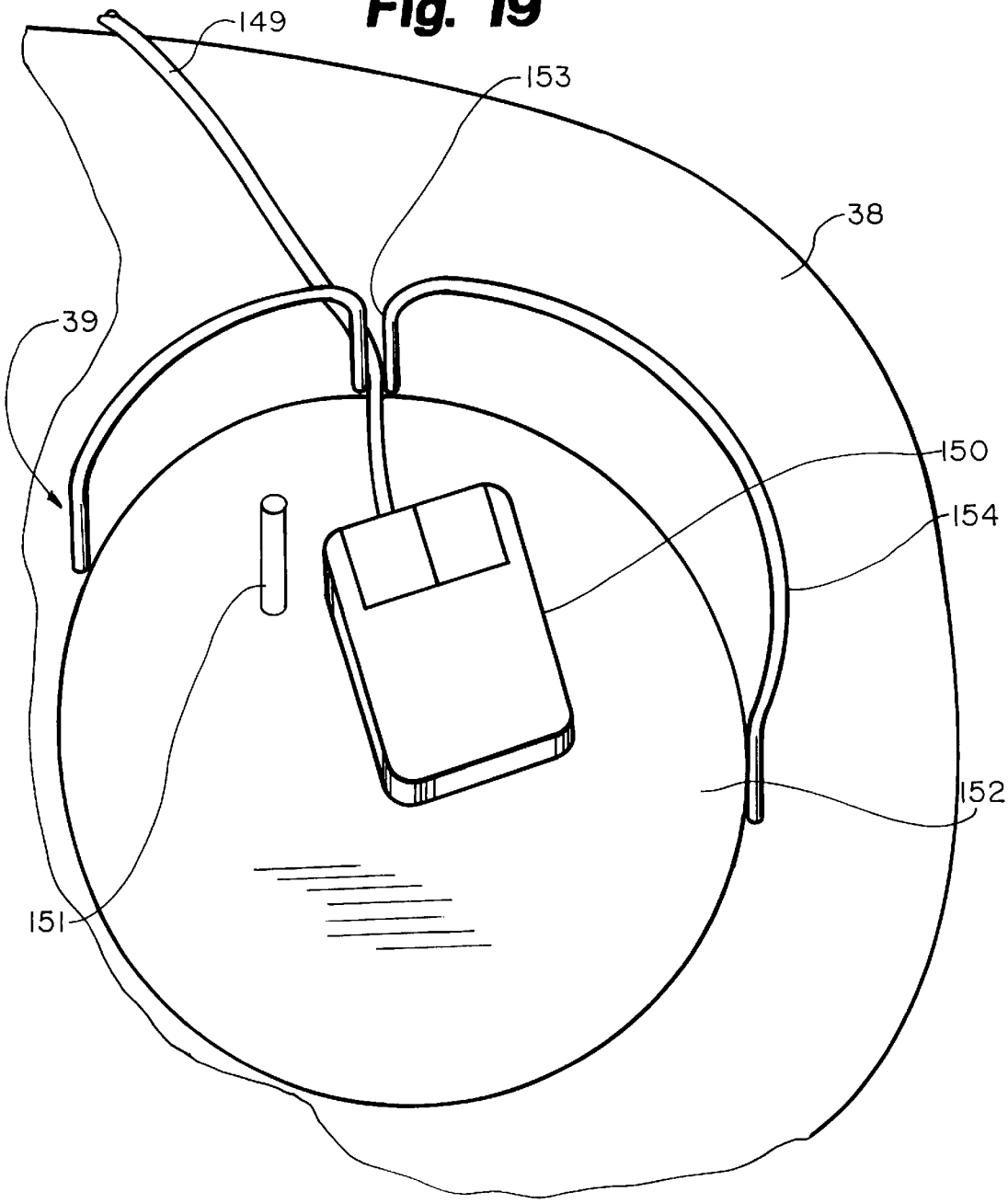
FIG. 19 is a detailed isometric view of the mouse cage.

Directing attention to FIG. 19, a detail of the mouse cage structure 39 is shown. Specifically, mouse 150 is supported on pad 152. Retaining structure 154 forms a partial fence to secure mouse 150 in place. This is particularly important when platform 38 rotates/tilts away from the user to provide an ergonomically beneficial positioning of the user in the lean/stand posture. The aperture 153 defined in the structure 154 compressively engages the wire 149 of the mouse 150 to prevent the mouse 150 from sliding. Other means of preventing such sliding may include a clip on the wire 149 proximate the aperture 153 or an upright peg 151 around which the wire 149 can be wound. Mouse cage 39 allows mouse 150 to be accessible and available regardless of the tilt angle of platform 38.

Figure 20:
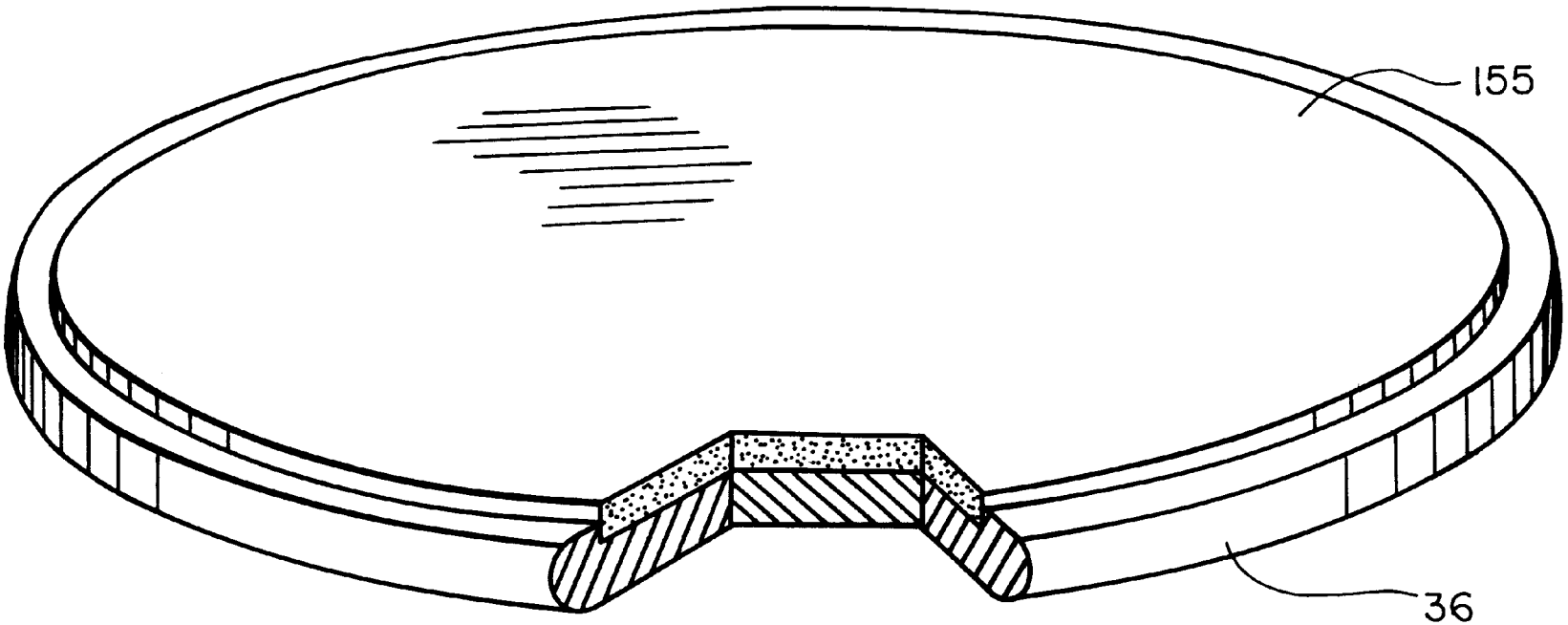
FIG. 20 is a detailed isometric view of the monitor platform with vibration dampener.
Figure 21:
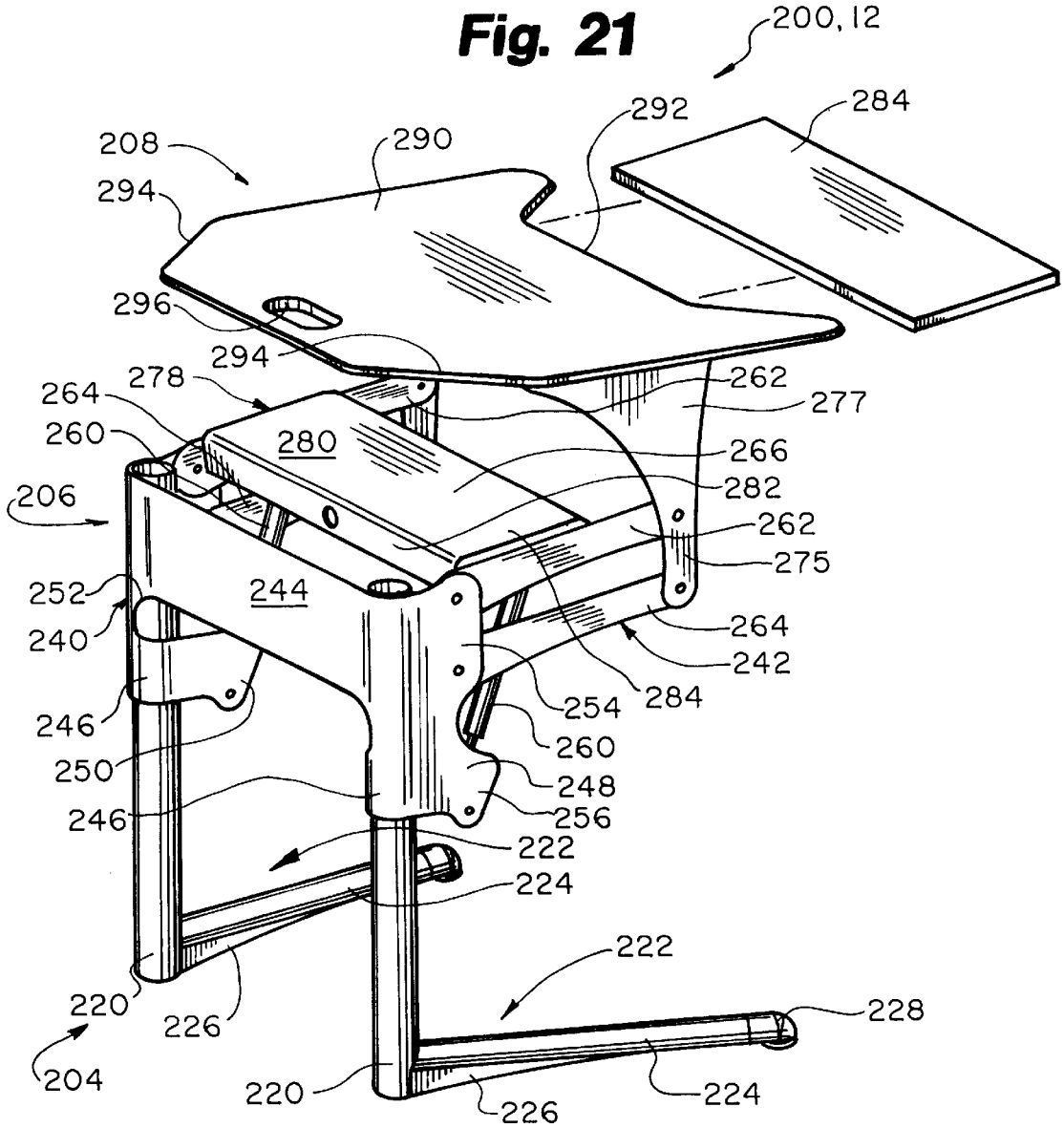
FIG. 21 is a front perspective view of an alternative embodiment of a work station of the present invention.
Figure 22:
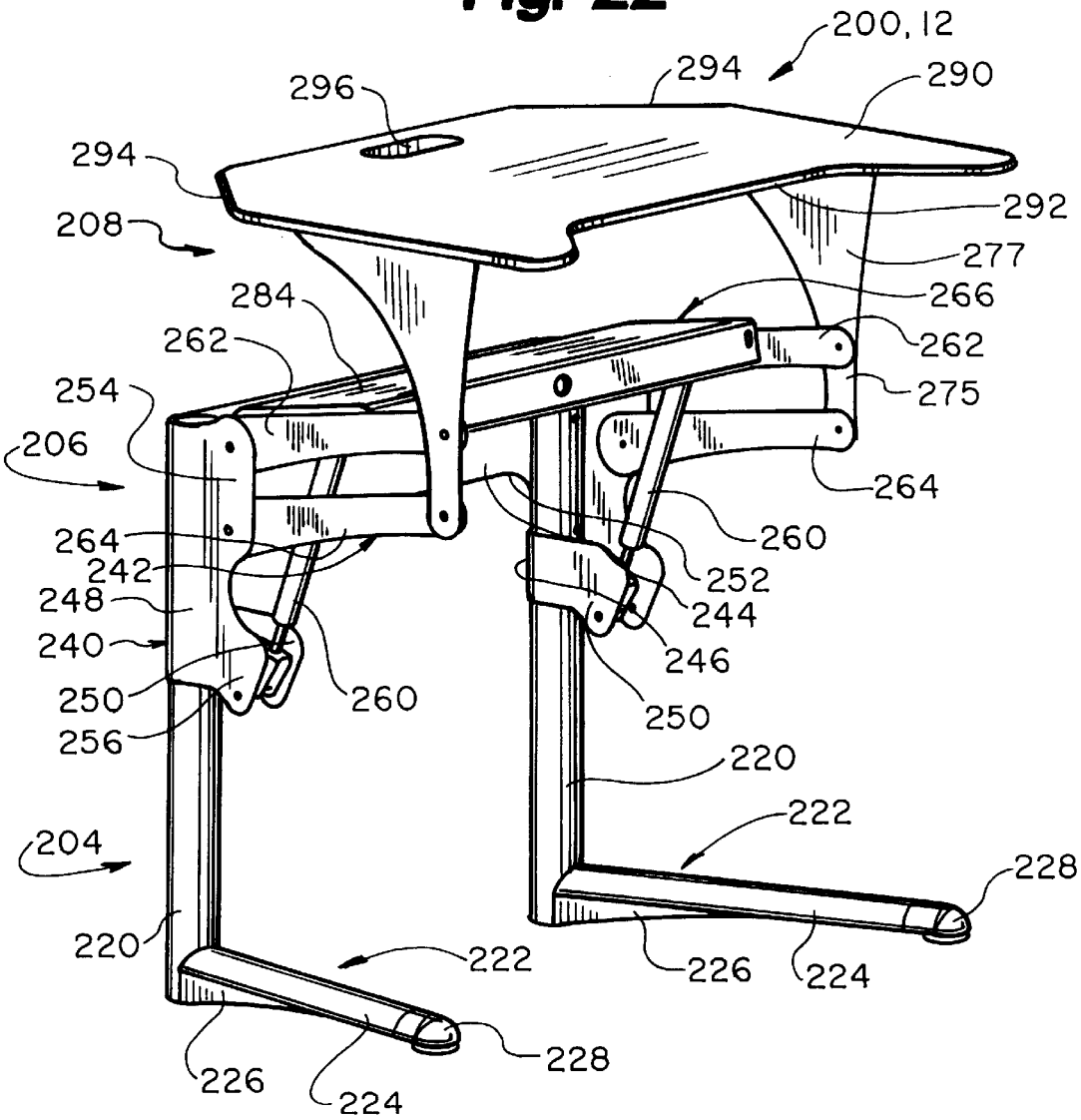
FIG. 22 is a rear perspective view of the alternative embodiment of the work station of FIG. 21.

FIG. 20 is a detailed drawing showing vibration dampener 155 secured on top of platform 36. Vibration dampener 155 may be constructed from 4# EVA black foam or equivalent. Dampener 155 advantageously reduces/eliminates the transfer of vibration and undulatory movement from the joints and links.

Accordingly, the present invention utilizes structures which cooperate with a user's body to form a dynamic bio-mechanical system to promote active sitting and proactive positioning within a range of medically preferred healthy human postures. Positioning system 10 is typically integrated with work station 12 although, as is shown in exemplary embodiment of FIG. 16, it can be independently used at various seated task operations. Similarly, some components of the present invention may be omitted to adapt to specialized applications. Further, various components may be modified to adapt to specific work environments.

An alternative embodiment 200 of work station 12 of the present invention is depicted in FIGS. 21–24. As shown, embodiment 200 of work station 12 generally comprises a support assembly 204, a lift assembly 206, and a work surface assembly 208.

Support assembly 204 preferably comprises a pair of support legs 220, which are preferably of a tubular configuration. Each support leg 220 is unitarily and/or fixedly secured to a stabilizing support 222. Each stabilizing support 222 includes an elongated top portion 224 that is preferably semi-circular in configuration and a pair of side walls 226 that extend substantially perpendicularly down from each side of top portion 224. Side walls 226 are preferably triangular in shape, the triangular shape adding structural rigidity to top portion 224, having the base of the triangle secured to leg support 220 and the tip of the triangle reaching approximately half the length of top portion 224. Each stabilizing support 222 further includes a rounded nose section 228 that preferably houses a height adjustment device 230. Height adjustment device 230 preferably comprises a foot whose height may be mechanically adjusted, e.g., a threaded connection to adjust height, spring-adjusted height, hole and locking pin adjusted height, etc. Alternatively, nose section 228 may house a caster, preferably lockable in nature, allowing for easy positioning of work station 12.

Lift assembly 206 generally comprises a support assembly 240 and a pivoting assembly 242. Support assembly 240 preferably includes a back portion 244, a wrap-around portion 246, an exterior side portion 248, and an interior side portion 250. Back portion 244 extends laterally from first leg support 220 to second leg support 220 and is preferably secured thereto. Further, back portion 244 is preferably unitary with wrap around portion 246; the connection point of back portion 244 to wrap-around portion 246 indicated by arc 252. Wrap-around portion 246 preferably wraps the circumference of each leg support 220 and, as such, is slidably positioned over each leg portion during assembly of work station 12. Once positioned, wrap-around portion 246 is preferably secured in place. Exterior side portion 248 is substantially equivalent in height to the combined height of back portion 244 and wrap-around portion 246, and is preferably secured tangentially thereto at the exterior. Exterior side portion 248 is defined by an upper side portion 254 and a lower side portion 256. Lower side portion 256 is substantially equivalent in shape and in placement along leg support 220, as interior side portion 250. Interior side portion 250 is substantially equivalent in height to wrap-around portion 246 and is preferably secured tangentially thereto at the interior.

Pivoting assembly 242 of lift assembly 206 includes a pair of lift cylinders 260, a pair of main lift arms 262, a pair of follower arms 264, and a slide adjustment assembly 266. Each lift cylinder 260 is defined by a first end 268 and a second end 270 (see FIG. 23). First end 268 is maintained in a fixed position via a bracket 272 that is positioned between lower side portion 256 of exterior side portion 248 and interior side portion 250, and that is secured to interior side portion 250. Second end 270 is maintained in a fixed position by virtue of a bracket 274 secured to the underside of a support bar 276, which forms a part of slide adjustment assembly 266. Main lift arms 262 are pivotally secured between upper side portion 254 of exterior side portion 248 and legs 275 of a table support bracket 277. Each follower arm 264 is positioned below a respective main lift arm 262 and is substantially parallel thereto. Like each main lift arm 262, each follower arm 264 is preferably pivotally secured between upper side portion 254 of exterior side portion 248 and legs 275 of table support bracket 277.

Figure 23:
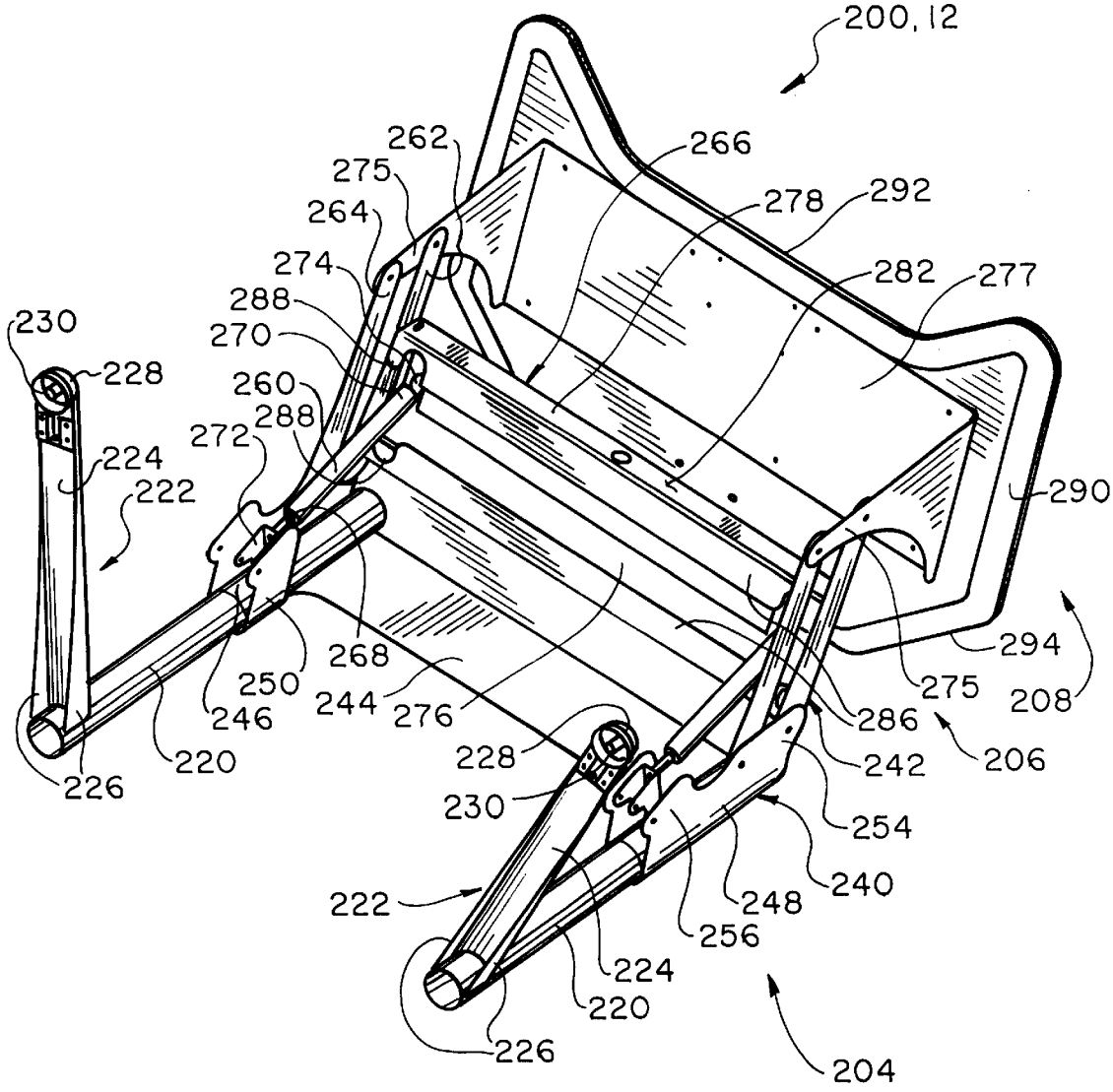
FIG. 23 is a perspective view depicting the underside of the alternative embodiment of the work station of FIG. 21.

Slide adjustment assembly 266 includes support bar 276, which is fixedly secured to second end 270 of the two lift cylinders 260, and a slide wrap 278. As indicated above, support bar 276 is preferably fixedly secured to second end 270 of lift cylinder 260 and is additionally preferably secured at its sides to each main lift arm 262. Slide wrap 278, to which may be attached an additional table surface 284 (shown in FIG. 21), is preferably unitary in configuration including a top portion 280, a pair of side portions 282, and a pair of bottom portions 286 (FIG. 23). Bottom portions 286 wrap to the underside of support bar 276 and include recesses 288 to accommodate the position of lift cylinders 260 allowing slide wrap 278 to be slid back and forth atop support bar 276. Table surface 284 may be fixedly secured or alternatively, pivotally secured to slide wrap 278 to provide for angular adjustment, i.e., tilting of table surface 284.

Work surface assembly 208 generally includes a rigid work surface 290 and table support bracket 277. Work surface 290 may be of any desirable shape but preferably includes a recessed portion 292 allowing work surface 290 to surround a user and angled corner portions 294. Work surface 290 is preferably provided with an aperture 296, which may be used as a handle to aid in lifting and lowering work surface 290 in conjunction with lift cylinders 260 or alternatively, may be used as an opening through which computer cables, power cords, etc., may be inserted.

Figure 24:
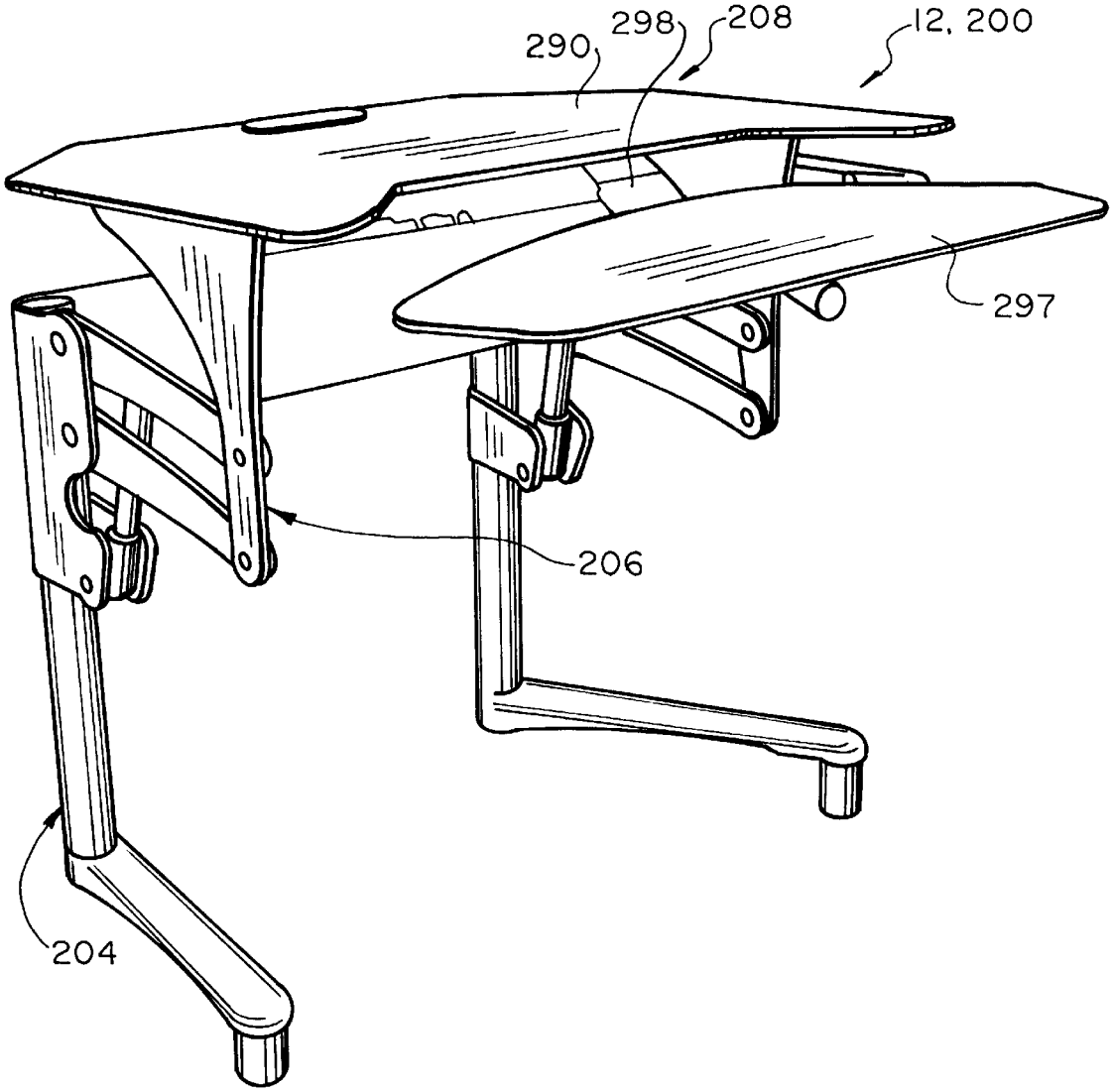
FIG. 24 shows the work station of FIGS. 21–23 wherein the work surface of the work station includes an additional articulating keyboard/work surface.
Figure 25:
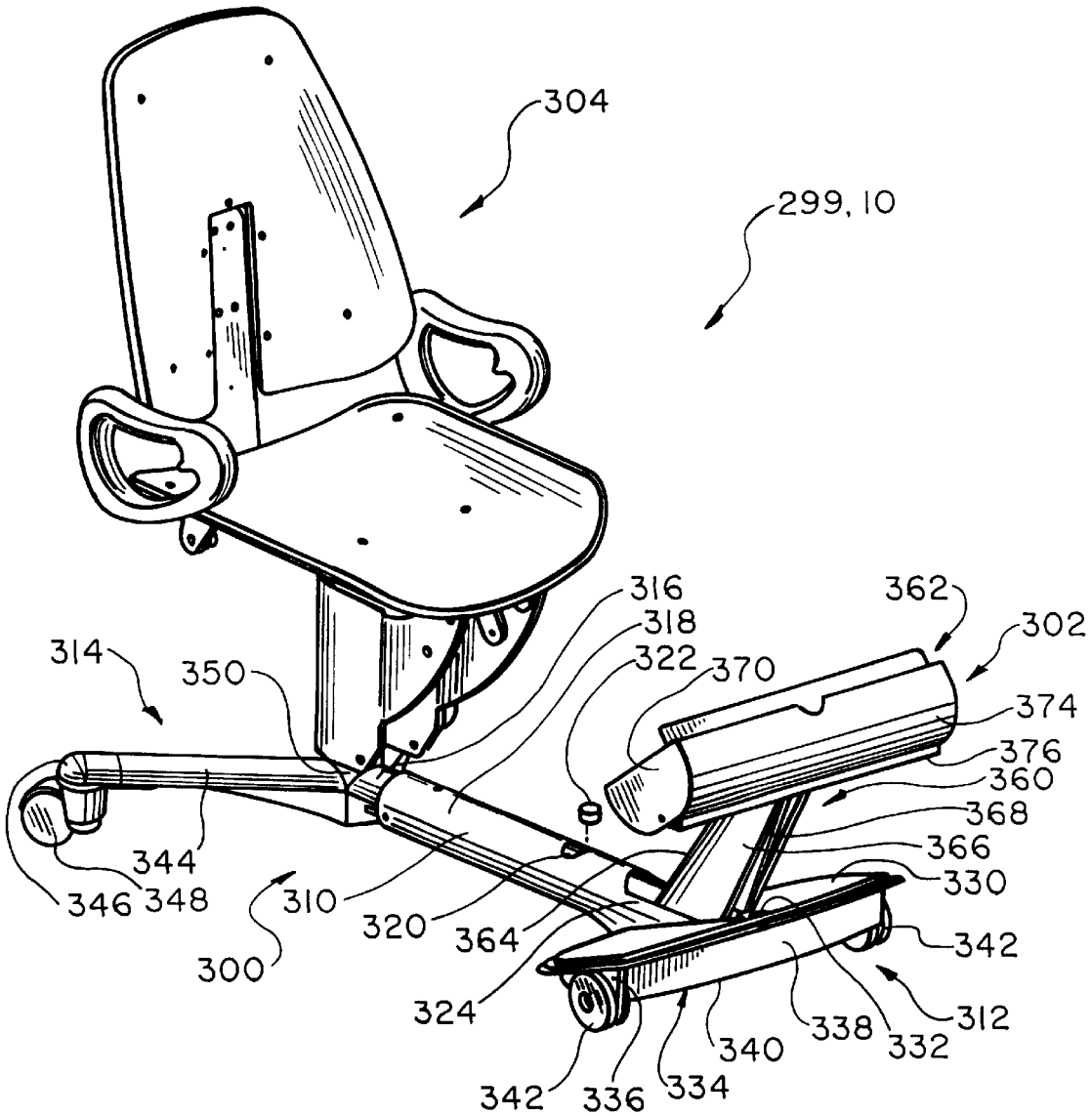
FIG. 25 is a front perspective view of an alternative embodiment of a body positioning system of the present invention.
Figure 26:
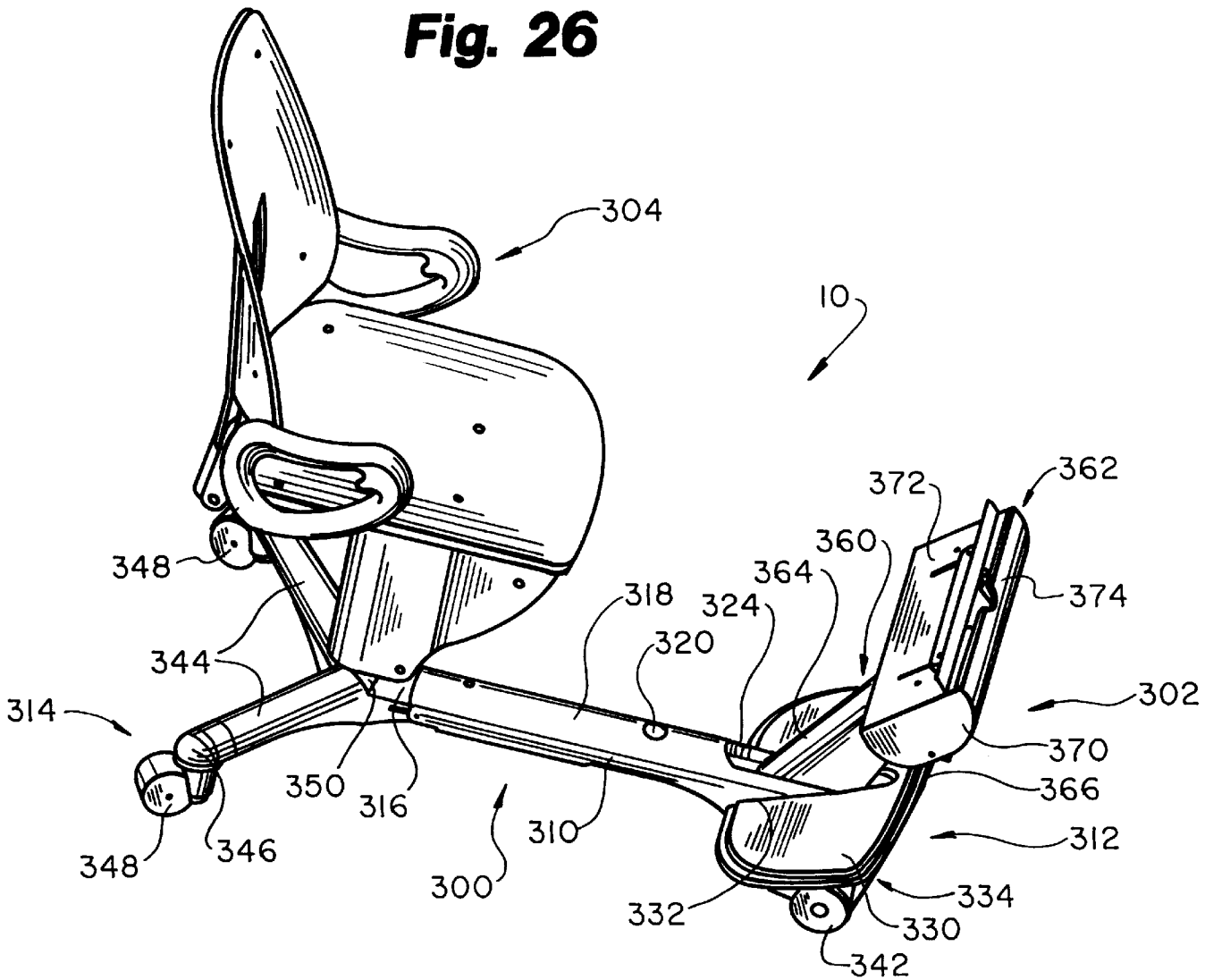
FIG. 26 is a side perspective view of the alternative embodiment of the body positioning system of the present invention.
Figure 27:
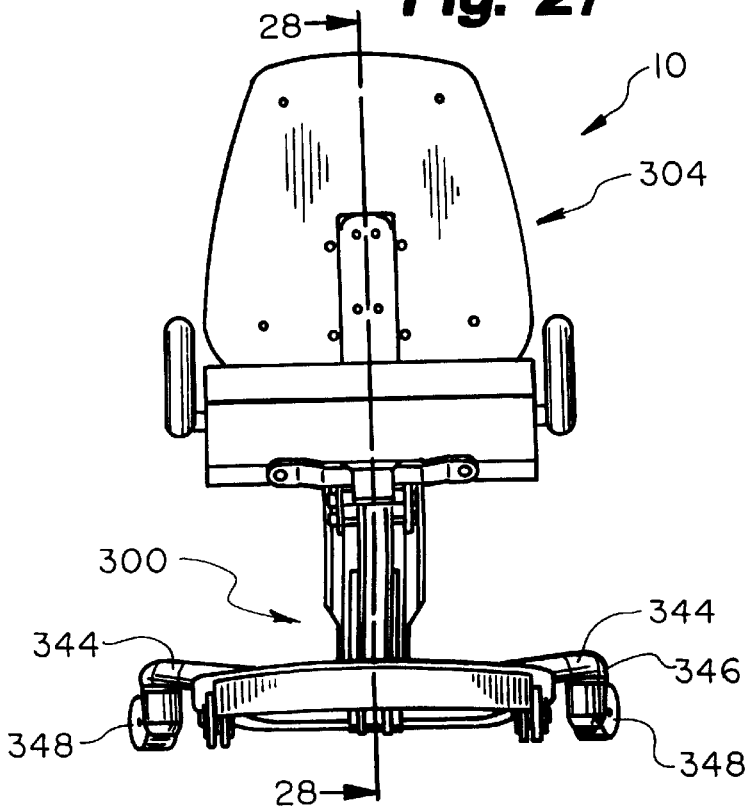
FIG. 27 is a rear plan view of the alternative embodiment of the body positioning system of the present invention.
Figure 28:
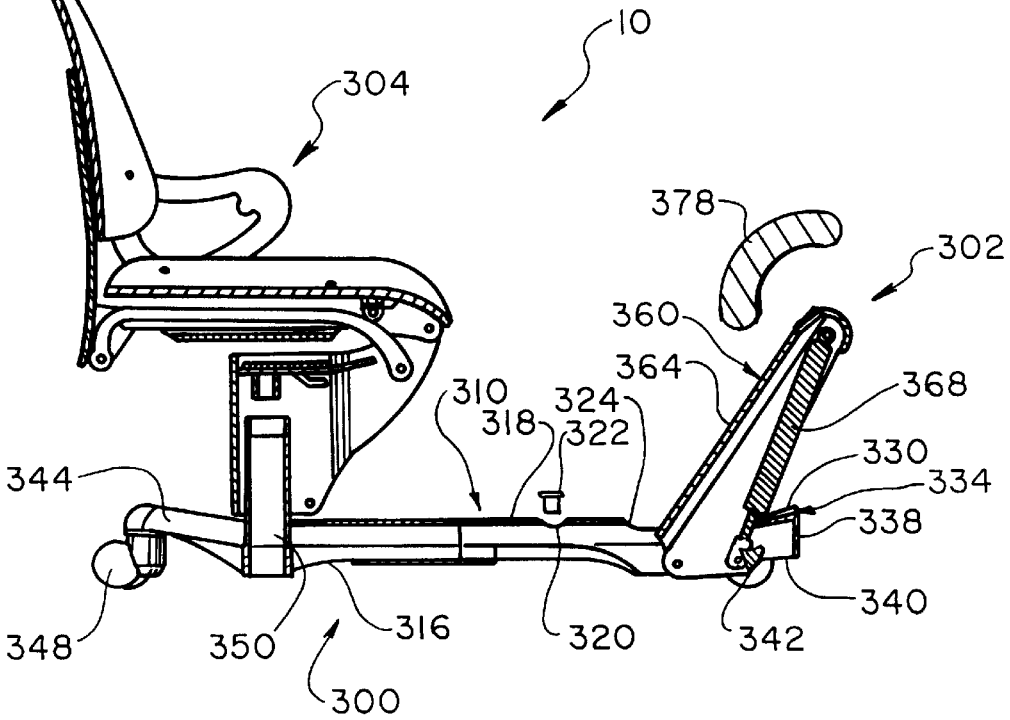
FIG. 28 is a cross-sectional view taken along line A—A of FIG. 27.

Alternatively, rigid work surface 290 may be replaced with a work surface that additionally incorporates an articulating keyboard surface/work surface 297, see FIG. 24 like those available from Ergonomic Concepts of Raleigh, N.C. With the addition of an articulating keyboard surface/work surface 297, slide adjustment assembly 266 may be replaced with a simple rigid member fixedly secured between main lift arms 262 or any semblance thereof. However, as with table surface 284, keyboard surface 297 is preferably provided with the ability of angular adjustment, i.e., tilting by means of shiftable connector 298 affixed to the underside of work surfaces 290, 297.

FIGS. 25–28 depict an alternative embodiment 299 of body positioning system 10, the location of which may be established independently of the location of the work station 200, 12. As shown, body positioning system 299, 10 generally includes a base structure 300, a lower leg-support assembly 302, and an adjustable chair structure 304.

Base structure 300 includes a central member 310 that is supported between a T-end portion 312 and a Y-end portion 314. Central member 310 is preferably a telescoping member having inner portion 316 that is slidably adjustable within an outer portion 318 of member 310. The telescoping nature of central member 310 allows each user to determine their preferred distance of chair structure 304 to lower leg-support assembly 302. Once at a preferred distance, outer portion 318 is preferably secured to inner portion 316 to prevent undesirable movement of central member 310. Outer portion 318 of member 310 preferably includes an aperture 320 to allow for positioning of a depressible foot pedal 322 and an elongate aperture 324 configured to allow for movement of lower leg-support assembly 302.

T-end portion 312 of base structure 300 includes an angled face plate 330 for supporting and positioning a user's feet. Angled face plate 330 includes a central recess 332 allowing face plate 330 to be positioned about central member 310 and lower leg-support assembly 302. Face plate 330 is supported by a box structure 334 having a pair of side panels 336, a rear panel 338, and a lower panel 340. A pair of wheels 342 are secured to and operate to support T-end portion 312.

Y-end portion 314 of base structure 300 includes a pair of elongated arms 344 that extend angularly from inner portion 316 of base structure 300. Each elongated arm 344 includes a downward extending nose portion 346 to which is secured a swiveling caster 348. Y-end portion 314 further provides a central shaft 350 to which is secured to adjustable chair structure 304.

Lower leg-support assembly 302 includes a central support member 360 and lateral lower leg support 362. Central support member 360 includes a front plate 364 and a pair of side plates 366. The rear of central support member 360 remains open allowing central support member 360 to house, at least in part, air cylinder 368. Air cylinder 368 (see FIG. 28) is pivotally connected at one end to central support member 360 and at its other end to box structure 334 of T-end portion 312. The pivotal connection of air cylinder 368 allows lower leg-support assembly 302 to be moved forward and back as desired using foot pedal 322, which is operably connected to air cylinder 368. Specifically, depressing foot pedal 322 operates air cylinder 368 such that lower leg-support assembly 302 is moved towards chair structure 304. Releasing foot pedal 322 operates to stop movement of lower leg-support assembly 302 and locking lower leg support 302. Lower leg-support assembly 302 is moved forward by manually pushing assembly 302 forward towards T-end portion 312 while operating foot pedal 322.

Lateral lower leg support 362 is generally semi-circular in shape having a pair of side plates 370, a planar front plate 372, a rounded rear portion 374, and an open lower portion 376 that allows for insertion of the upper portion of central support member 360. Lateral lower leg support 362 is preferably pivotally secured to central support member 360 allowing the user to angularly adjust lateral lower leg support 362. A rounded cushion 378 preferably covers front plate 372 and a portion of rounded rear portion 374, as shown.

Adjustable chair structure 304 is substantially identical to the chair structure of earlier-described body positioning systems 10, incorporating their components and manner of operation, however, adjustable chair structure 304 is supported by central shaft 350 of base structure 300 rather than by pedestal 20 of the earlier embodiments. As such, adjustable chair structure 304 in combination with base structure 300 and lower leg-support assembly 302 cooperate as body positioning system 10 to alternate between the "seated", "breathe-easy", and "lean/stand" positions of FIG. 14.

Figure 29:
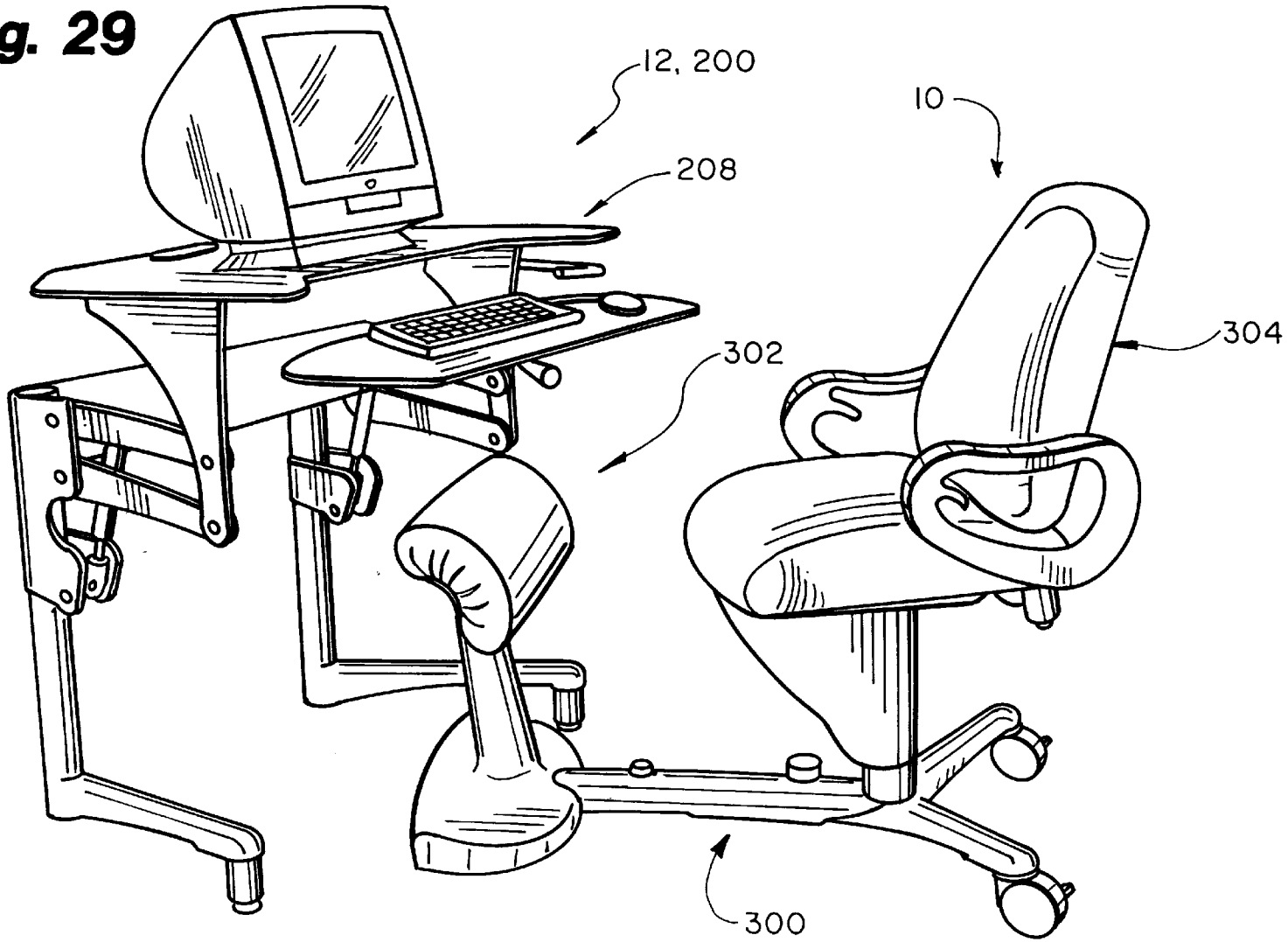
FIG. 29 is an ensemble depiction of the work station of FIGS. 21–24 and the body positioning system of FIGS. 25–28 wherein both are in a seated operating position.
Figure 30:
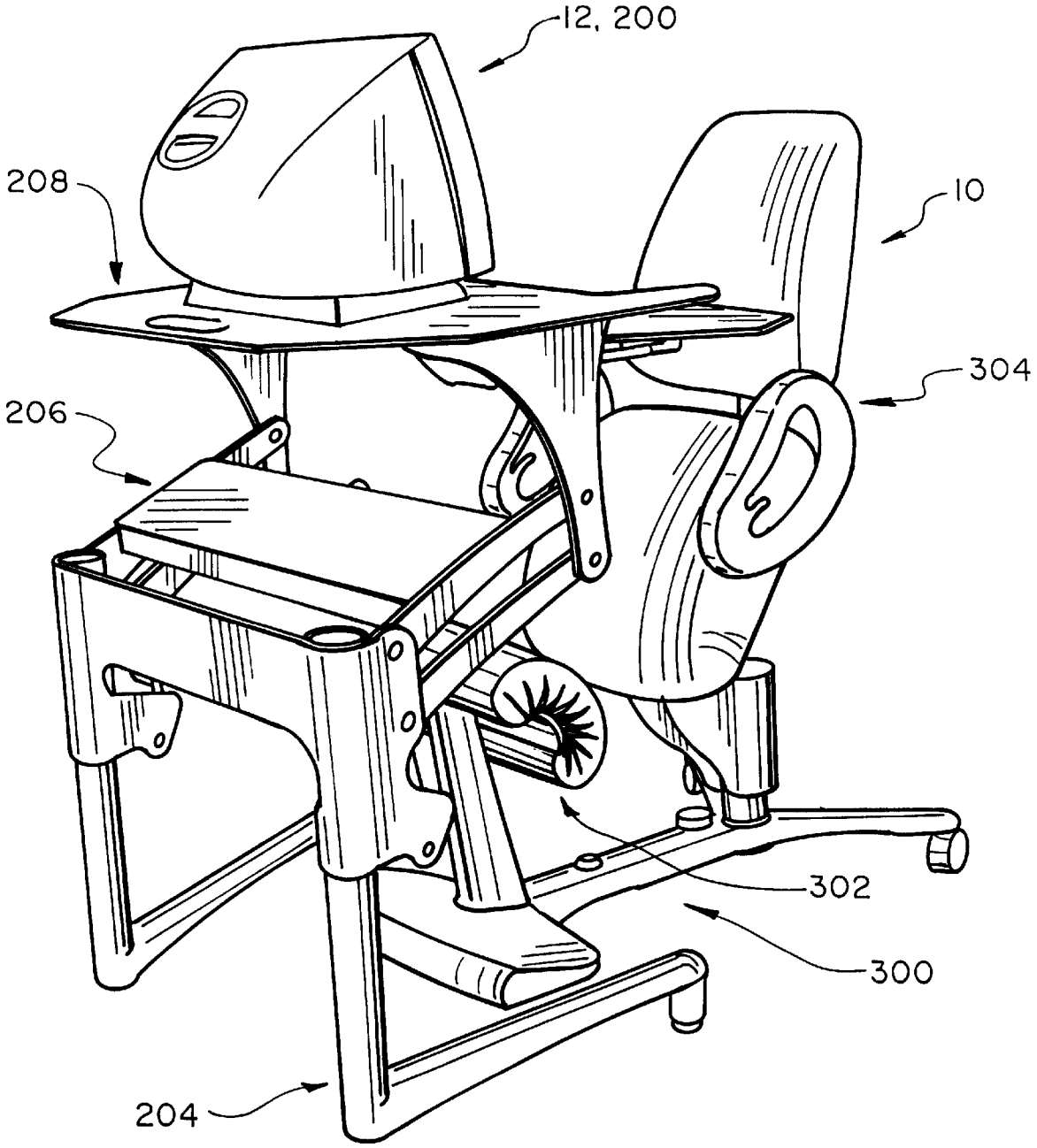
FIG. 30 is an ensemble depiction of the work station of FIGS. 21–24 and the body positioning system of FIGS. 25–28 wherein both are in a seated operating position.

FIG. 29 depicts embodiment 200 of work station 12 and embodiment 299 of body positioning system 10 in a seated working position where body positioning system 10 is positionable relative the position of work station 12. FIG. 30 depicts embodiment 200 of work station 12 and embodiment 299 of body positioning system 10 in a lifted working position, e.g., the "breathe-easy" or "lean/stand" position.

A further alternate embodiment of the body positioning system 10 and computer work station 12 is depicted in FIGS. 31–43, with the computer work station 12 being depicted in FIGS. 31–35, and the body positioning system 10 being depicted FIGS. 36–43. Like numbers in these figures denote like components with respect to the figures discussed above.

Referring to FIGS. 31–35, the work station 12 includes a keyboard surface 297 supported by a work surface 290, which is in turn supported by a frame 370. The frame 370 has a pair of spaced apart tubular legs 371. The tubular legs 371 are angled inward with respect to one another such that the distance between the front ends 371*a* is significantly less than the distance between the rear ends 371*b*. Such angularity assists in defining a relatively wide space to permit the body positioning system 10 to be disposed relatively close to the work station 12. Feet 372 for engaging the surface supporting the work station 12 are disposed proximate each of the front ends 371*a* and rear ends 371*b*.

A pair of upright stanchions 373 are fixedly coupled to the tubular legs 371 approximately ⅓ of the distance from the respective front 371*a* to the respective rear 371*b*. Each of the stanchions 373 is preferably formed of tubular metal construction and is fixedly coupled to the respective tubular leg 371. A pair of cross-members 374*a*, 374*b* extend between the stanchions 373 and are fixedly coupled thereto. Further, a generally rectangular support panel 375 is fixedly coupled to each of the stanchions 373 and assists in providing structural rigidity to the frame 370. The support panel 375 is preferably fixedly coupled to the cross-members 374*a*, 374*b*. In addition to the support panel 375, a decorative panel 376 may be affixed to the front surface of the stanchions 373.

A pair of generally rearwardly directed work surface support brackets 377 are disposed proximate to the top margin of each of the stanchions 373. Each of the work surface support brackets 377 is fixedly coupled to the respective stanchion 373 as by welding, suitable fasteners, or the like. The work surface support brackets 377 have a pair of pivot points 378*a*, 378*b* that are spaced apart and disposed in a generally vertical relationship.

The work surface member 290 and keyboard surface member 297 taken together comprise a working surface assembly 379. The work surface member 290 has a generally upwardly directed planar margin comprising a work surface 380. A suspension assembly 381 supports the planar work surface 380.

Figure 35:
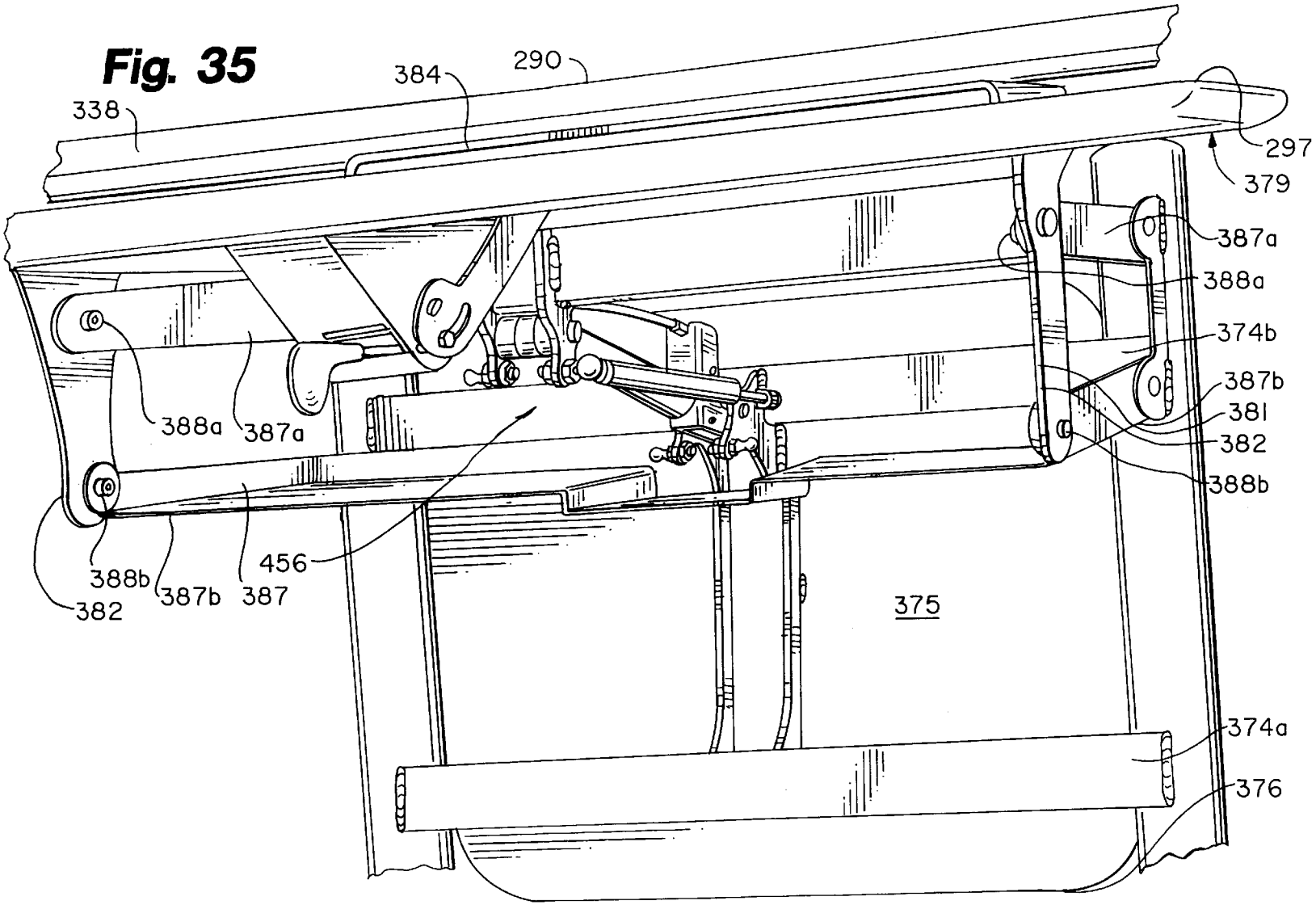
FIG. 35 is a perspective view of the suspension system of the work surface.

The suspension assembly 381 includes a pair of generally mirror image, depending brackets 382 that depend from the work surface member 290 proximate the side margins thereof. Referring to FIG. 35, the two depending brackets 382 are coupled by a cross-member 384. The cross-member 384 is fixedly coupled to the underside surface 383 of the work surface member 290. Such coupling may be in the form of screws or other suitable fasteners. A pair of parallelogram support links 387*a*, 387*b* are coupled to each of the depending brackets 382 at pivot points 388*a*, 388*b*, respectively. An underlying tray 387 extends between the two parallelogram support links 387*b*. An actuator depression 386 is formed proximate to the center portion of the tray 385. The actuator depression 386 accommodates the compressed gas spring assembly 456, as will be described in detail below.

Figure 33:
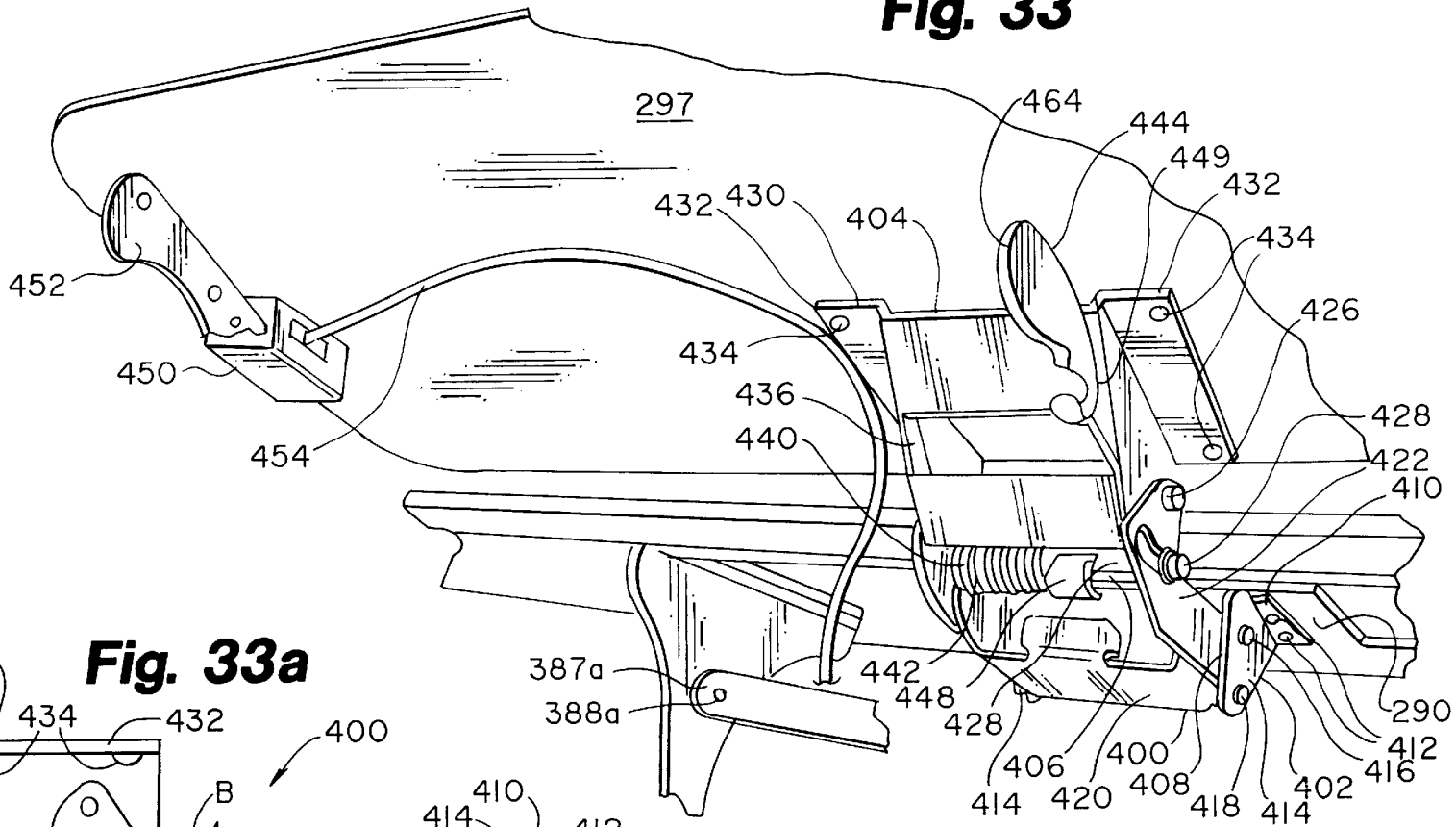
FIG. 33 is an underside view of the workstation planar work surface depicting the actuators affixed thereto.
Figures 34, 34A:
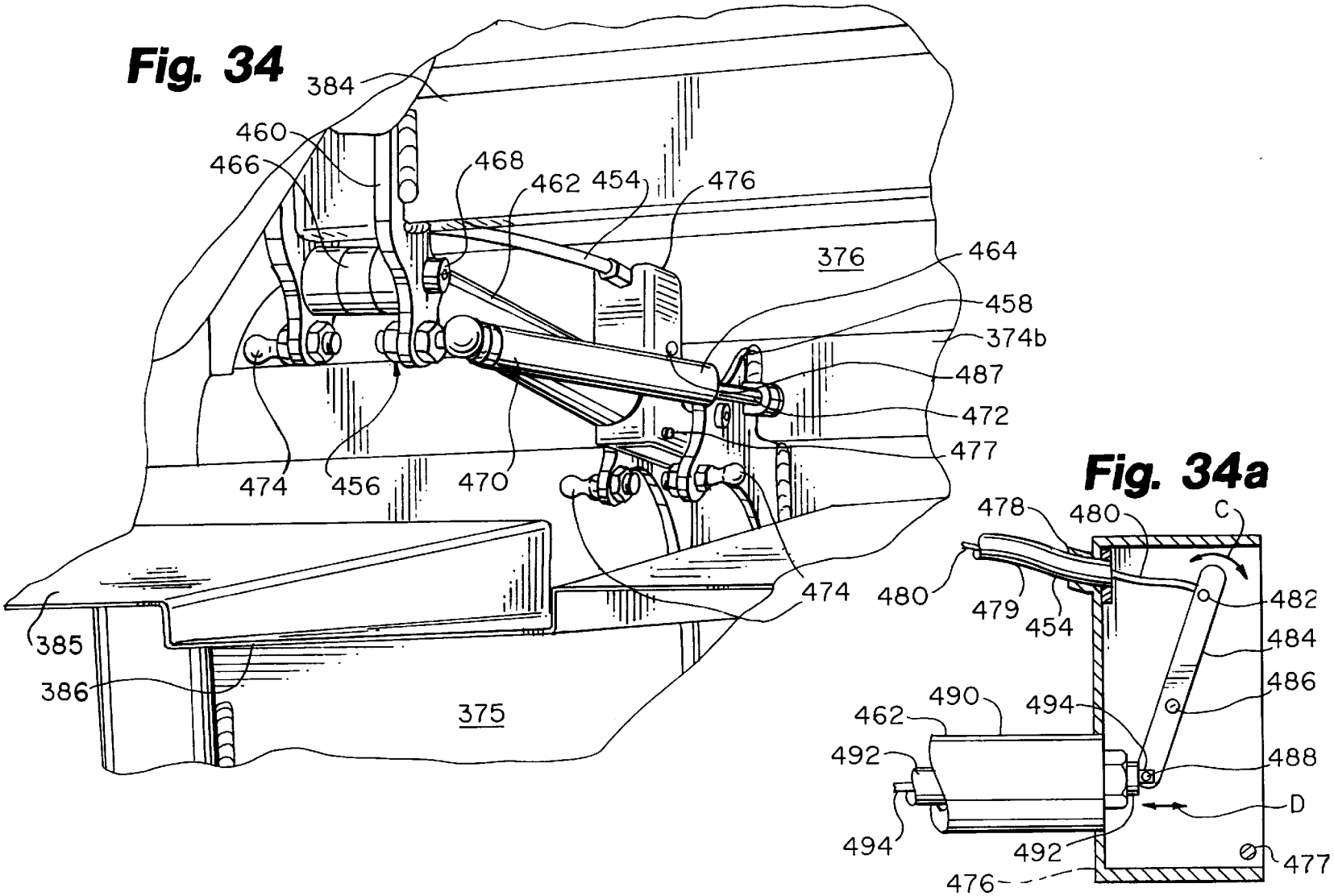
FIG. 34 is a perspective view of the compressed gas spring assembly supporting the work surface.
FIG. 34*a* is a side elevational view of the actuator controlling the primary gas spring of FIG. 34, a portion of the depiction being cut away.

As depicted in FIGS. 33–35, a suspension 400 operably couples the keyboard surface 297 to the work surface 290. The suspension 400 has three major subcomponents: work surface coupling assembly 402, keyboard surface coupling assembly 404, and hinge assembly 406.

The work surface coupling assembly 402 includes a support flange 408. As depicted in FIG. 33, the support flange 408 has both a left and a right side that are substantially mirror images of one another. Accordingly, the description below applies to both sides of the support flange 408. The support flange 408 further includes two orthogonally disposed flanges, the first of which is a generally horizontal flange 410 and the second is a depending, generally vertical flange 414. The two horizontal flanges 410 are fixedly coupled to the underside of the work surface 290 by fasteners 412 which may be screws or other suitable fasteners. It should be noted that the horizontal flange 410 and the vertical flange 414 may be formed of an integral unitary piece, preferably formed of metal. Alternatively, the horizontal flange 410 may be a plate that fits flush with the underside of the work surface 290. The depending vertical flange 414 may be formed of a single U-shaped piece of metal that has the two depending vertical flanges 414 coupled by a generally planar cross-piece and is fixedly coupled to the plate forming the horizontal flange 410.

Each of depending vertical flanges 414 has a pair of spaced apart hinge points 416, 418. The hinge points 416, 418 have inwardly directed hinges. The hinge of the hinge point 416 is rotatably coupled to an outer upper link 422 and a hinge of the hinge point 418 is rotatably coupled to an inner lower link 420.

The inner lower link 420 and the outer upper link 422 are generally disposed such that they define a shiftable parallelogram and remain generally parallel throughout their range of motion. Accordingly, the planar orientation of the keyboard surface 297 with respect to the work surface 290 remains constant throughout the range of motion of the lower link 420 and the upper link 422.

The inner lower link 420 has a semi-circular groove 424 defined therein. The inner lower link 420 is rotatably coupled to the keyboard surface coupling assembly 404 at a hinge point 426. Semi-circular groove 424 is in registry with a bore (not shown) defined in the distal end of the inner lower link 420. The inner lower link 420 is rotatably coupled to the keyboard surface coupling assembly 404 by a hinge pin 428.

The keyboard surface coupling assembly 404 includes a support flange 430. Like the support flange 408 of the work surface coupling assembly 402, the support flange 430 has a pair mirror-image horizontal flanges 432 and a pair of mirror-image depending vertical flanges 436. The horizontal flanges 432 are fixedly coupled to the underside of the keyboard surface 297 by fasteners 434 which may be screws or other suitable fasteners. The depending vertical flange 436 has a semi-circular groove 438 defined therein. The semi-circular groove 438 has a generally smaller length dimension than the semi-circular groove 424 and has a generally similar radius acting about a common point of rotation. The semi-circular groove 438 is preferably disposed in registry with at least a portion of the semi-circular groove 424.

The third sub-component of suspension 400 is the hinge assembly 406. The hinge assembly 406 includes a hinge pin member 440. The hinge pin member 440 includes the aforementioned hinge pin 428. The hinge pin 428 acts to rotatably couple three separate components; the inner lower link 420 and the outer upper link 422 of the work surface coupling assembly 402 and the support flange 430 of the keyboard surface coupling assembly 404. Accordingly, the hinge pin 428 passes through the semi-circular groove 424, the bore (not show) defined in the distal end of the inner lower link 420, and the semi-circular groove 438 defined in the vertical flanges 436 of the keyboard surface coupling assembly 404. A coil spring 442 is disposed concentric with a portion of the hinge pin 428. Under compression, the spring 442 acts to immobilize and lock in place all the aforementioned components that are rotatably coupled to the hinge pine 428.

The spring 442 may be selectively put into compression for locking the aforementioned components supported by the hinge pin 428 and relaxed for permitting relative motion between such components. The spring 442 is actuated by an actuator member 444. The actuator member 444 includes an actuator handle 446 that is operably coupled to a cam actuator 448. Such coupling may be effected by an adjustable L-shaped rod 449 having a first end coupled to the actuator handle and a second end coupled to the cam actuator 448. In the depiction of FIG. 33, the actuator handle 446 is in the engaged disposition wherein the cam actuator 448 is compressibly engaged with the spring 442. Rotating the actuator handle 446 leftward to the disengaged disposition causes the L-shaped rod 449 to translate rearward, thereby rotating the cam actuator 448 about a pivot point. The cam actuator 448 rotatably translates relative to the spring 442 such that the compressive force exerted by the cam actuator 448 on the spring 442 is relaxed. The disengaged disposition is an over-center situation and the spring 442 stays relaxed until the operator returns the actuator handle 446 to the engaged disposition.

Figure 33A:
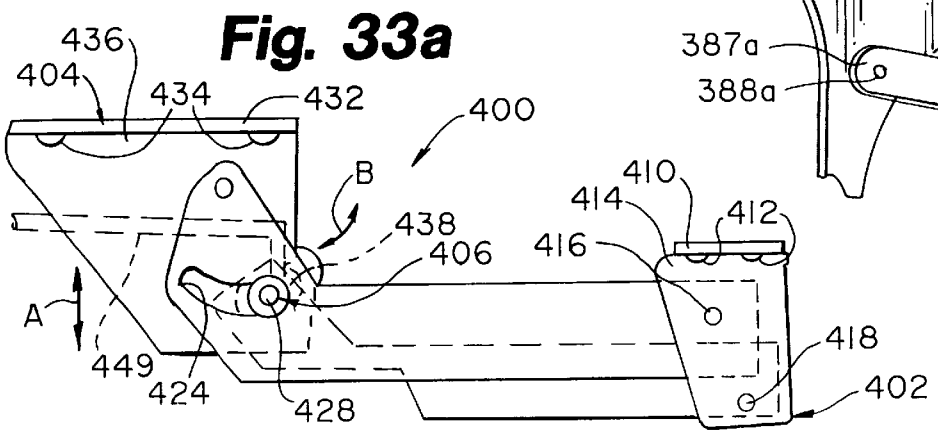
FIG. 33*a* is a side perspective view of the key board suspension with portions thereof depicted in phantom.

In operation, the unique hinged relationship of the suspension 400 permits the keyboard surface 297 to move relative to the work surface 290 while maintaining the angular relationship of the keyboard surface 297 to the work surface 290. By this is meant that if the keyboard surface 297 is in a leveled relationship with the work surface 290, the keyboard surface 297 may be raised or lowered relative to the work surface 290, but the level relationship is maintained even though the keyboard surface 297 is in a different, parallel plane relative to the work surface 290. This motion is indicated by arrow A of FIG. 33*a*. Additionally, the keyboard surface 297 is tiltable with respect to the work surface 290. This is indicated by the arrow B of FIG. 33*a*.

To achieve a level displacement of the keyboard surface 297 relative to the work surface 290, as indicated by the arrow A, the actuator handle 446 is moved leftward from the disposition depicted in FIG. 33 to a disengaged disposition. In such disposition, the cam actuator 448 has been rotated out of compressive engagement with the spring 442 and the spring 442 is not exerting any appreciable locking force on the above-noted components that are supported by the hinge pin 428. The keyboard surface 297 may be pushed downward or raised upward by exerting pressure thereon. Such pressure results in motion of the inner lower link 420 and the outer upper link 422 that maintains a parallel relationship between the links 420, 422.

In order to maintain such parallel relationship, the hinge pin 428 translates within the semi-circular groove 424. In order to achieve a tilting relationship of the keyboard surface 297 to the work surface 290, a rotational force may be imposed on the keyboard surface 297. Such rotational force causes the tilting of the keyboard surface 297 and motion of the semicircular groove 438 relative to the hinge pin 428. Once the desired positional relationship of the keyboard surface 297 relative to the work surface 290 is achieved, the actuator handle 446 is again moved rightward to the engaged disposition, as depicted in FIG. 33.

A further actuator is disposed on the underside of the keyboard surface 297. This actuator is the work surface actuator assembly 450. The work surface actuator assembly 450 is fixedly coupled to the underside surface of the keyboard surface 297. The work surface actuator assembly 450 includes an actuator handle 452 that is operably coupled to the proximal end of the concentric coaxial cable 454.

The concentric coaxial cable 454 is operably coupled to a compressed gas spring assembly 456 for selective control thereof. The compressed gas spring assembly 456 is best depicted in FIGS. 34 and 34*a*. The compressed gas spring assembly 456 is operably coupled by a first support bracket 458 to the support panel 375 and the cross-member 374*b*. The compressed gas spring assembly 456 is further operably coupled by a second support bracket 460 that is fixedly coupled to the cross-member 384 of the work surface 379. As such, the compressed gas spring assembly 456 controls the spatial relationship of the work surface assembly 379 to the frame 370. As will be seen, this spatial relationship is controlled by an operator primarily through actuation of the work surface actuator assembly 450 followed by application of a force to the work surface assembly 379.

The compressed gas spring assembly 456 includes a primary gas spring 462. The primary gas spring 462 is connected at a first end to an actuator body 476 as is described in greater detail below. The primary gas spring 462 is connected a second end to the second support bracket 460 by means of a connector 466 having a bore (not shown) defined therein through which a connector pin is disposed.

In order to assist in the support of relatively heavy objects borne on the work surface 290, a plurality of secondary gas springs 464 may be included that extend from the support bracket 458 to the second support bracket 460. Such secondary gas springs 464 exert a generally upward bias on the work surface 290 in order to minimize the force required of an operator to reposition the work surface 290. A single such secondary gas spring 464 is depicted in FIG. 34. The secondary gas spring 464 includes a cylinder 470 and a concentric slidable piston rod 472. The secondary gas spring 464 is coupled at the first support bracket 458 and the second support bracket 460 by ball joints 474. Ball joints 474 are included for the installation of additional secondary gas springs 464, as needed. Instead of adding secondary gas springs 464, the point of attachment of the primary gas spring 462 can be varied such as depicted in FIG. 12 where a threaded screw 103 adjusts the link member 109.

Figure 34B:
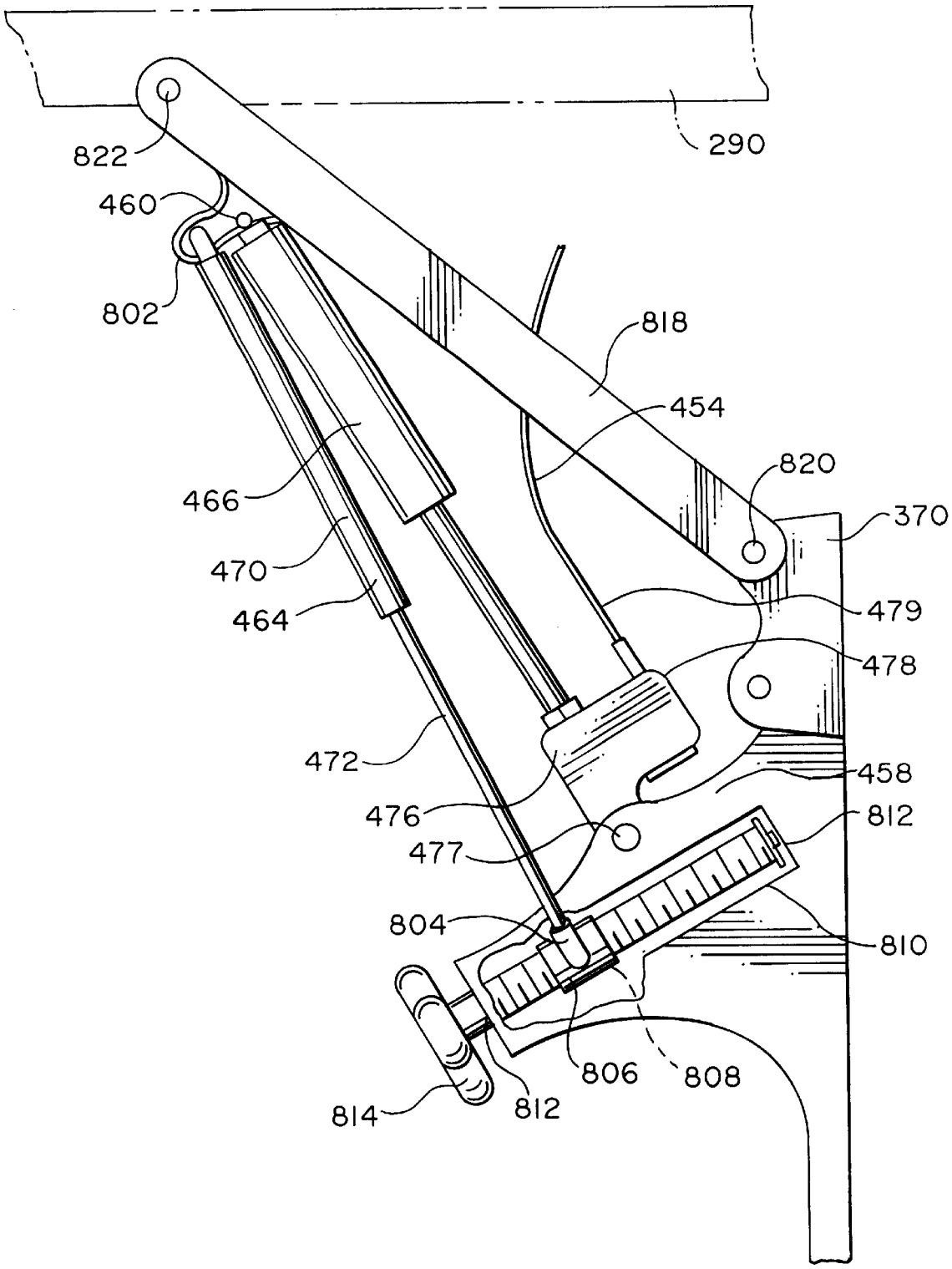
FIG. 34*b* is a side elevational view of an alternative embodiment of the compressed gas spring assembly supporting the work surface, a portion of the depiction being cut away.

A threaded screw may be used to similarly to adjust a pivoting link member as well, thereby adjusting the leverage point. Such a device is depicted in FIG. 34*b*. The secondary gas spring 464 is coupled at a first end 802 to the bracket 460 and at a second end 804 to a sleeve 806. The sleeve 806 has a threaded bore 808 defined therethrough. A threaded bolt 810 is rotatably engaged in the bore 808. The threaded bolt 810 is rotatably borne in bushings 812. There is no threaded engagement with the bushings 812, such that rotation of the bolt 810 does not result in translation of the bolt 810 relative to the bracket 458. A manually actuatable handle 814 is available at the exposed end of the bolt 810. Rotation of the bolt 810 acts to move the sleeve 806 along the longitudinal axis of the bolt 810. Such movement adjusts the leverage of the secondary gas spring 464 acting on the work surface 290. Such variance in the force exerted by the secondary gas spring 464 permits readily supporting both relatively light and relatively heavy objects on the work surface 290.

A fixed link 818 may also be used with this embodiment. The link 818 is pivotally coupled at a proximal end by pivot point 820 to the frame 370. The distal end of the link 818 is pivotally coupled to the work surface 290 at a pivot point The bracket 460 may be fixedly coupled to the link 818 proximate the distal end thereof.

As indicated above, the primary gas spring 462 is coupled at a first end to an actuator body 476, as best depicted in FIG. 34*a*. The actuator body 476 is coupled to the first support bracket 458 by a pin 477 that passes through bores (not shown) defined in both the actuator body 476 and the first support bracket 458, which bores are brought into registry.

A coupler 478 fixedly couples the sheath 479 of the concentric cable 454 to the actuator body 476. A cable 480 that is concentric with the sheath 479 is free to translate relative to the sheath 479 responsive to actuation of the actuator handle 452. The cable 480 is coupled to a lever 484 by a suitable connector 482. The connector 482 may be a sphere of metal formed on the end of the cable 480 and disposed in a bore defined in the lever 484.

The lever 484 is preferably an elongate metal bar. The lever 484 is pivoted about a fulcrum 486 supported on a pin 487 that passes through a bore (not shown) defined on the lever 484 and bores defined in the walls of the actuator body 476. A connector 488 is included at the distal end of the lever 484 for connecting the lever 484 to the primary gas spring 462.

Figure 31:
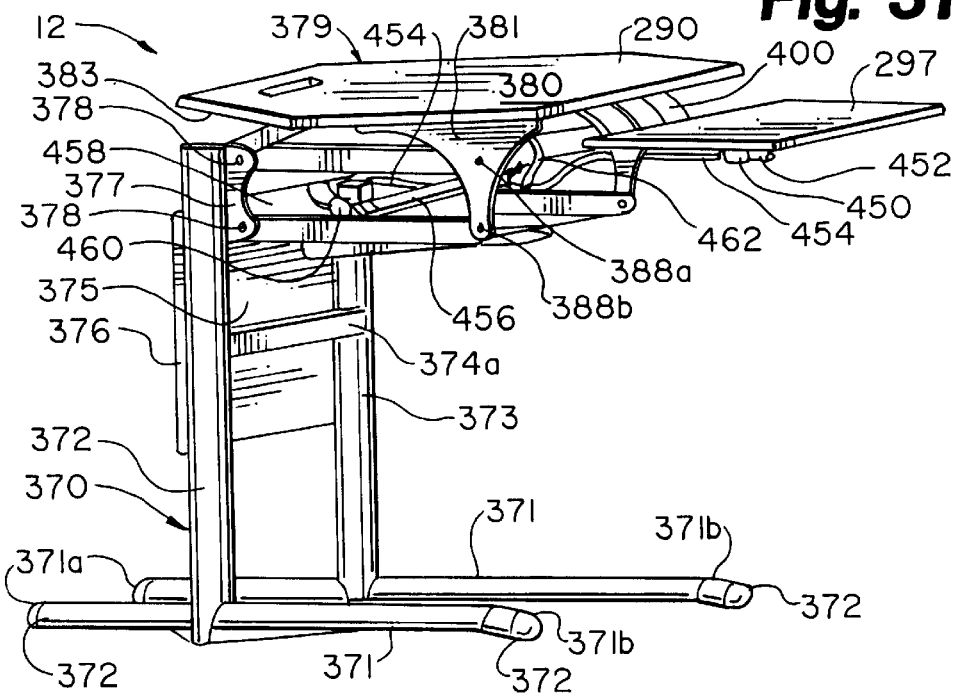
FIG. 31 is a rear quarter perspective view of the work station assembly of a further preferred embodiment of the present invention.
Figure 32:
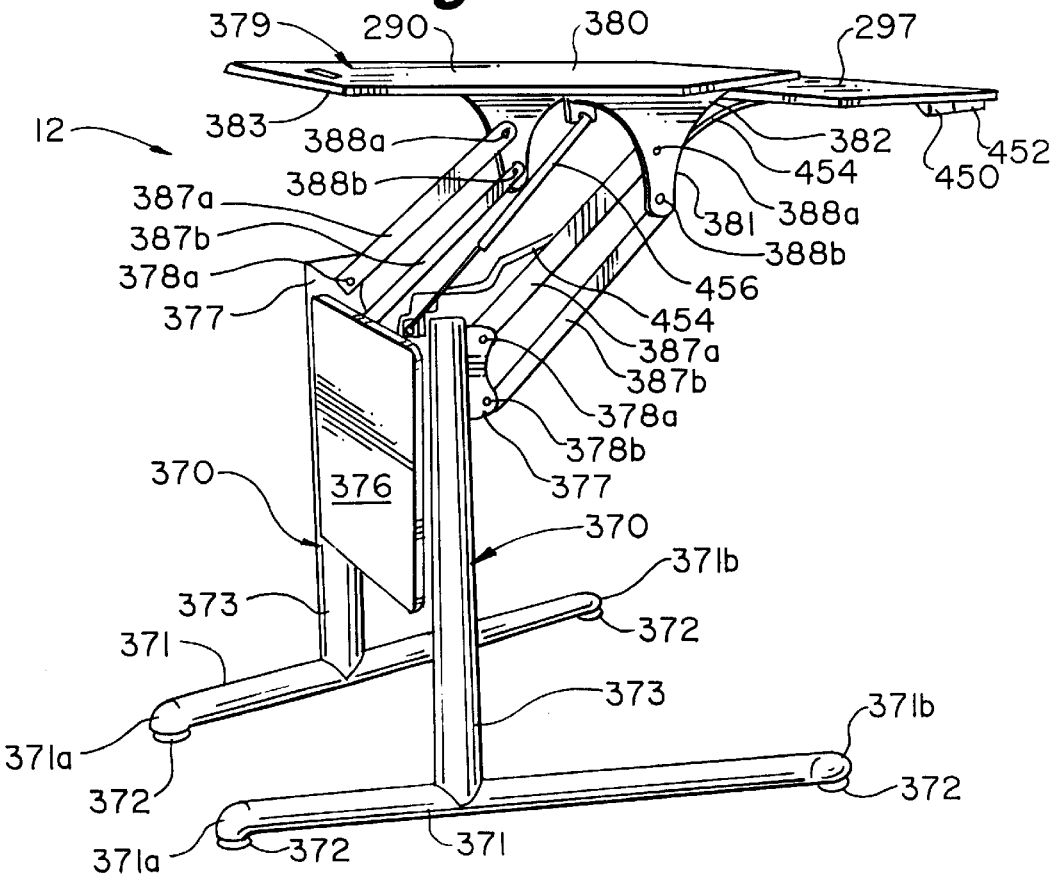
FIG. 32 is a front quarter perspective view of the work station assembly of FIG. 31.

The primary gas spring 462 has three concentric components. The first such component is the cylinder 490. The second component is a translatable piston 492 disposed within the cylinder 490. The third component is a locking rod 494 disposed within the piston 492. A first end of the locking rod 494 is coupled to the connector 488. The primary gas spring 462 (and any secondary gas springs 464) generally bias the work surface assembly 379 upward relative to the frame 370 to the elevated spatial relationship generally as depicted in FIG. 32 as distinct from the depressed spatial relationship as depicted in FIG. 31.

In operation, the primary gas spring 462 is locked at a specific length, the piston 492 being locked relative to the cylinder 490 when the locking rod 494 is disposed to the left as depicted in FIG. 34*a*. To shift the work surface assembly 379 relative to the frame 370, such as to move the work surface 379 from the disposition depicted in FIG. 31 to the disposition depicted in FIG. 32, the operator actuates the actuator handle 452. Referring to FIG. 34*a*, such actuation causes the cable 480 to retreat within the sheath 479, resulting in counter clockwise rotation of the lever 484 as indicated by the arrow C. Such rotation results in an unlocking withdrawal of the locking rod 494 from the piston 492. Such withdrawal is indicated by rightward motion as depicted by arrow D. When the primary gas spring 462 is unlocked, a relatively low level of upward or downward pressure exerted by an operator on the keyboard surface 297 will result in translation of the work surface assembly 379 either upward or downward relative to the frame 370, as desired. When the work surface assembly 379 is in the desired spatial position relative to the frame 370, the actuator handle 452 was released by the operator. The locking rod 494 is biased in the inward locked disposition and accordingly the locking rod 494 retreats leftward within the piston 492 into a locked engagement. Once locked, the work surface assembly 379 is held in a fixed spatial relationship relative to the frame 370.

Figure 38:
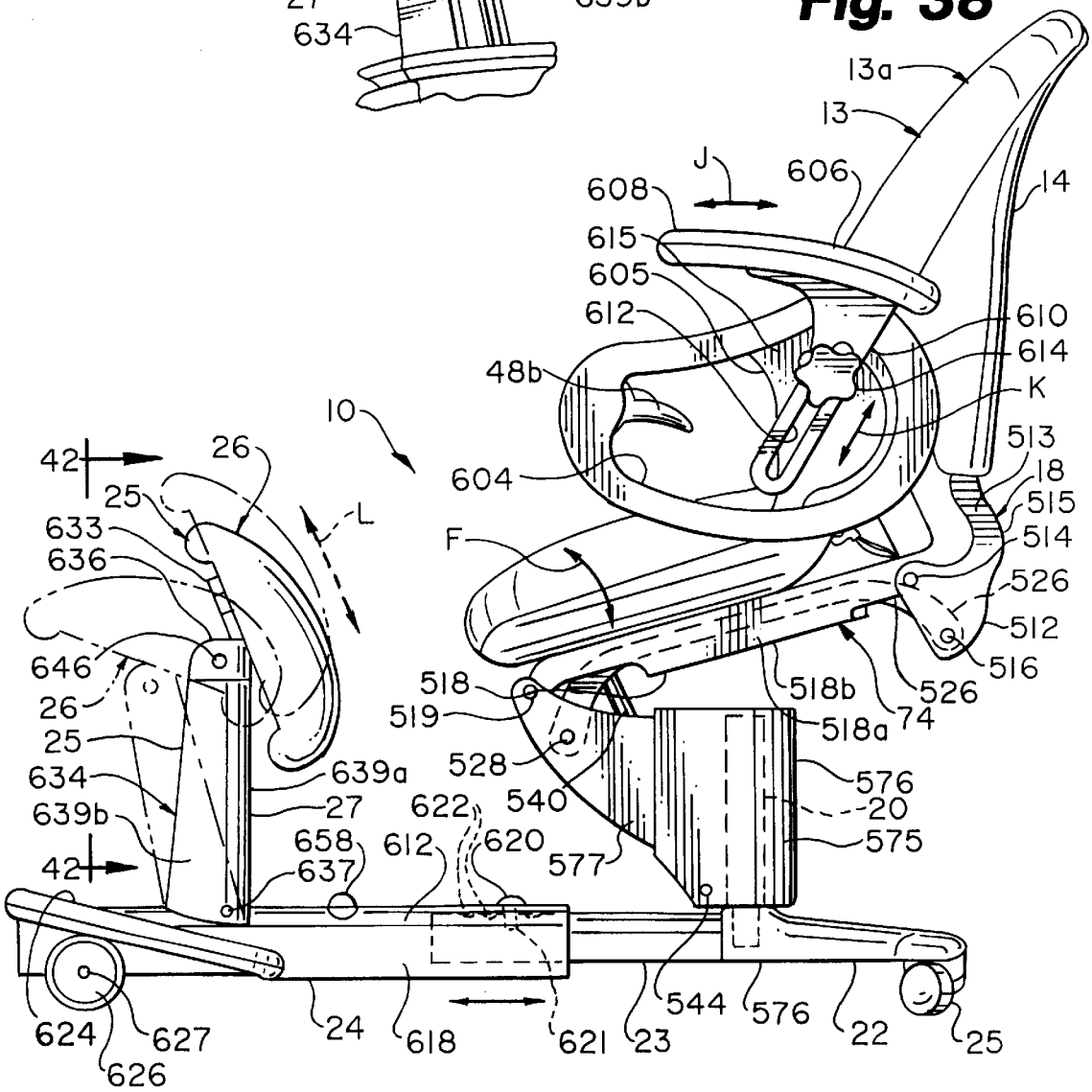
FIG. 38 is a side elevational view of the embodiment of FIG. 36 disposed in the lifted work position.
Figure 39:
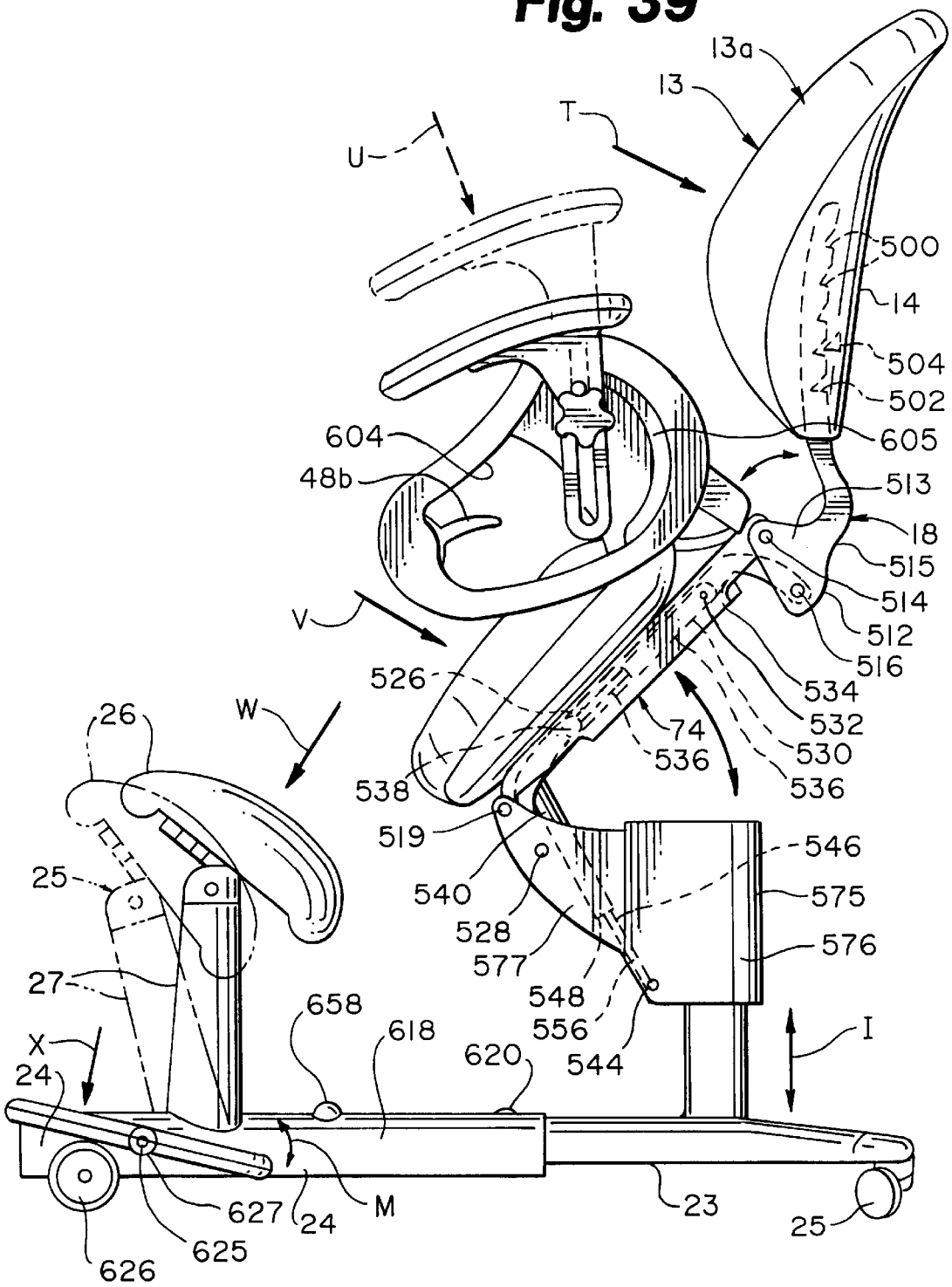
FIG. 39 is a side elevational view of the body positioning system in the lean stand position.

We turn now from the description of the work station 12 to the description of the positioning system 10. The positioning system 10 is depicted in FIGS. 36–44. It is important to note that cooperative body support is provided at all surfaces indicated by arrows T–X, as depicted in FIG. 39. As with the previous embodiments of the positioning system 10, the positioning system 10 of the present embodiment includes a chair assembly 13 having a chair 13*a*, the chair 13*a* having a back or pressure bearing surface 14 connected by joint 18 to a seat or pressure bearing surface 15. A pair of side supports 16 are fixedly coupled to the seat 15. One support 12 is disposed at either side of the seat 15.

The back 14 and the seat 15 are supported on an upward directed pedestal 20. The pedestal 20 is joined to two generally orthogonally disposed and outwardly directed stabilizers 22. A connector arm 23 lies in substantially the same plane as the stabilizers 22 and provides for the connection to a base member 24. Each of the two stabilizers 22 has a floor engaging caster thereon for providing ready mobility to the positioning system 10.

Figure 37:
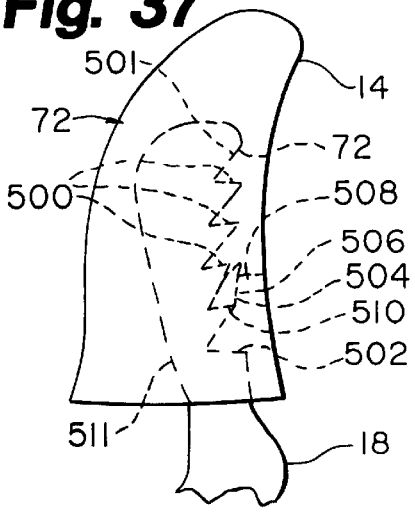
FIG. 37 is a sectional side elevational view of the chair back of the chair depicted in FIG. 36 disposed in the seated work position.

As depicted in FIG. 37, a height adjustment mechanism 72 is included to adjust the height relationship of the back 14 relative to the joint 18. In an embodiment, a plurality of ascending notches 500 are defined in the rear margin of the upper extension 511 of the joint 18. Each of the notches 500 defines a step 501. It should be noted that the lowest of the notches 500 includes a more pronounced lower step 502.

The back 14 includes a biased pawl 504. The pawl 504 is rotatable about a pivot point 506. A spring 508 biases the engaging face 510 of the pawl 504 into engagement with the steps 501, 502. It should be noted that the pawl 504 could as well be attached to the joint 18 and the notches 500 defined in the back 14.

To adjust the height of the back 14 relative to the joint 18, an operator simply grasps the lower portion of the back 14 and raises it slowly. The pawl 504 is heard sequentially engaging each of the ascending notches 500. When the desired height is reached, the operator simply stops raising the back 14 and the back 14 stays at the desired height as maintained by the pawl 504 engaged in the selected notch 500.

To lower the back 14 relative to the joint 18, the back 14 is raised all the way up. When the uppermost notch 500 is bypassed by the pawl 504, the pawl 504 is rotated by the bias of the spring 508 such that it no longer engages the steps 501, 502. The back 14 is then free to descend relative to the joint 18. When the pawl 504 engages the extended lower step 502 of the bottom notch 500 the pawl 504 is again rotated into engagement with the first notch 500. This is the lowest disposition of the back 14 relative to the joint 18. The back 14 may then be raised again to permit the pawl 504 to engage a selected notch 500 at a desired height. The range of motion of the back 14 relative to the joint 18 is approximately 6 inches from the disposition where the pawl 504 is engaged with the lowest notch 500 to the disposition in which the pawl 504 is engaged with the highest notch 500.

Figure 36:
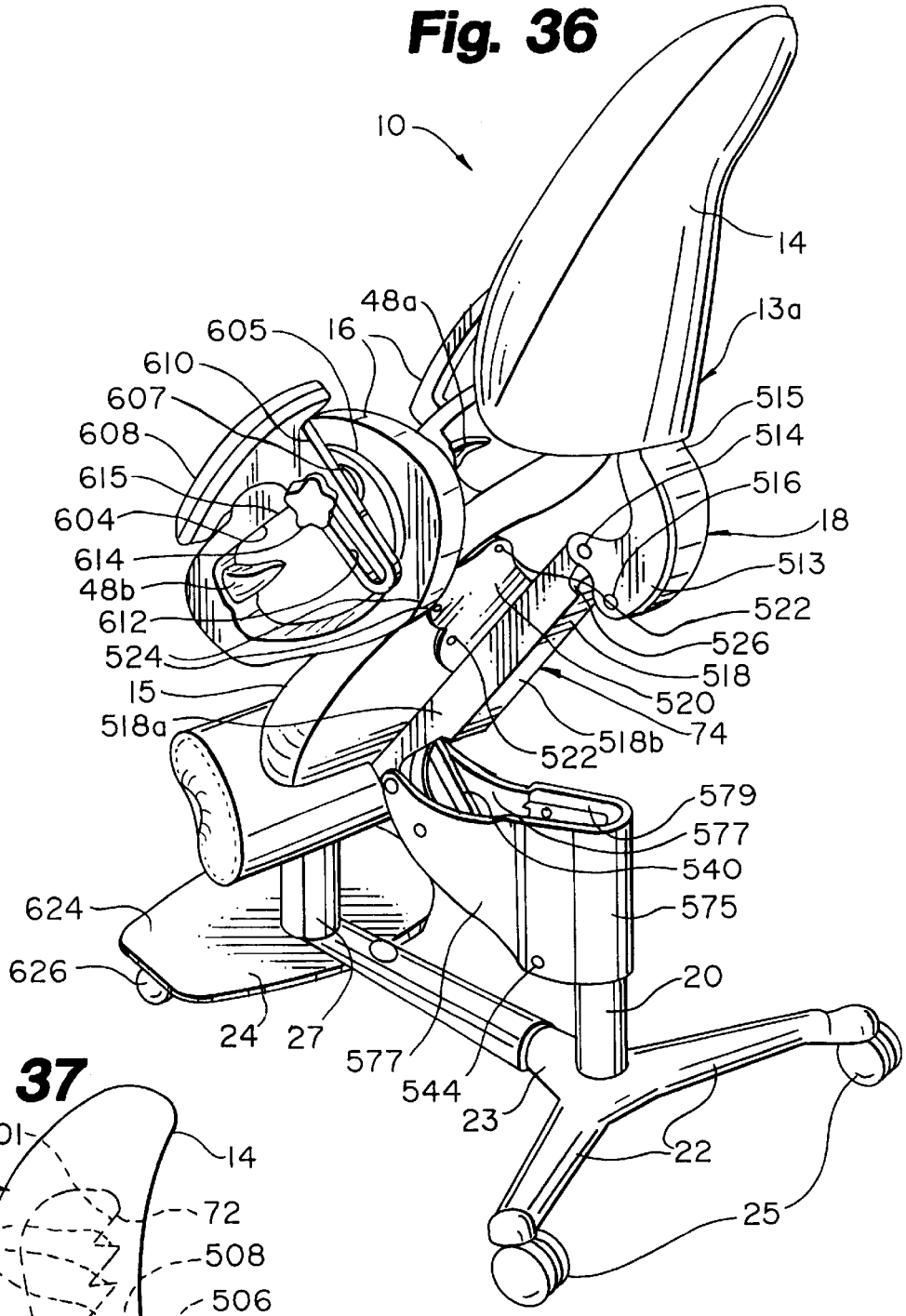
FIG. 36 rear quarter perspective view of the body positioning system assembly of a further preferred embodiment of the present invention.

The joint 18 includes the aforementioned upper extension 511 and a coupling end 512. The coupling end 512 of the joint 18 is depicted in FIGS. 36, 38, and 39. The coupling end 512 has two generally spaced apart side margins 513 joined by a back margin 515 to define a channel within the coupling end 512. A pair of pivot points 514, 516 are defined in each of the side margins 513. When viewed from the side, pivot points 514, 516 defined in each of the side margins 513 are in registry.

A structural frame 74 is disposed beneath the seat 15 and is operably connected to the joint 18 to support the back 14 and the seat 15 of the positioning system 10. The structural frame 74 includes a channel section 518 having spaced apart generally parallel side margins 518*a*, connected by a transverse bottom margin 518*b*. The two side margins 518*a* and the bottom margin 518*b* define the channel within the channel section 518.

A flange support 520 extends outward from the upper margin of each of the side margins 518*a* and is disposed substantially orthogonal with respect to the side margins 518*a*. The flange support 520 substantially underlies the seat 15 and provides the support for both the seat 15 and the side supports 16. Suitable connectors 522, which may be cap screws or screws connect the seat 15 to the flange support 520. Likewise, similar type connectors 524 connect the lower margin of the side supports 16 to the flange support 520.

A pair of parallel arms 526, best depicted in phantom in FIG. 38, reside within the channel defined within the channel section 518. The coupling end 512 of the joint 18 is pivotally coupled at pivot point 514 to the channel section 518 and is further pivotally coupled at pivot point 516 to a first end of each of the parallel arms 526. The channel section 518 is connected at a pivot point 519 to each of the spaced apart arms 577 of the pedestal assembly 576. Further, each of the parallel arms 526 is connected at pivot point 528 to a respective arm 577 of the pedestal assembly 576. The aforementioned connecting arrangement functions to keep the joint 18 oriented spatially in the same position without regard to whether the seat 15 is disposed at a great incline such as depicted in FIGS. 36 and 39, or at a lesser incline as depicted in FIG. 38. The effect of this is that the back 14 has a substantially fixed orientation in space and simply moves up and down with the same incline in space as the incline of the seat 15 is changed.

Referring to FIG. 39, an auxiliary gas spring 530, depicted in phantom, is disposed between the two parallel arms 526. The auxiliary gas spring 530 is connected at a first end at pivot point 532 to connector 534. Connector 534, in turn, is fixedly coupled to the channel section 518 (see FIG. 40). The auxiliary gas spring 530 is connected at a second end via a pin connector 538 to both of the parallel arms 526. In such disposition, the auxiliary gas spring 530 exerts a bias that tends to tilt the seat 15 into the more tilted disposition as depicted in FIG. 39 as compared to the more level disposition as depicted in FIG. 38.

The incline of the seat 15 is primarily effected by the primary gas cylinder 540. The primary gas cylinder 540 is depicted in FIGS. 36, 38, and 39 and in detail in the sectional representations of FIGS. 40 and 41. The primary gas cylinder 540 is connected at a first end to a cross-bracket 542. The cross-bracket 542 is fixedly coupled to each of the margins 518*a* of the channel section 518. The primary gas cylinder 540 has a piston 546 and a cylinder 548. The cylinder 548 is disposed upward connected proximate the cross-bracket 542. The piston 546 extends generally downward from the cylinder 548 and is coupled to a bracket 550.

Figures 40, 41:
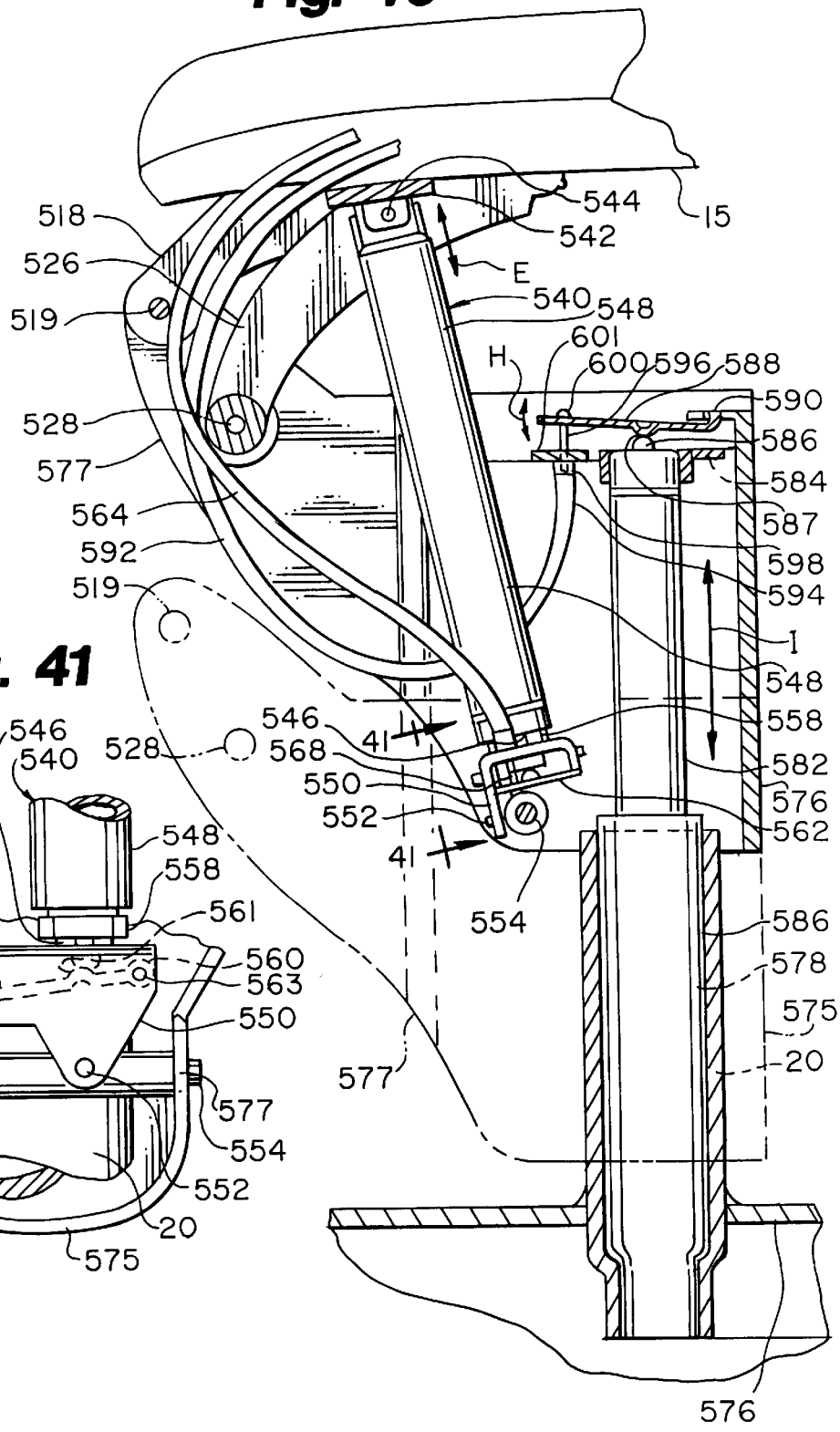
FIG. 40 is a side elevational view of the sectioned pedestal and the primary gas cylinder supporting the chair assembly.
FIG. 41 is a rear elevational view of the primary gas cylinder actuator assembly.

The bracket 550 has a generally inverted J-cross-sectional shape as depicted in FIG. 40. A connecting pin 552 passes through a bore (not shown) defined in the bracket 550 and through a bore (not shown) defined in a cross-pin 554 to couple the cross-pin 554 to the bracket 550. The cross-pin 554 is pivotally coupled to and extends between the two parallel arms 577 of the pedestal assembly 576. A lock nut 558 secures the piston 546 to the bracket 550.

A shiftable concentric lock 560 is disposed coaxially with the piston 546 of the primary gas cylinder 540. The concentric lock 560 extends through a bore (not shown) defined in the bracket 550. The concentric lock 560 is biased in the outward, locked disposition relative to the piston 546. As such, the concentric lock 560 normally resides in the fully extended and locked disposition as depicted in FIG. 41. A pivotable lever 562 is disposed within the bracket 550 and pivots about a pivot point 563. In a preferred embodiment, a raised portion 561 of the lever 562 is in contact with the end of the concentric lock 560.

A cable assembly 564 is coupled to the distal end of the lever 562. The cable assembly 564 has a sheath 566 that is fixedly coupled to the bracket 550 by a coupler 570. A shiftable cable 568 is disposed concentric (coaxial) with the sheath 566 and is selectably translatable relative to the sheath 566. A first end of the shiftable cable 568 is coupled to the lever 562 by a suitable connector 572. This connector may be a ball of metal affixed to the end of the shiftable cable 568. The other end of the cable assembly 564 is connected to the trigger 48*a* substantially as indicated in FIG. 8.

In operation, the tilt of the seat 15 is fixed relative to the pedestal assembly 566 by the locking engagement of the concentric lock 560 within the piston 546. The outwardly directed bias on the concentric lock 560 acts to force lever 562 to rotate in a counter-clockwise direction relative to the pivot point 563. Such action acts to extend the shiftable cable 568 in the downward direction, indicated by arrow G, as depicted in FIG. 41. Actuation of the trigger 48*a* acts to retract the shiftable cable 568 upward as indicated by arrow G relative to the sheath 566. The raised portion 561 of the lever 562 bears on the end of the concentric lock 560 forcing the lock 560 upward within the cylinder 548 and unlocking the concentric lock 560. While the trigger 48*a* is held in the actuated position, the primary gas cylinder 540 is unlocked and the primary gas cylinder 540, in cooperation with the auxiliary gas spring 530, acts to tilt the seat 15 from the level disposition of FIG. 40 through an intermediate disposition of FIG. 38 to the fully tilted disposition as depicted in FIGS. 36 and 39. At any point in the travel of the seat 15 the inclination thereof can be fixed by simply releasing the trigger 48*a*. Such release results in the bias acting on the concentric lock 560 to return the concentric lock 560 to the locked condition.

To return the seat 15 from an inclined disposition as depicted in FIG. 39 to a more level disposition as depicted in FIG. 40, the trigger 48*a* is again actuated to unlock the concentric lock 560. An operator's pressure on the back of the seat 15 causes the primary gas cylinder 540 to compress downward as indicated by arrow E of FIG. 40 resulting in rotation downward as indicated by the arrow F in FIG. 38. Again, the declination of the seat 15 can be arrested at any point in its travel as indicated by arrow F by simply releasing the trigger 48*a* and returning the concentric lock 560 to the locked position.

The pedestal 20 is a component of the pedestal assembly 576. The pedestal assembly 576 is depicted in greatest detail in FIG. 40 and is also shown in FIGS. 36, 38, and 39.

The pedestal assembly 576 includes a unitary support component 575 that comprises a wrap around envelope 579 that substantially envelopes the pedestal 20 and extends outward to include the substantially parallel arms 577 which have been discussed without detail above. Preferably, the support component 575 that comprises the envelope 579 and arms 577 is a major structural element and is formed of ¼ inch thick steel plate. The support component 575 is free to rotate relative to the pedestal 20 so that an operator may swivel the unit comprising the back 14 and seat 15 relative to the pedestal 20.

A gas cylinder assembly 578 is disposed substantially concentric with a bore defined within the pedestal 20. A portion of the gas cylinder assembly 578 projects above the top margin of the pedestal 20. As will be described, the gas cylinder assembly 587 facilitates substantially vertical translation of the support component 575 relative to the pedestal 20.

The gas cylinder assembly 578 includes a cylinder 580 having a shiftable, translatable piston 582 disposed therein. The gas cylinder assembly 578 is mounted such that the cylinder 580 is disposed substantially within the pedestal 20 and the cylinder 580 projects upward therefrom. The distal end of the piston 582 is fixedly coupled to a mounting bracket 584 that is disposed proximate the top margin of the envelope 579. The concentric lock 586 is disposed within the piston 582 and projects above the upper margin of the piston 582.

A raised portion 587 of a lever 588 bears on the distal end of the concentric lock 586. The lever 588 is pivotable about a lever pivot 590 that is operably coupled to the support component 575. The pivoting motion of the lever 588 is indicated by arrow H.

A cable assembly 592 is operably coupled to the distal end of the lever 588. The cable assembly 592 is a coaxial cable having a sheath 594 surrounding a shiftable, translatable coaxial cable 596 disposed within the sheath 594. A first end of the cable 596 is coupled by a connector 600 to the distal end of the lever 588. The sheath 594 of the cable assembly 592 is fixedly coupled by a coupler 598 to a small bracket 601 that is formed integral with the support component 575. The second end of the cable 596 of the cable assembly 592 is coupled to the trigger 48*b*, similar to the coupling of cable 90 and trigger 48*a*, 48*b* in FIG. 8.

Vertical shifting of the support component 575 relative to the pedestal 20 of the pedestal assembly 576 is effected by actuation of the trigger 48*b*. Such shifting carries with it both the back 14 and seat 15 of the positioning system 10 and accordingly affects the height of the back 14 and seat 15 above the floor surface on which the positioning system 10 is resting. In the depiction of FIG. 40, the support component 575 is in its full upper position. Accordingly, the seating surface of the seat 15 is at its highest disposition above the surface on which the positioning system 10 is resting. The concentric lock 586 is biased in its upward locked disposition, locking the back 14 and seat 15 at the depicted height.

To lower the support component 575 to the disposition indicated in phantom in FIG. 40, an operator actuates trigger 48*b*. Such actuation causes the lever 588 to rotate generally counter-clockwise. The pressure of the raised portion 587 bearing on the distal end of the concentric lock 586 forces the concentric lock 586 inward into the piston 582, thereby unlocking the concentric lock 586. Downward pressure applied on the seat 15 will cause the seat 15 and the support component 575 to move downward as indicated by arrow I to the phantom position. Such pressure compresses the gas in the cylinder 580. When the seat 15 has achieved its desired height, the operator simply releases the trigger 48*b* and the bias that biases the concentric lock 586 into the locked disposition forces the lever 588 in a clockwise rotation as indicated arrow H to the locked disposition of the concentric lock 586, thereby locking the back 14 and seat 15 at the desired height.

To raise the height of the seat 15, an operator merely again actuates the trigger 48*b* to unlock the concentric lock 586. The energy stored within the gas cylinder assembly 578 causes the seat 15 mounted on the component comprising the arms 577 and envelope 579 to rise to a desired height as indicated by arrow I, at which point the operator simply releases the trigger 48*b* and the concentric lock 586 then again locks the gas cylinder assembly 578 in the desired position.

Reference has been made to the triggers 48*a*, 48*b* mounted on the two side supports 16. The features of the side supports 16 will now be described. The side supports 16 are depicted in FIGS. 36–39.

Each of the side supports 16 has a generally kidney-shaped support loop 604. The support loop 602 has an aperture 604 defined therein. A support web 605 is fixedly disposed within the aperture 604. It is generally not intended that the support loop 602 provide arm support for a user of the positioning system 10. That function is left to the arm supports 606.

Each of the side supports 16 has an arm support 606 that is selectively, fixedly coupled to the respective support web 605. This support arm 606 is coupled to the support web 605 by means of a mounting disk 607 that is interposed between the support web 605 and arm support 606. The mounting disk 607 has a threaded bore (not shown) defined therein.

Each of the arm supports 606 has a curvilinear support surface 608. The curvilinear support surface 608 is preferably cushioned and designed to support the arms of an operator. A support bracket 610 depends from the curvilinear support surface 608. The support bracket 610 has an elongate slot 612 defined therein. A lock nut 614 is passed through the slot 612 and threadably engaged with the threaded bore defined in the mounting disk 607. The lock nut 614 has a large knurled handle 615 that may be readily grasped by an operator to engage and disengage the lock nut 614 as desired.

The arm supports 606 are movable relative to the support loop 602 both rotatably and linearly translatably as indicated by arrows J and K, respectively.

To position the arm support 606 as desired, the operator simply loosens the lock nut 614. The support bracket 610 may then be rotated as indicated by arrow J or moved linearly as indicated by arrow K and then relocked in the desired position by grasping an rotating handle 615 to retighten the lock nut 614.

The final major element of the positioning system 10 is the base structure 24. The base structure 24 is depicted in FIGS. 36, 38, 39, and 42. Generally, the base structure 24 is a major structural component of the support system 10, cooperating with the stabilizers 22 and connector arm 23 to support the support system 10 on a surface. A lower leg support 25 is included at the forward portion of the base structure 24. The lower leg support 25 includes a support pad 26 that is designed to support the knee and upper shin portion of the lower legs of an operator. The support pad 26 is supported on a link member 27 coupled to the base structure 24, described in greater detail below.

The base structure 24 includes a forward directed support tube 618. The support tube 618 acts as a receiver for the connector arm 23 as indicated in FIG. 38, the connector arm 23 is fixedly coupled to the support tube 618 by a fastener 620. In an embodiment, the fastener 620 has a hex-type head, requiring a tool to engage and disengage the fastener 620. The fastener 620 has a threaded shank that is threaded into a threaded bore 622 defined in the connector arm 623. Preferably, there are plurality of threaded bores 622 disposed linearly along the upper margin of the connector arm 23. In this manner, the total length of the combined connector arm 23 and support tube 618 can be adjusted as desired. This is an adjustment that is designed to not be made on a routine basis in an embodiment and accordingly, as indicated above, the fastener 620 requires a tool for engagement and disengagement.

A foot rest 624 may be fixedly coupled to the support tube 618 proximate the distal end thereof. See FIG. 37. Alternatively, the foot rest 624 may be adjustable as desired to adjust the angle presented to the user's feet. A friction lock disposed between the foot rest 624 and the base structure 24, augmented by a manually actuatable knob 627, as depicted in FIG. 39, may be used to vary the tilt of the foot rest 624, as indicated by the arrow M, about the pivot point 625. The knob 726 is preferably coupled to a threaded rod (not shown) that passes through a friction material comprising the friction lock and is threaded into a threaded receiving bore (not shown) defined in the base structure 24. Tightening the knob acts to compress the friction material, thereby fixing the angle of the foot rest 624.

A pair of spaced apart wheels 626 are positioned beneath and supported by the foot rest 624. As distinct from the casters 25, the wheels 626 are mounted on a fixed axle such that they do not caster in the depicted embodiment. It is understood that the wheels 626 could be replaced with casters, as desired.

Figure 43:
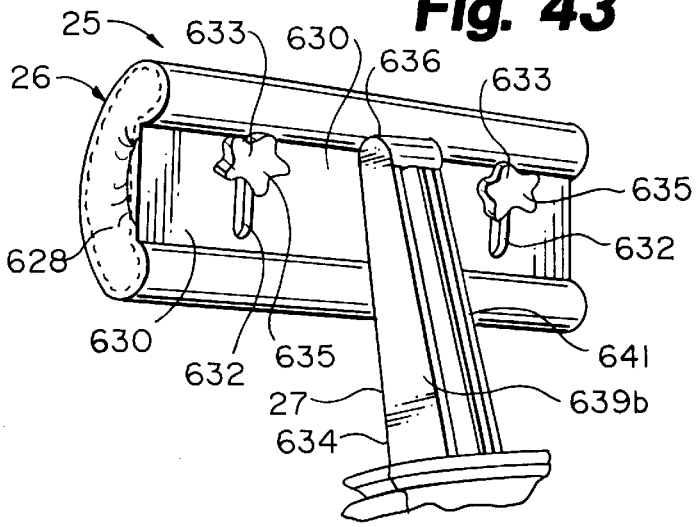
FIG. 43 is a front perspective view of the lower leg-support assembly.

Details of the lower leg support 25 are as follows with reference to FIGS. 38, 42, and 43. The lower leg support pad 26 has a cushion 628 affixed to a support plate 629. The support plate 629 is brought into flush engagement with a slotted plate 630 that is fixedly coupled to the link member 27. Plates 629, 630 are shiftable relative to one another. A plurality of elongated slots 632 are defined generally vertically in the slotted plate 630. A lock nut 633 is passed through the respective slots 632. Each of the lock nuts 633 has a knurled handle 635 to facilitate manual engaging and disengaging of the lock nut 633. The lock nuts 633 in combination with the slots 632 facilitate a generally vertical adjustment of the support pad 26 relative to the link member 27, as indicated by the arrow L in FIG. 38. By disengaging the lock nuts 633, the support pad 26 may be moved as indicated by arrow L through a range of motion limited by the length of the slots 632. When the desired height of the support pad 26 is achieved, the lock nuts 633 may be simply reengaged by an operator by rotating the handle 635 of the lock nut 633, as depicted in FIG. 43.

As indicated above, the support pad 26 is operably coupled to the base structure 24 by the link member 27. As depicted in FIGS. 42 and 43, the link member 27 includes a structural upright 634. The upright 634 has a channel defined therein. The channel is defined by a curved margin 639*a* connecting to generally parallel side margins 639*b* of the upright 634. The curved margin 639*a* preferably faces an operator seated in the seat 15. An opening 641 is defined by the edge margins of the side margins 639*b* and is generally opposite the curved margin 639*a*. The upright 634 is pivotally coupled to the base 24 at a hinge point 637. The upright 624 is capped with a dome 636.

A gas spring 638 resides within the channel defined within the upright 634. The gas spring 638 has a cylinder 640 and a concentric, translatable piston 642. A connector 644 is fixedly coupled to the upper margin of the cylinder 640 and is rotatably coupled to the upright 634 proximate to the dome 636 by a pin 646. The distal end of the piston 642 is fixedly coupled to a bracket 650 by a lock nut 648. The bracket 650 is pivotally coupled to the base 24 at a pivot point 652. It should be noted that the pivot point 652 is spaced apart from the hinge point 637 creating a moment arm therebetween. The bias exerted by the gas spring 638 and the upright 634 tends to bias the upright 634 into the rearward disposition indicated by solid lines in FIG. 42.

A cam actuator 654 is disposed within the bracket 650. The cam actuator 654 has a cam surface 655 that bears on a concentric lock 656 that is translatably disposed within the piston 642 of the gas spring 638. The operation of such concentric lock 654 has been previously described. To reiterate, the concentric lock is biased in the locked disposition as indicated in FIG. 42, locking the cylinder 640 and piston 642 at a certain length. Generally upward pressure on the concentric lock 656 causes the concentric lock 656 to translate to an unlocked disposition, thereby permitting pivoting action of the link member 27 as will be described.

The cam actuator 654 is pivotally coupled at a pivot 659 to the bracket 650. Rotating the cam actuator 654 about the pivot 659 results in the cam surface 655 bearing on the concentric lock 656 to unlock the concentric lock 656.

An actuator assembly 658 is operably coupled to the cam actuator 654. The actuator assembly 658 includes a foot pedal 660 that is translatable generally in a vertical direction. The foot pedal 660 is operably coupled to a lever 662. A coaxial cable assembly 664 is operably coupled at a proximal end to the lever 662. The cable assembly 664 is operably coupled at a distal end to the cam actuator 654. The cable assembly 664 has a sheath 666 surrounding a shiftable coaxial cable 668 disposed therein. At a first end, the sheath 666 is fixedly coupled by a connector 670 to a pedal bracket 671. At a second end, the sheath 666 is fixedly coupled by a connector 672 to the bracket 650. The distal end of the cable 668 is coupled to the cam actuator 654 by a connector 674.

Figure 42:
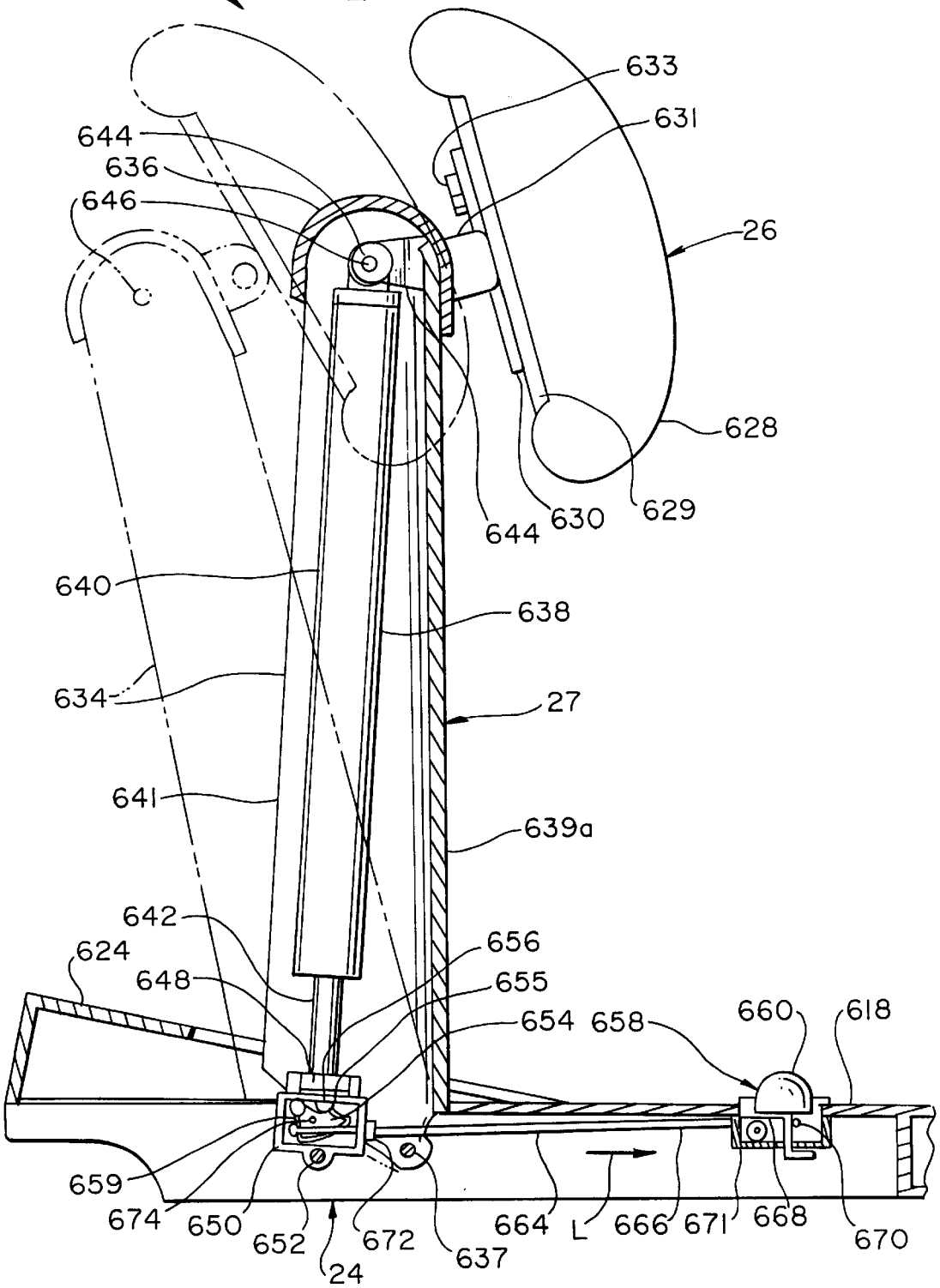
FIG. 42 is a side elevational view of the lower leg-support assembly with the forwardmost disposition thereof depicted in phantom.

To position the support pad 26 as desired between a leftmost (forward) disposition indicated in phantom in FIG. 42 and a rightmost (rearward) disposition depicted in solid in FIG. 42, an operator depresses the foot pedal 660. Such action causes the cable 668 to translate in the direction indicated by the arrow L of FIG. 42. Such translation rotates the cam actuator 654 about the pivot 659 causing the cam surface 655 to depress and unlock the concentric lock 656.

When unlocked, the bias exerted by the gas spring 638 positions the support pad 26 and link member 27 as indicated in solid in FIG. 42. The support pad 26 may be stopped at any disposition between the phantom depiction and the solid depiction thereof by simply releasing pressure on the foot pedal 660. The downward bias of the concentric lock 656 will then cause the concentric lock 656 to retreat to its lowermost and locked disposition.

To move the support pad 26 from its rightmost disposition as depicted in FIG. 42 to its leftmost disposition, the foot pedal 660 is again depressed and leftward pressure must be applied to the support pad 26 to overcome the bias exerted by the gas spring 638. Again, when the desired position is achieved, the downward pressure on the foot pedal 660 is simply released and the concentric lock 656 again locks the gas spring 638 at that position.

Figure 44:
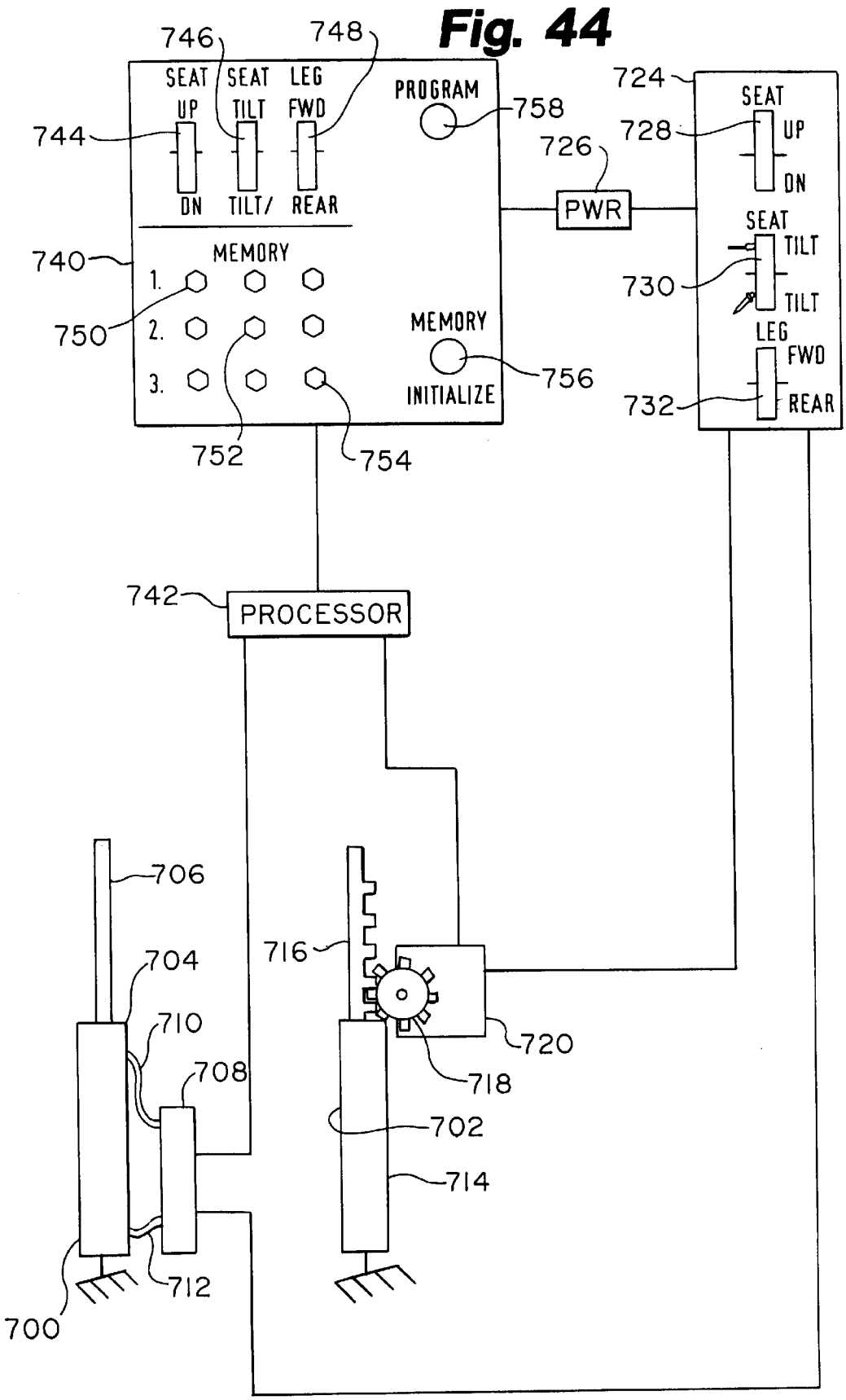
FIG. 44 is a schematic representation of controllers and actuators for a powered embodiment of the present invention.

Up to this point, the body positioning system 10 of the present invention has been described as a purely mechanical device. Alternatively, the system 10 may be adapted to be powered. Referring to FIG. 44, any or all of the actuators comprising primary gas cylinder 540, gas cylinder assembly 578, and/or gas spring 638 (the aforementioned purely mechanical devices) may be replaced by powered actuators. Such powered actuators may include, for example, hydraulic actuator or pneumatic actuator 700 and rack and pinion actuator 702. Other suitable powered linear actuators may also be used including, for example, a ball and screw device.

The hydraulic (or pneumatic) actuator 700 has a cylinder 704 with a translatable piston 706 disposed therein. The distal end of the cylinder 704 is fixed and the distal end of the piston 706 is affixed to the component of the system 10 to which motion is desired to be imparted. The motorized pump 708 selectively provides the flow of fluid (hydraulic fluid or air) via lines 710, 712 to the dual acting hydraulic (or pneumatic) actuator 700. By reversing the flow in the lines 710, 712, the piston 706 is either retracted or extended with respect to the cylinder 704.

Similarly, the rack and pinion actuator 702 includes a rack receiver 714 and a translatable tooth rack 716. The distal end of the rack receiver 714 is fixed, while the distal end of the rack 716 is attached to the component to which lineal motion is desired to be imparted. The pinion gear 718 is disposed proximate the rack 716 such that the teeth of the pinion gear 718 and the teeth of the rack 716 intermesh. A motor 720 imparts rotational motion to the pinion gear 718. Reversing direction of rotation of the pinion gear 718 causes the gear to translate into or out of the rack receiver 714 as desired.

A control 724 is in communication with a source of power 726 and is in communication with the hydraulic pump 708 of the motor 720. In an exemplary system, the controller 724 has three position switches thereon. Each of such switches has a neutral position and a first actuated position and a second actuated position. The first such switch is the seat up/down switch 728. Switch 728 in the neutral disposition locks the chair 13*a* in the current position. Actuating the up direction of the switch 728 causes the chair 13*a* to rise as long as the switch 728 is held in such disposition. The switch 728 is spring loaded to the neutral position and releasing pressure on the up actuation causes the switch 728 to turn to the neutral disposition by locking the chair 13*a* at the present disposition. Similarly, the seat 15 may be lowered by selecting the down disposition.

The seat 15 is tilted by actuation of the seat tilt switch 730. Selecting the first tilt actuation position tilts the seat 15 toward the generally level disposition and selecting the second tilt actuation tilts the seat 15 toward a more vertical disposition. Seat tilt switch 730 is also spring loaded to the neutral position in which the current tilt of the seat 15 is maintained.

The final switch on the controller 724 is for controlling the lower leg support 25. In the neutral disposition, the switch 732 maintains the lower leg support 25 in its current disposition. Actuating the first portion of the switch 722 moves the lower leg support 25 forward and actuating the second portion of the switch 732 moves the leg support 25 rearward. Like the switches 728, 730, the switch 732 is spring loaded to the neutral position.

An alternative controller 740 is also depicted in FIG. 44. The alternative controller 740 would be used in place of the controller 724. The controller 740 is operably coupled to a suitable source of power 726. Significantly, the controller 740 is coupled to a processor 742, the processor 742 permitting many more functions. For example, the controller 740 has three switches 744, 746, and 748 that duplicate the functions of the previously described switches 728, 730, and 732. Additionally the controller 740 has three memory switches associated with the functions seat up/down, seat tilt, and lower leg support position. Accordingly, a user can position the height of the chair 13*a* as desired using the switch 744 and then actuate the initialize switch 756 simultaneously with one of the three switches 750 to enter the existing position into memory. Subsequently, simply selecting the respective switch 750 will automatically return the height of the chair 13*a* to the memorized position. Similar functions are available by using the switches 752 for seat tilt 15 and 754 for lower leg support 25 position.

In order to minimize the repetitive stress on a user when performing a repetitive task, the controller 740 can be programmed to automatically simultaneously change the position of at least the seat 15 tilt and the lower leg support 25 on a set schedule. For example, by selecting the program actuator 758, a program is initiating in which a seat 15 tilt and the lower leg support 25 position is simultaneously changed automatically every 15 minutes of use to minimize user fatigue.

While the preferred embodiments of the present invention have been shown and described, it will be obvious to those skilled in the art that changers, variations and modifications may be made therein without departing from the present invention in its broader aspects.

Thus, although the present invention has been described with reference to preferred embodiments, workers skilled in the art will recognize that changes may be made in form and detail without departing from the spirit and scope of the invention in its broader aspects and, therefore, the aim in the appended claims is to cover such changes and modifications as fall within the scope and spirit of the invention.

What is claimed is:

1. An adjustable height work station, wherein the height of said work station is adjustable from a seated work level through a standing work level, comprising:

a base structure;

a work area supported on a bracket and having a substantially planar surface adapted to be adjusted from a seated work level through a standing work level; and a lift arm and a follower arm, said follower arm parallel to and disposed below said lift arm, said lift arm and said follower arm each having a first end and a second end, each of said first ends pivotally secured to said base structure and said second ends being pivotally secured to the bracket of said work area, said first ends and said second ends being pivotable through a range of motion to raise and lower said work area between a seated work level and a lifted work level while maintaining said planar surface in a substantially horizontal position throughout said range of motion; and an air cylinder fixedly secured to said base structure at a first end and fixedly secured to said work area, at a second end, wherein said air cylinder is disposed adjacent said lift and follower arms, wherein said air cylinder assists said lift arm in raising said work area from said seated level through said lined work level.

2. The adjustable height work station of claim 1, further comprising a second lift arm and a second follower arm parallel to the first lift and follower arms.

3. The adjustable height work station of claim 1, further comprising a second work area mounted to the work area, wherein said second work area has an adjustable depth position relative to a depth position of said work area.

4. The adjustable height work station of claim 1, further comprising a second work area, wherein said second work area is angularly adjustable in reference to the work area.

5. The adjustable height work station of claim 1, further comprising a handle, wherein said handle is operably coupled to said lift arm.

6. An adjustable height work station, wherein the height of said work station is adjustable between a seated work level and a lifted work level, comprising:

support means for supporting a lifting means;

work means supported on a bracket for providing a planar work surface area adapted to be adjusted from a seated work level through a standing work level; and lifting means for lifting said work means between a seated work level and a lifted work level and for maintaining said work means in a substantially horizontal orientation when said work means is transitioned from said seated work level and through said standing work level;

a second lift means secured to a bracket on said work means below said lifting means, said second lift means for operating in conjunction with said lifting means for lifting said work means between a seated work level and a lifted work level and for maintaining said work means in a substantially horizontal orientation when said work means transitioned between said seated work level and said lifted work level; and air lift means for providing pneumatic assistance to said lifting means in lifting said work means between a seated work level and a lifted work level, air lift means secured to said work means and said support means and disposed adjacent said first and second lift means.

7. The adjustable work station of claim 6, further comprising handle means for pressing against to provide manual assistance to said lifting means in lifting said work means from a seated work level through a standing work level.

8. The adjustable work station of claim 6, further comprising second work means for providing a planar work surface in addition to and mounted to said work means.

9. The adjustable work station of claim 8, wherein said second work means is angularly adjustable in reference to said work means.

10. The adjustable work station of claim 8, wherein said second work means for providing a planar work surface has an adjustable depth position relative to a depth of said work means.

11. A work station system, comprising:

an adjustable height work station, wherein the height of said work station is adjustable from a seated work level through a standing work level, wherein said adjustable height work station comprises:

a base structure;

a work area supported on a bracket having a substantially planar surface adapted to be adjusted from a seated work level through a standing work level; and a lift arm and a follower arm, said follower arm parallel to and disposed below said lift arm, said lift arm and said follower arm each having a first end and a second end, each of said first ends pivotally secured to said base structure and said second ends being pivotally secured to the frame of said work area, said first ends and said second ends are being pivotable through a range of motion to raise and lower said work area between a seated work level and a lifted work level while maintaining said planar surface in a substantially horizontal position throughout said range of motion; and a body positioning system positioned proximate said adjustable height work station, wherein said body positioning system comprises:

a chair structure adapted to be adjusted from a seated work level through a standing work level;

lower leg support assembly; and a support structure having a plurality of wheels for repositioning said support structure, wherein said support structure supports said chair structure and said lower leg support assembly in a co-linear orientation, and wherein the supported chair structure, in combination with the supported lower leg support assembly, is adjustable to provided a seated work position through a standing work position corresponding to the seated work level and lifted work level of said adjustable height work station, respectively.

12. A work station system, comprising:

an adjustable height work station, wherein the height of said work station is adjustable between a seated work level and an elevated work level, the elevated work level being elevated with respect to the seated work level, wherein said adjustable height work station comprises:

a work surface member supported on a frame by a suspension assembly that includes two spaced apart parallelogram support links, the work surface member having a substantially planar work surface adapted to be adjusted from a seated work level through a standing work level, and wherein the suspension assembly spaced apart parallelogram support links each have a first end pivotally coupled to a work station frame and each have a second end pivotally coupled to the planar work surface;

wherein the adjustable height work station suspension assembly includes a work surface actuator assembly for selectively shifting a locking actuator assembly between a locked disposition and an unlocked disposition;

a keyboard surface member operably, shiftably coupled to the work surface member;

the suspension assembly being selectively shiftable through a range of motion to raise and lower said planar work surface from a seated work level through a standing work level while maintaining said planar work surface in a substantially horizontal disposition throughout said range of motion; and a body positioning system positionable proximate said adjustable height work station for cooperative interaction therewith for ergonomically positioning a user relative to the planar work surface, wherein said body positioning system comprises:

a base member;

a chair assembly operably shiftably coupled to the base member adapted to be adjusted from a seated work level through a standing work level;

a lower leg support assembly operably shiftably coupled to the base member;

the base member supporting said chair assembly and said lower leg support assembly in a co-linear disposition, and wherein the supported chair structure, in combination with the supported lower leg support assembly, is adjustable to provide a seated work position through a standing work position corresponding to the seated work level through a lifted work level of said adjustable height work station, respectively.

13. The work station system of claim 12, wherein the adjustable height work station suspension assembly includes a locking actuator assembly, the actuator assembly being operably coupled at a first end to the work station frame and being operably coupled at a second end to the planar work surface, the actuator assembly fixing the planar work surface relative to the work station frame when the actuator assembly is in a locked disposition, the actuator assembly being selected from a list consisting of art air cylinder, a powered hydraulic actuator, and a powered mechanical actuator.

14. The work station system of claim 12, wherein the adjustable height work station suspension assembly includes at least one biasing member, the at least one biasing member exerting an upward directed bias on the planar work surface.

15. The work station system of claim 12, wherein the keyboard surface member is selectively elevatable relative to the work surface member planar work surface such that the keyboard surface member may be disposed at a height relative to the work surface member planar work surface.

16. The work station system of claim 15 wherein the keyboard surface member is operably, shiftably coupled to the work surface member by a keyboard surface suspension, the keyboard surface suspension selectively fixing the disposition of the keyboard surface relative to the work surface member in both height and tilt.

17. The work station system of claim 12, wherein the body positioning system base member includes an elongated connector arm, the connector arm being adjustable to affect the distance that the chair assembly is displaced from the lower leg support assembly.

18. The work station system of claim 12, wherein the body positioning system base member includes at least one supporting surface engaging wheel.

19. The work station system of claim 18, further including four wheels disposed in pairs, a first pair of wheels being disposed proximate the lower leg support assembly and a second pair of wheels being disposed proximate the chair assembly, the first pair of wheels being rotatable plane that is substantially parallel to the co-linear disposition of the chair assembly and lower leg support assembly and the second pair of wheels castoring for being rotatable in at least two planes.

20. The work station system of claim 12 wherein the chair assembly chair seat includes a pair of side supports fixedly coupled to the seat and disposed flanking the seat.

21. The work station system of claim 20 wherein the chair assembly chair seat side supports each include an actuation trigger disposed thereon, a first actuation trigger for enabling a seat inclination adjustment and a second actuation trigger for enabling a height adjustment of the chair assembly.

22. The work station system of claim 20 wherein the chair assembly chair seat includes an arm support operably, shiftably coupled to each of the side supports, the arm support being linearly and rotatably adjustable relative to the respective side support.

23. The work station system of claim 22 wherein each of the arm supports is frictionally, rotatably coupled to the respective side support, the arm support being rotatable relative to the side support upon overcoming a certain frictional force.

24. The work station system of claim 12 wherein the lower leg support assembly includes a link member operably coupled to the base member and supports a lower leg pad, the lower leg support assembly being adjustable in a plane that includes the co-linear disposition.

25. The work station system of claim 24 wherein the link member of the lower leg support assembly includes a lockable gas spring, the gas spring exerting a rotational bias on the link member when the gas spring is in an unlocked disposition the gas spring acting to urge the link member in a rearward disposition proximate to the chair assembly.

26. The work station system of claim 25 wherein the link member of the lower leg support assembly is pivotally coupled to the base member at a first pivot point and the gas spring is pivotally coupled to the base member at a second pivot point, the first and second pivot points being spaced apart.

27. The work station system of claim 25 further including an actuator assembly being operably coupled to the lockable gas spring of the link member, the actuator assembly for selectively locking and unlocking the gas spring.

28. The work station system of claim 27 wherein the gas spring actuator assembly is disposed in the base member.

29. The work station system of claim 27 wherein the gas spring actuator assembly includes a foot pedal, the foot pedal being selectively shiftable between a locked disposition and an unlocked disposition, the foot pedal unlocking the lockable gas spring when in the unlocked disposition.

30. The work station system of claim 29 wherein the foot pedal of the gas spring actuator assembly is biased in the locked disposition.

31. The work station system of claim 12 wherein the lower leg support assembly is adjustable in a plane that is substantially vertical and includes the co-linear disposition.

32. The work station system of claim 12 wherein the lower leg pad of the lower leg support assembly is selectively adjustable in at least one dimension.

33. The work station system of claim 32 wherein the lower leg pad of the lower leg support assembly is selectively linearly adjustable.

34. The work station system of claim 32 wherein the lower leg pad of the lower leg support assembly is selectively rotatably adjustable.

35. The work station system of claim 12 wherein the chair assembly chair back is incrementally adjustable in height relative to the chair seat.

36. The work station system of claim 12 wherein the chair assembly chair seat and chair back are operably coupled, the inclination of the chair seat being adjustable independent of the chair back.

37. The work station system of claim 12 wherein the chair assembly chair seat and chair back are operably coupled, the elevation of the chair seat being adjustable in concert with the elevation of the chair back.

38. The work station system of claim 12, wherein the chair assembly includes a chair having a seat and a back, a height adjustment assembly for adjusting the height of the chair relative to the base member, and an inclination adjustment assembly for adjusting the inclination of the chair seat relative to the back.

39. The work station system of claim 38 wherein the chair seat and the chair back are operably, shiftably coupled by a multi-bar linkage, the multi-bar linkage effectively decoupling a inclination adjustment of the chair seat from the inclination of the seat back.

40. The work station system of claim 39 wherein the multi-bar linkage linking the chair seat and the chair back is a parallelogram linkage.

41. The work station system of claim 39 wherein the multi-bar linkage linking the chair seat and the chair back includes an auxiliary gas spring, the auxiliary gas spring exerting a bias on the chair seat acting to incline the seat relative to a generally horizontal seat disposition.

42. The work station system of claim 38 wherein the chair assembly includes a pedestal assembly, the pedestal assembly being pivotally, operably coupled to the base member for accommodating swiveling motion of the chair relative to the base member.

43. The work station system of claim 42 wherein the chair assembly height adjustment assembly is operably coupled to the pedestal assembly and to the chair, the height adjustment assembly including an actuator selected from a list consisting of a lockable gas cylinder assembly, a powered hydraulic actuator, and a powered mechanical actuator.

44. The work station system of claim 43 wherein a lockable gas cylinder of the height adjustment assembly is operably coupled to a second actuation trigger for enabling a seat elevation adjustment, actuation of the second actuation trigger acting to unlock the lockable gas cylinder assembly.

45. The work station system of claim 44 wherein the lockable gas cylinder exerts a substantially upward directed bias on the chair when the lockable gas cylinder is in an unlocked disposition.

46. An adjustable height work station, comprising:

a work surface member supported on a frame by a suspension assembly, the work surface member having a substantially planar work surface adapted to be adjusted from a seated work level through a standing work level;

a keyboard surface member operably, shiftably coupled to the work surface member;

the suspension assembly being selectively shiftable through a range of motion to raise and lower said planar work surface from a seated work level through a standing work level while maintaining said planar work surface in a substantially horizontal disposition throughout said range of motion;

wherein the suspension assembly includes two spaced apart parallelogram support links, each having a first end pivotally coupled to a work station frame and each having a second end pivotally coupled to the planar work surface;

where in the suspension assembly includes an actuator assembly selected from a list consisting of a locking compressed gas spring assembly, a powered hydraulic actuator, and a Dowered mechanical actuator, the actuator assembly being operably coupled at a first end to the work station frame and being operably coupled at a second end to the planar work surface, the actuator assembly fixing the planar work surface relative to the work station frame when the actuator assembly is in a locked disposition; and wherein the height of said work station is adjustable from a seated work level through an elevated work level, the elevated work level being elevated with respect to the seated work level.

47. The adjustable height work station of claim 46 wherein the keyboard surface member is selectively elevatable relative to the work surface member planar work surface such that the keyboard surface member may be disposed at a height relative to the work surface member planar work surface.

48. The adjustable height work station of claim 47 wherein the keyboard surface member is operably, shiftably coupled to the work surface member by a keyboard surface suspension, the keyboard surface suspension selectively fixing the disposition of the keyboard surface relative to the work surface member in both height and tilt.

* * * * *